US006446451B1

(12) United States Patent
Monk et al.

(10) Patent No.: US 6,446,451 B1
(45) Date of Patent: Sep. 10, 2002

(54) VARIABLE CAPACITY COMPRESSOR HAVING ADJUSTABLE CRANKPIN THROW STRUCTURE

(75) Inventors: David T. Monk; Joe T. Hill, both of Bristol, VA (US); Philip C. Wagner, Bristol, TN (US); Joseph F. Loprete, Bristol, TN (US); Michael R. Young, Bristol, TN (US); Charles A. Singletary, Bristol, VA (US)

(73) Assignee: York International Corporation, York, PA (US)

( * ) Notice: Subject to any disclaimer, the term of this patent is extended or adjusted under 35 U.S.C. 154(b) by 0 days.

(21) Appl. No.: 09/820,983

(22) Filed: Mar. 30, 2001

Related U.S. Application Data

(63) Continuation-in-part of application No. 09/235,288, filed on Jan. 22, 1999, now Pat. No. 6,217,287, which is a continuation-in-part of application No. 09/013,154, filed on Jan. 26, 1998, now Pat. No. 6,099,259.

(51) Int. Cl.[7] ..... F25B 1/00; F04B 1/06

(52) U.S. Cl. ..... 62/228.5; 62/229; 417/221; 417/326

(58) Field of Search ..... 62/229, 228.5, 62/324.6; 417/45, 221, 326

(56) References Cited

U.S. PATENT DOCUMENTS 4,245,966 A * 1/1981 Riffe ..... 417/539
4,248,053 A * 2/1981 Sisk ..... 62/158
5,951,261 A * 9/1999 Paczuski ..... 417/315
6,092,993 A * 7/2000 Young et al. ..... 417/53
6,099,259 A * 8/2000 Monk et al. ..... 417/15

* cited by examiner

*Primary Examiner*—William Wayner
(74) *Attorney, Agent, or Firm*—Finnegan, Henderson, Farabow, Garrett & Dunner, L.L.P.

(57) ABSTRACT

A two-stage reciprocating compressor is provided. The compressor includes a block with a single cylinder and associated single compression chamber and single piston. The compressor further includes a crankshaft. The crankshaft has an eccentric crankpin that is operatively connected to the piston. A reversible motor is provided to rotate the crankshaft in a forward direction and in a reverse direction. An eccentric cam is rotatably mounted on the eccentric crankpin. The eccentric cam is held stationary with respect to the crankpin when the crankshaft is rotating in the forward direction. When rotating in the forward direction, the crankshaft drives the piston at a full stroke between a bottom position and a top dead center position. The eccentric cam rotates with respect to the crankpin when the crankshaft is rotating in the reverse direction. When rotating in the reverse direction, the crankshaft drives the piston at a reduced stroke between an intermediate position and the top dead center position.

109 Claims, 37 Drawing Sheets

VARIABLE CAPACITY COMPRESSOR HAVING ADJUSTABLE CRANKPIN THROW STRUCTURE

RELATED APPLICATIONS

The present application is a continuation-in-part of application Ser. No. 09/235,288 filed on Jan. 22, 1999, now U.S. Pat. No. 6,217,287, which is a continuation-in-part of U.S Pat. No. 6,099,259 issued on Aug. 8, 2000 from application Ser. No. 09/013,154 filed on Jan. 26, 1998.

BACKGROUND OF THE INVENTION

The present invention is concerned with variable capacity compressors, vacuum or other pumps or machines, and particularly those reciprocating piston compressors used in refrigeration, air conditioning systems or heat pumps or the like, including machines such as scotch yoke compressors of U.S. Pat. No. 4,838,769, wherein it is desirable to vary the compressor output, i.e., compressor capacity modulation, in accordance with cooling load requirements. Such modulation allows large gains in efficiency while normally providing reduced sound, improved reliability, and improved creature comforts including one or more of reduced air noise, better dehumidification, warmer air in heat pump mode, or the like.

The efficiency gains resulting from a compressor with capacity modulation are beneficial in a variety of commercial applications. For example, most residential refrigerators currently utilize a single capacity compressor and cycle the compressor on and off to maintain a certain temperature within the cabinet of the refrigerator. During normal operation, the temperature of the refrigerator increases due to the warmer ambient air surrounding the refrigerator or when the refrigerator door is opened or a load of perishables having a temperature greater than that of the cabinet is introduced to the refrigerator. If the temperature exceeds a preset limit, the compressor is activated to cool the cabinet of the refrigerator. To account for the higher load conditions when the door is opened or perishables are introduced to the cabinet, the cooling capacity of the compressor is necessarily greater than the minimum required to maintain a particular temperature in the ambient conditions. With this design, the compressor undergoes multiple starts and stops to respond to varying load conditions. The high number of starts and stops will shorten the life of the compressor. Additionally, operating the compressor at full capacity during periods of minimal load is inefficient.

One approach to achieving modulation of a compressor has been to switch the stroke length, i.e., stroke, of one or more of the reciprocating pistons whereby the volumetric capacity of the cylinder is changed. In these compressors the reciprocating motion of the piston is effected by the orbiting of a crankpin, i.e., crankshaft eccentric, which is attached to the piston by a connecting rod means which has a bearing in which the eccentric is rotatably mounted.

A proposed mechanism in the published art for switching stroke is the use of a cam bushing mounted on the crankshaft eccentric, which bushing when rotated on the eccentric will shift the orbit axis of the connecting rod bearing radially and parallelly with respect to the crankshaft rotational axis and thus reduce or enlarge the rod bearing orbit radius. This, in turn, changes the piston stroke accordingly. In such cam action mechanism the piston at the reduced stroke does not attain full or primary stroke top-dead-center (TDC) positioning within the cylinder. This design diminishes compression and permits considerable reexpansion of the only partially compressed refrigerant. The efficiency of the compressor is thus markedly compromised.

Certain prior art cam mechanisms are shown and described in U.S. Pat. Nos.: 4,479,419; 4,236,874; 4,494,447; 4,245,966; and 4,248,053, the disclosures of which with respect to general compressor construction and also with respect to particular structures of cylinder, piston, crankshaft, crankpin and throw shifting mechanisms are hereby incorporated herein by reference in their entirety. With respect to these patents the crankpin journal is comprised of an inner and one or more outer eccentrically configured journals, the inner journal being the outer face of the crankpin or eccentric, and the outer journal(s) being termed "eccentric cams or rings" in these patents. The outer journals are rotatably mounted or stacked on the inner journal. The bearing of the connecting rod is rotatably mounted on the outer face of the outermost journal. In these patents, all journal and bearing surfaces of the coupling structure or power transmission train of the shiftable throw piston, from the crankshaft to the connecting rod, are conventionally circular.

Referring particularly to the U.S. Pat. No. 4,245,966, a TDC position of the piston is said to be achieved thru the use of two eccentric rings which are provided with stops to orient the cams, in the hope of achieving the TDC position. This structure is very complex, expensive, and difficult to manufacture and to assemble, in a commercial sense.

OBJECTS OF THE INVENTION

An object of the present invention is to provide improved coupling structures for a crankpin throw shifting mechanism for a single or multi-cylinder compressor wherein the piston always achieves primary TDC position regardless of the degree of stroke change.

Another object is to provide improved commercial applications of single or multiple compressors that include improved coupling structures. These and other objects will become apparent from the description and claims of the invention, presented below.

SUMMARY OF THE INVENTION

Accordingly, one aspect of the present invention is directed to a unique, simple and reliable coupling structure for functionally connecting a connecting rod bearing and a crankpin. This structure is adapted to change the primary stroke of a piston while always effecting primary top dead center positioning of said piston on its up-stroke regardless of the stroke change.

In accordance with another aspect of the present invention, as embodied and broadly described herein, the invention is directed to a two stage reciprocating compressor. The compressor includes a block with a single cylinder and associated single compression chamber and single piston. The compressor also includes a crankshaft. The crankshaft has an eccentric crankpin that is operatively connected to the piston. A reversible motor is provided to rotate the crankshaft in a forward direction and in a reverse direction. An eccentric cam is rotatably mounted on an eccentric crankpin. The eccentric cam is stationary with respect to the crankpin when the crankshaft is rotating in the forward direction to drive the piston at a full stroke between a bottom position and a top dead center position. The cam rotates with respect to the crankpin when the crankshaft is rotating in the reverse direction to drive the piston at a reduced stroke between an intermediate position and the top dead center position.

According to another aspect, the invention is directed to a refrigerator appliance that includes at least one insulated cooling compartment. The refrigerator appliance further includes a two-stage reciprocating compressor that has an electrical motor, a single cylinder with an associated single compression chamber and single piston. The compressor further includes an eccentric cam rotatably mounted on an eccentric crankpin. The cam is held stationary with respect to the crankpin when the motor is rotating in the forward direction to drive the piston at a full stroke between a bottom position and a top dead center position. The cam rotates with respect to the crankpin when the motor is rotating in the reverse direction to drive the piston at a reduced stroke between an intermediate position and the top dead center position. The refrigerator appliance further includes an evaporator, an expansion valve, and a condenser in series with the compressor and placed in a system designed to cool the cooling compartment.

In another aspect, the invention is directed to a heating, ventilating, and air conditioning ("HVAC") system for conditioning air within an enclosure. The HVAC system includes a condenser, an expansion device and an evaporator. The HVAC system further includes a two-stage reciprocating compressor that has an electrical motor, a single cylinder with an associated single compression chamber and single piston. The compressor further includes an eccentric cam rotatably mounted on an eccentric crankpin. The cam is held stationary with respect to the crankpin when the motor is rotating in the forward direction to drive the piston at a full stroke between a bottom position and a top dead center position. The cam rotates with respect to the crankpin when the motor is rotating in the reverse direction to drive the piston at a reduced stroke between an intermediate position and the top dead center position.

As explained in more detail below, the present invention provides a structurally simple coupling mechanism which can be manufactured to give any desired compressor capacity shift. The coupling structure of the invention can be applied to give different strokes for two or more pistons of multi-cylinder compressors and provide a wide range of desired variations in compressor capacity without reducing compressor efficiency thru significant volume clearance, i.e., clearance between the piston top and valve plate at TDC.

It is to be understood that both the foregoing general description and the following detailed description are exemplary and explanatory only and are not restrictive of the invention, as claimed.

BRIEF DESCRIPTION OF THE DRAWINGS

The invention will be understood further from the drawings herein which are not drawn to scale and in which certain structural portions are exaggerated in dimension for clarity, and from the following description wherein.

DETAILED DESCRIPTION

Reference will now be made in detail to the presently preferred embodiments of the invention, examples of which are illustrated in the accompanying drawings. Wherever possible, the same reference numbers will be used throughout the drawings to refer to the same or like parts.

The present invention is directed to improved two stage, reversible reciprocating compressors and the application of such compressors to cooling systems including, but not limited to, both refrigerator appliances and heating, ventilating and air conditioning ("HVAC") systems. The compressors include a mechanical system that alters the stroke of at least one piston, when the direction of motor rotation is reversed. Wen the motor is operating in a forward direction, the piston travels through a full stroke within the respective cylinder. When the motor is reversed, the piston travels through a reduced stroke within the cylinder. The mechanical system preferably ensures that the piston reaches the top dead center positioning within the cylinder in both the full stroke and reduced stroke operation modes. In the exemplary embodiments, the mechanical system is illustrated in compressors having a single compression chamber and piston. However, the present invention contemplates that the mechanical system may also be used in compressors having multiple compression chambers and pistons.

Figure 1:
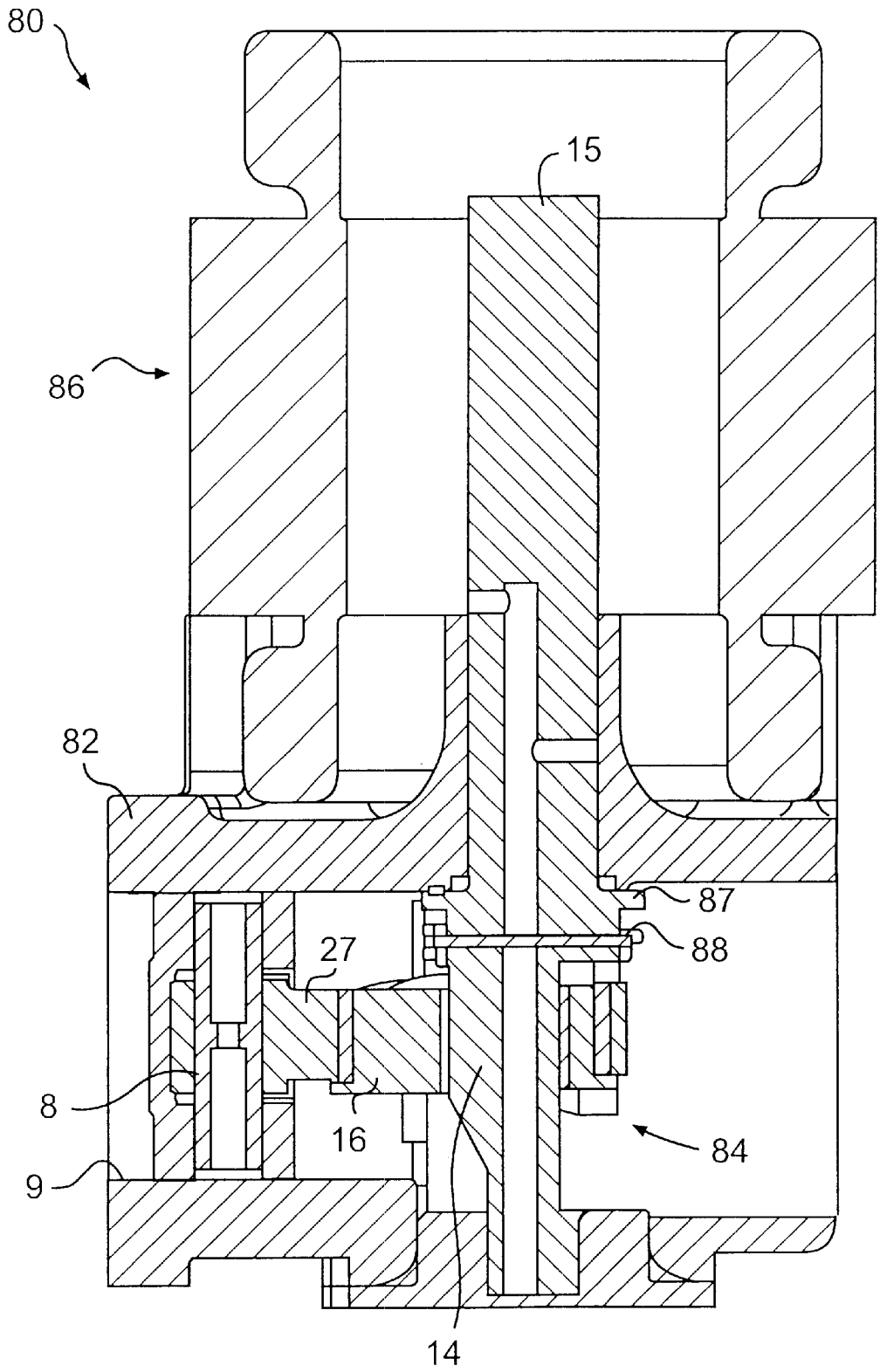
FIG. 1 is a sectional view of a two-stage reciprocating compressor for a heating, ventilating, and air conditioning ("HVAC") system, generally illustrating a coupling structure according to the present invention.

One exemplary embodiment of a two-stage reciprocating compressor is illustrated in FIG. 1 and is generally designated as reference number 80. As shown, compressor 80 includes a block 82 formed with a cylinder 9. Cylinder 9 slidably receives a piston 8 for reciprocal motion within the cylinder.

Piston 8 is connected to a rotatable crankshaft 15 that is also mounted within block 82. A reversible motor 86 selectively rotates crankshaft 15 in either a forward direction or a reverse direction to thereby effect motion of piston 8.

In accordance with the present invention, a mechanical system is provided to connect the piston and the rotatable crankshaft. The mechanical system drives the piston through a full stroke between a bottom position and a top dead center position when the motor is operated in the forward direction. The mechanical system drives the piston through a half stroke between an intermediate position and the top dead center position when the motor is operated in the reverse direction.

Figure 3A:
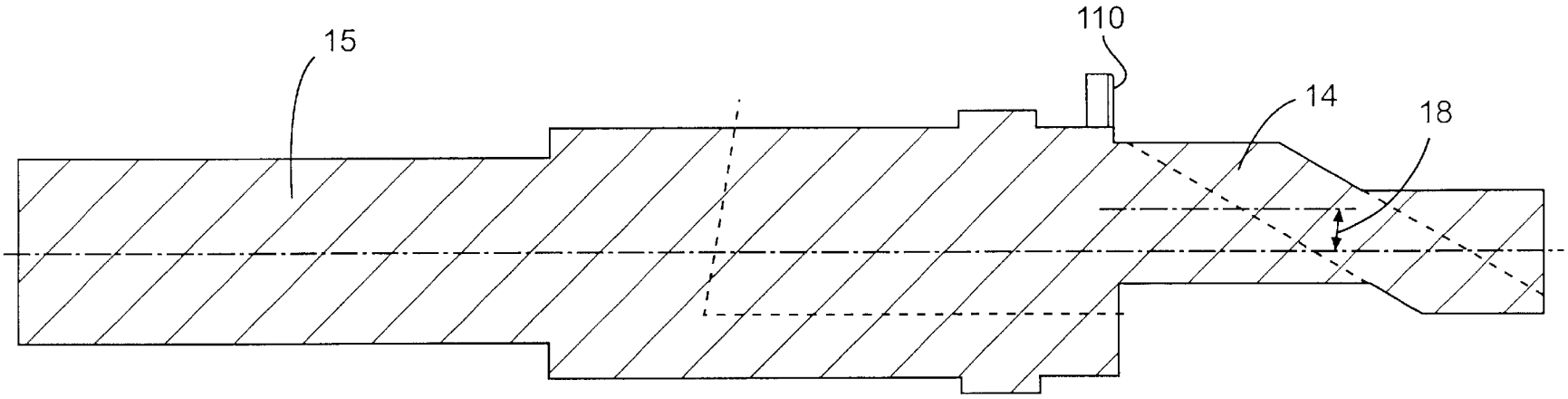
FIG. 3*a* is a cross sectional view of a crankshaft according to the present invention.
Figure 3B:
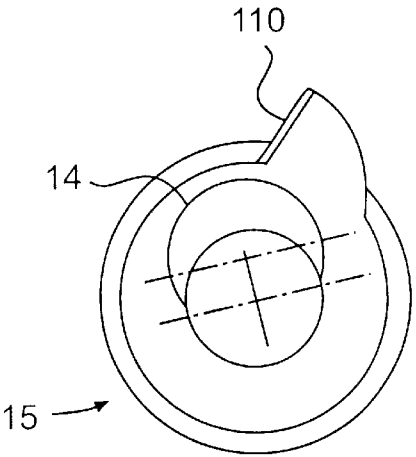
FIG. 3*b* is an end view of the crankshaft of FIG. 3*a;*
Figure 4C:
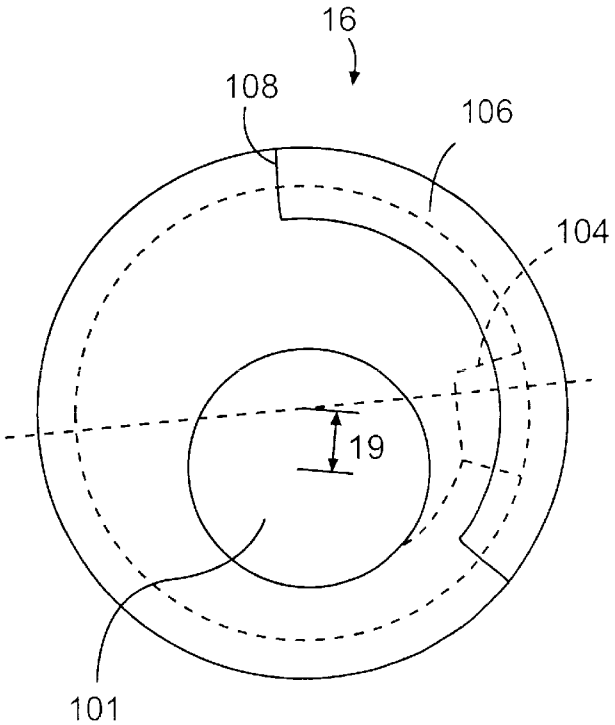
FIG. 4*c* is a second perspective view of the eccentric cam of FIG. 4*a;*
Figure 4B:
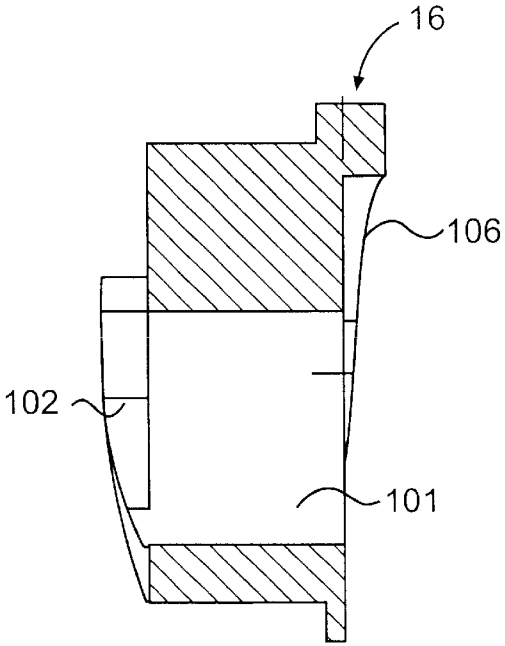
FIG. 4*b* is a cross sectional view of the eccentric cam of FIG. 4*a;*
Figure 4A:
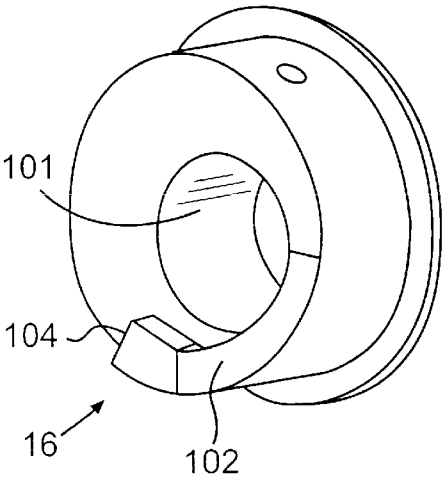
FIG. 4*a* is a perspective view of an eccentric cam according to the present invention.
Figure 5A:
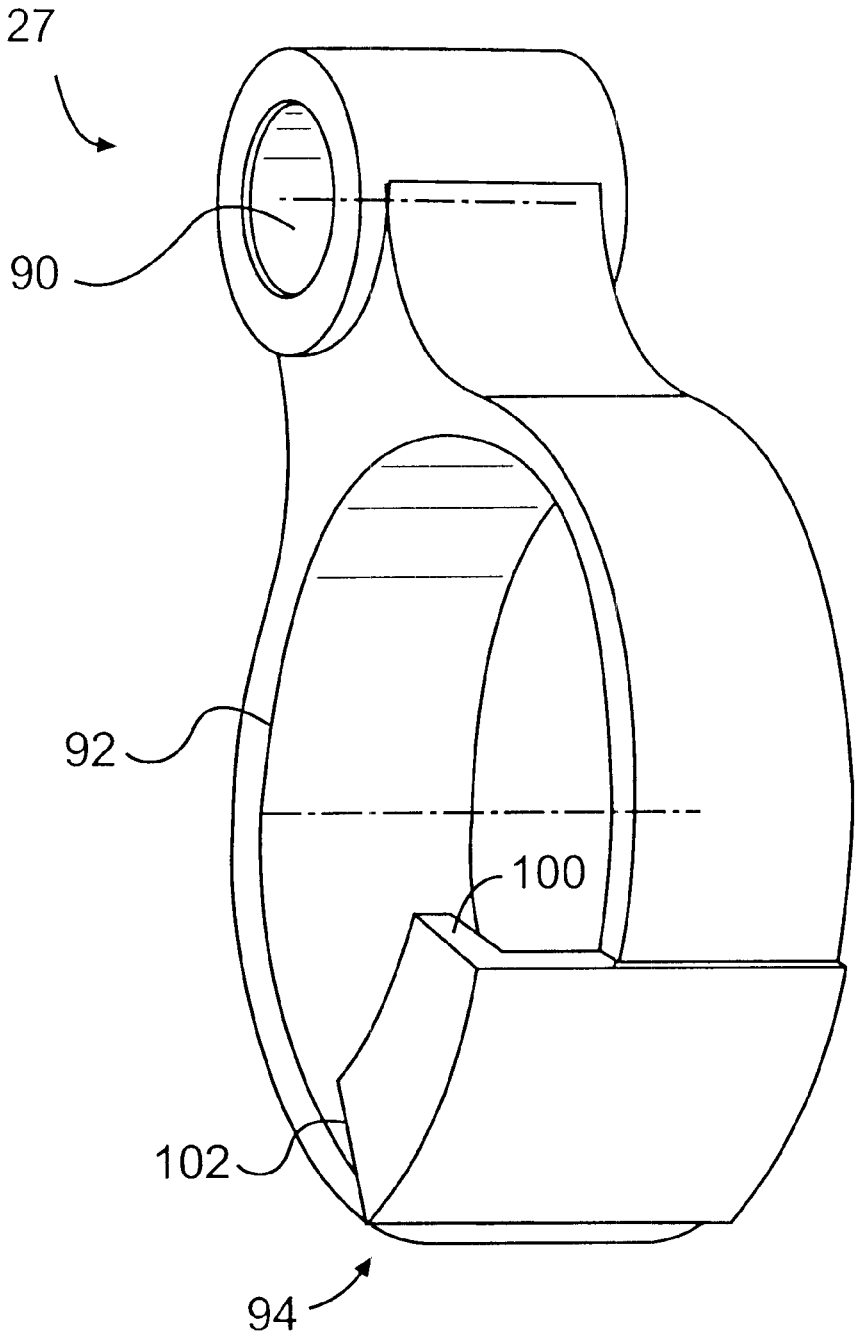
FIG. 5*a* is a perspective view of a connecting rod according to the present invention.
Figure 5C:
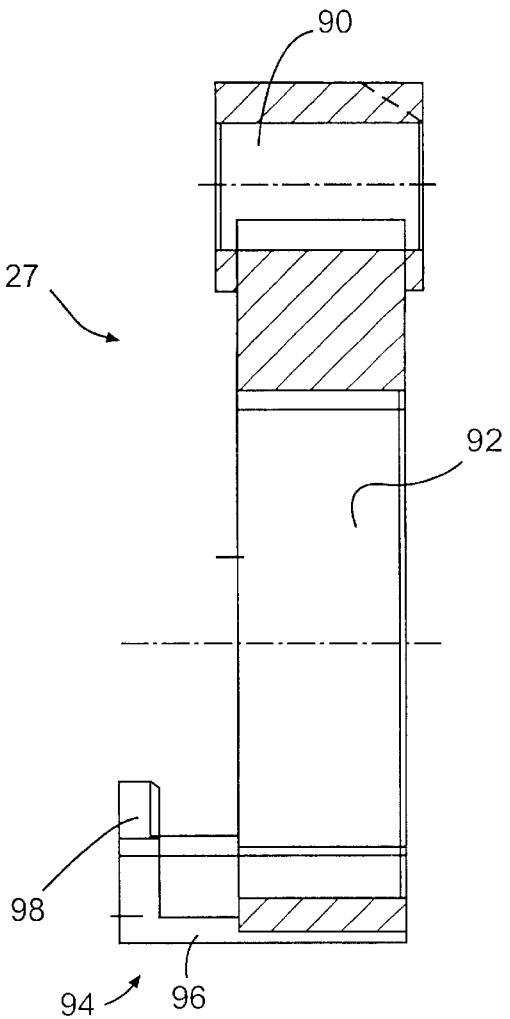
FIG. 5*c* is a cross-sectional view of the connecting rod of FIG. 5*a;*
Figure 5B:
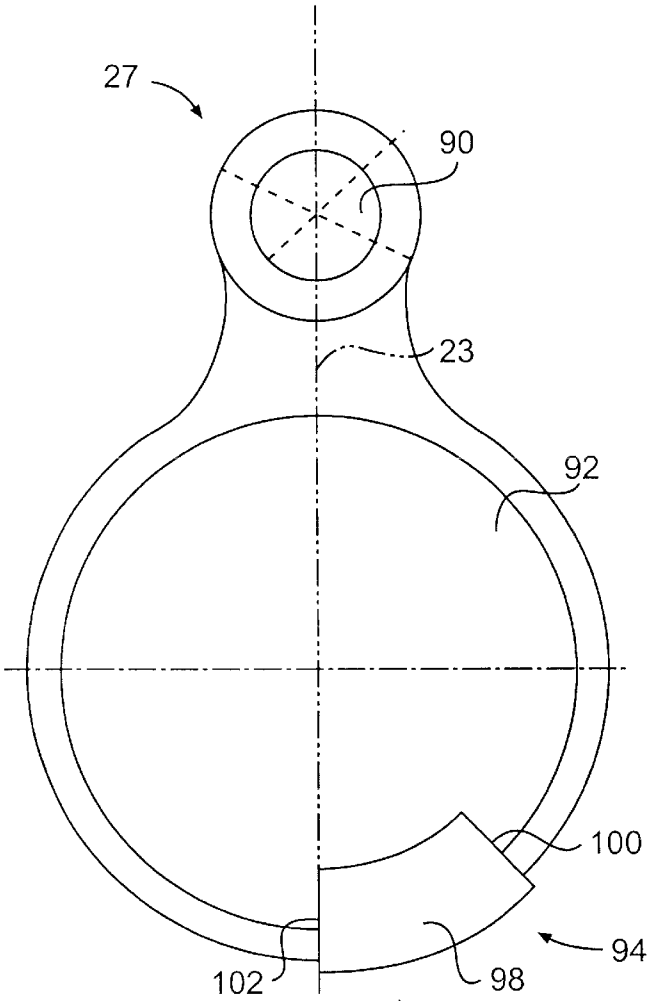
FIG. 5*b* is a front plan view of the connecting rod of FIG. 5*a;*

As illustrated in FIG. 1, mechanical system 84 includes an eccentric crankpin 14, an eccentric cam 16, and a connecting rod 27. As illustrated in FIGS. 3*a* and 3*b*, eccentric crankpin 14 is formed as part of crankshaft 15 and has an eccentricity 18. As illustrated in FIGS. 4*a*–4*c*, eccentric cam 16 is includes an opening 101 in which crankpin 14 is rotatably disposed and has an eccentricity 19. As shown in FIGS. 5*a*–5*c*, crankpin 27 includes an opening 92 in which eccentric cam 16 is rotatably disposed.

Figure 2A:
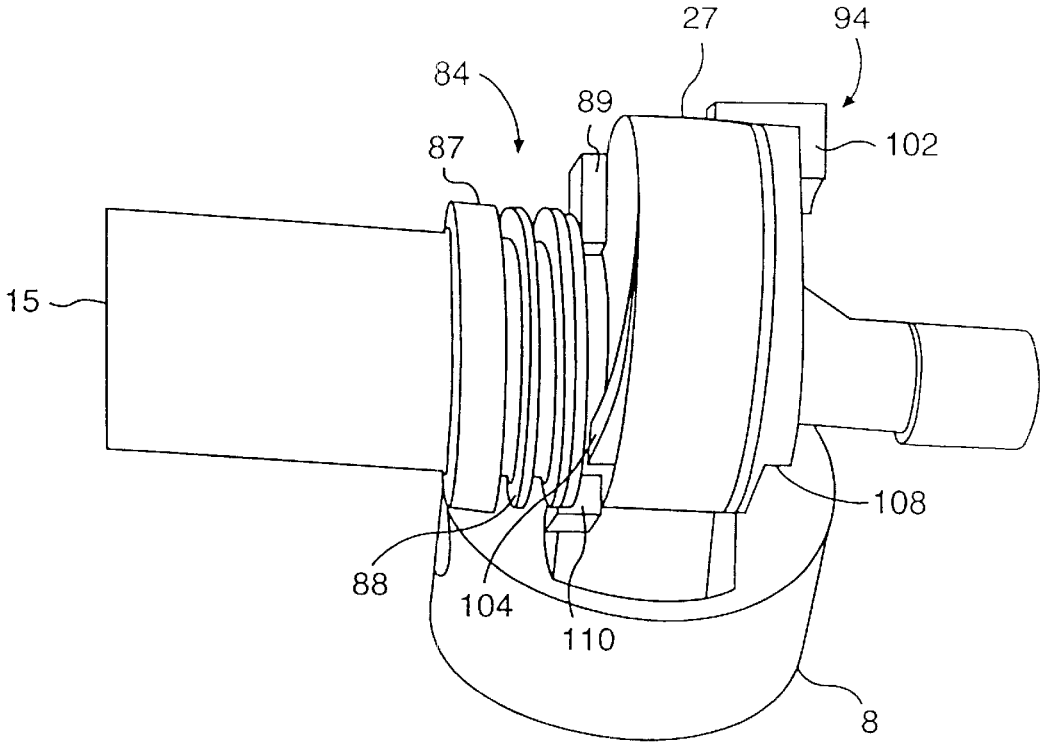
FIGS. 2*a*–2*b* are perspective views of a mechanical system for linking a reversible motor to a piston in accordance with the present invention.
Figure 2B:
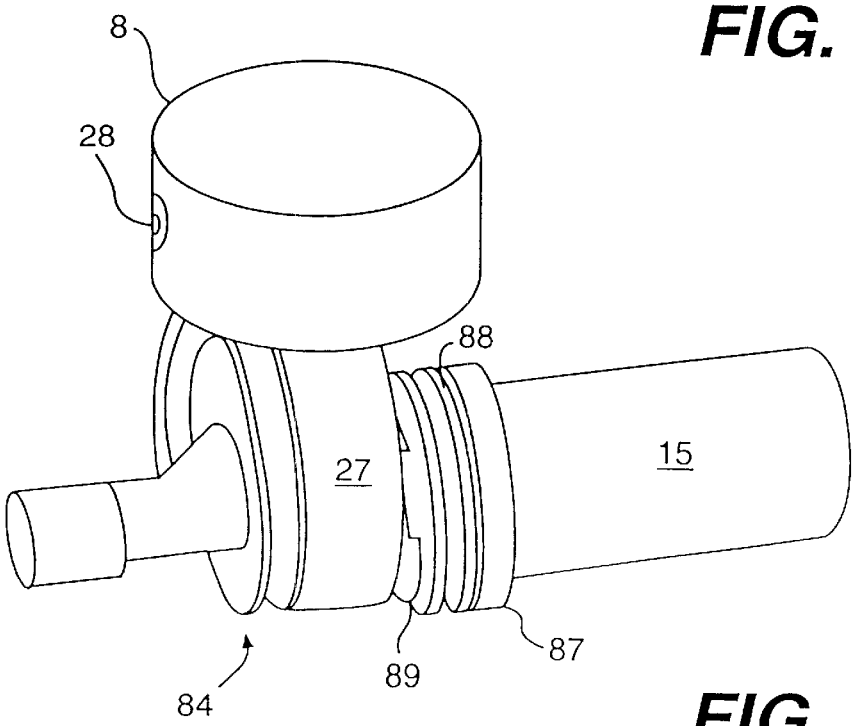

As shown in FIGS. 2*a* and 2*b*, connecting rod 27 is connected to piston 8 by a wrist pin 28. This connection allows connecting rod 27 to pivot with respect to piston 8. It is contemplated that other, similar connecting devices will be readily apparent to one skilled in the art.

The mechanical system also includes a first stop mechanism for restricting the relative rotation of the eccentric cam about the crankpin when the motor is rotating the crankshaft in the forward direction and a second stop mechanism for restricting the relative rotation of the eccentric cam with respect to the connecting rod when the motor is rotating the crankshaft in the reverse direction. Thus, when the motor is running in the forward direction, the eccentric cam is fixed to the crankpin at a first position by the first stop mechanism and the eccentric cam rotates with respect to the connecting rod. When the rotational direction of the motor is reversed, the eccentric cam rotates out of the first position to a second position where the second stop mechanism fixes the cam to the connecting rod. In the preferred embodiment, at the second position the crankpin rotates within the eccentric cam.

In one exemplary embodiment and as illustrated in FIGS. 3*a* and 3*b*, the first stop mechanism includes a stop 110 positioned on crankshaft 15 adjacent eccentric crankpin 14. As illustrated in FIGS. 4*a*–4*c*, eccentric cam 16 includes a first sloping projection 102 that ends in a face 104. When crankshaft 15 is rotated in the forward direction stop 110 engages face 104 so that eccentric cam 16 is fixed with respect to eccentric crankpin 14. When crankshaft 15 is rotated in the reverse direction, stop 110 rides along sloping projection 102, causing eccentric cam 16 to slide along crankpin 14, until stop 110 eventually drops over face 104. Thus, when crankshaft 15 rotates in the reverse direction, eccentric crankpin 14 is free to rotate within eccentric cam 16.

Figure 13A:
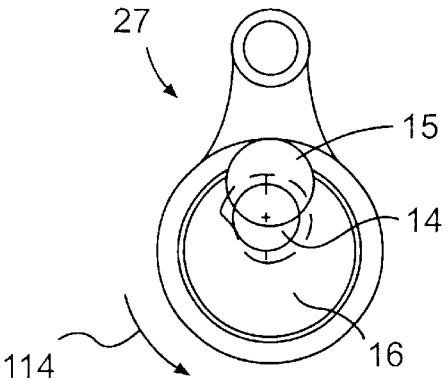
FIGS. 13*a*–13*e* are a series of front views of a mechanical system according to the present invention, illustrating the operation of a mechanical system in a full stroke mode.
Figure 13B:
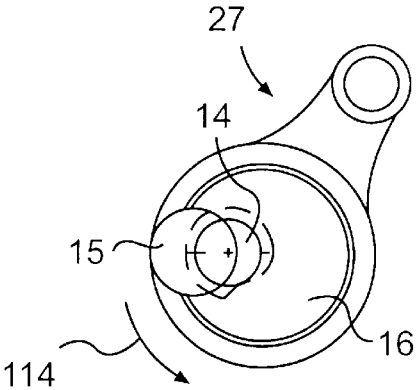
Figure 13C:
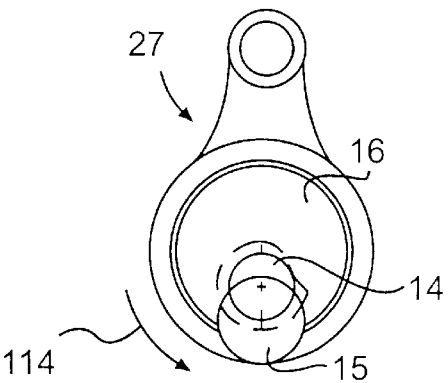
Figure 13D:
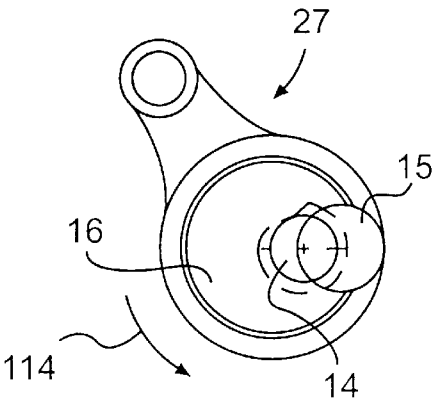
Figure 13E:
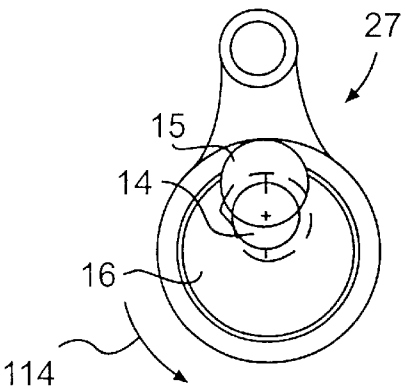

Preferably, the components of the first stop mechanism are disposed on crankshaft 15 and eccentric cam 16 so that when crankshaft 15 is rotated in the first direction and the eccentric cam is fixed with respect to the crankpin, the eccentricity 18 of crankpin 14 aligns with eccentricity 19 of eccentric cam 16. FIGS. 13*a*–13*e* illustrate the operation of the coupling structure in the full stroke mode. Crankpin 15 is rotated in the first direction as indicated by arrow 114. As shown in FIG. 13*a*, when crankpin 14 is at the bottom of its rotation, the combined eccentricity of cam 16 and crankpin 14 move connecting rod 27 and connected piston to the bottom position. Similarly, as shown in FIG. 13*c*, when crankpin 14 is at the top of its rotation, the combined eccentricity of cam 16 and crankpin 14 move connecting rod 27 and connected piston to the top dead center position.

As illustrated in FIGS. 4*a*–4*c*, the second stop mechanism includes a second sloping projection 106 on eccentric cam 16, preferably on the opposite side of the eccentric cam from first sloping projection 102. Second sloping projection 106 ends in face 108. As shown in FIGS. 5*a*–5*c*, connecting rod 27 includes a stop 94 having two support members 96 and 98 that form an L-shape extending away from and over opening 92. Support member 98 includes two faces 100 and 102.

When crankshaft 15 is rotated in the forward direction, the first stop mechanism fixes eccentric cam 16 to crankpin 14 and the eccentric cam rotates within connecting rod 27. As eccentric cam 16 rotates within connecting rod 27, face 102 of stop 94 rides along sloping projection 106, thereby causing eccentric cam 16 to slide along crankpin 14. Eventually face 102 of stop 94 moves over face 108 of sloping projection 106. When the direction of rotation is reversed, the first stop mechanism disengages and crankpin 14 rotates freely within eccentric cam 16. The eccentric cam will rotate in the reverse direction with respect to connecting rod 27 until face 108 of sloping projection 106 on eccentric cam 16 engages stop 94 on connecting rod 27. This engagement will restrict the rotation of the eccentric cam with respect to the connecting rod when the crankshaft is rotated in the reverse direction.

Preferably, as illustrated in FIGS. 2*a* and 2*b*, a spring 88 and a collar 89 are positioned on crankshaft 15. Spring 88 and collar 89 rotate with crankshaft 15. Spring 88 acts through collar 89 to bias eccentric cam 16 along crankpin 14. The action of spring ensures that faces 104 and 108 on eccentric cam 16 will align with and engage stops 110 and 94 on crankshaft 15 and connecting rod 27, respectively when the rotational direction of crankshaft 15 is switched. It is contemplated that the sizing and tolerances of the components of the mechanical system may be such that spring 88 and collar 89 may be omitted and the acceleration forces generated when the motor is reversed will ensure that the first and second stop mechanisms will still engage the respective stops on the connecting rod and crankshaft.

FIGS. 14*a*–14*e* illustrate the operation of the coupling structure in the reduced stroke mode. Crankpin 15 is rotated in the reverse direction as indicated by arrow 115. It should be noted that FIGS. 14*a*–14*e* depict the opposite side of the coupling structure from FIGS. 13*a*–13*e*. Thus, while the figures depict the rotation of the crankpin 15 as counterclockwise in both sets of figures, the actual direction of the crankpin is in the opposite direction.

Figure 14C:
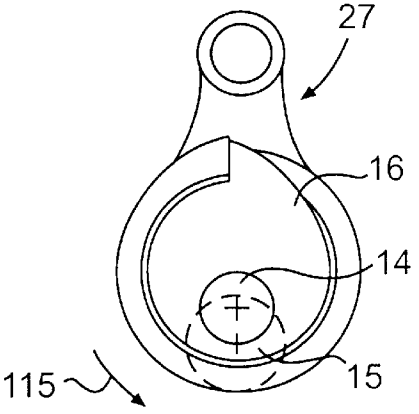
FIGS. 14*a*–14*e* are a series of rear views of a mechanical system according to the present invention, illustrating the operation of the mechanical system in a half stroke mode.
Figure 14B:
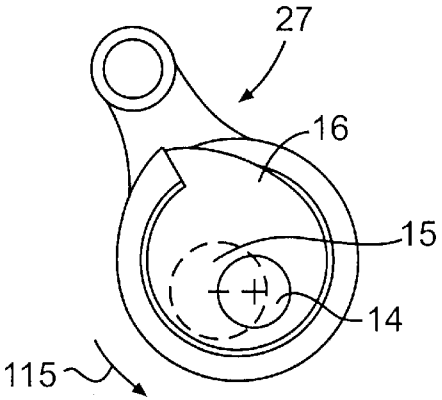
Figure 14A:
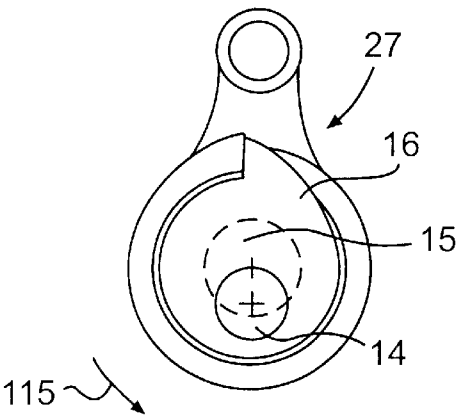
Figure 14E:
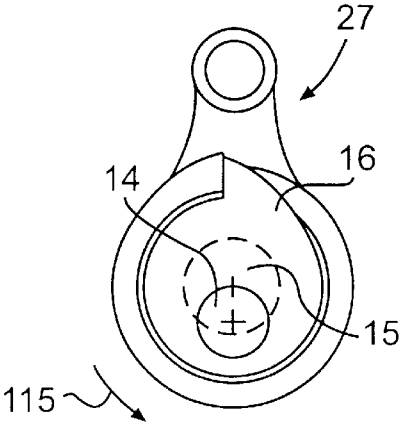
Figure 14D:
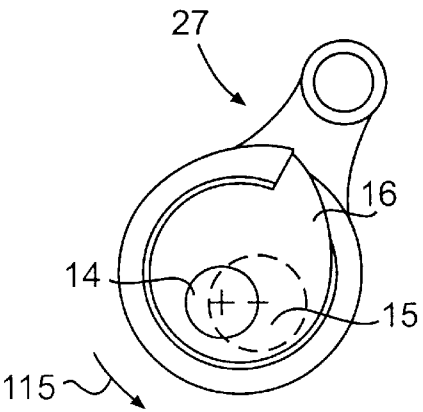

Preferably, the components of the second stop mechanism are disposed on eccentric cam 16 and connecting rod 27 so that when crankshaft 15 is rotated in the reverse direction the eccentricity 18 of eccentric cam 16 aligns with an axis 23 of connecting rod 27. Thus, the eccentricity 19 of the crankpin will only align with eccemtricity 18 of the eccentric cam when crankpin 14 is at the top of its rotation. As shown in FIG. 14*c*, this alignment results in the piston reaching the top dead center position when operating in the half stroke mode. As shown in FIGS. 14*a* and 14*e*, when crankpin 14 is at the bottom of its rotation, the eccentricity of cam 16 is opposite the eccentricity of crankpin 14. Thus, the piston only moves to an intermediate position, and not to the bottom position. It should be noted that the stroke length of the reduced stroke operation may be altered by varying the eccentricities 18 and 19 of the eccentric cam and crankpin, respectively.

Figure 6A:
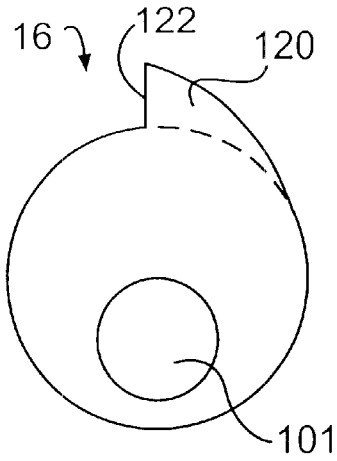
FIG. 6*a* is a front plan view of a second embodiment of an eccentric cam.
Figure 6B:
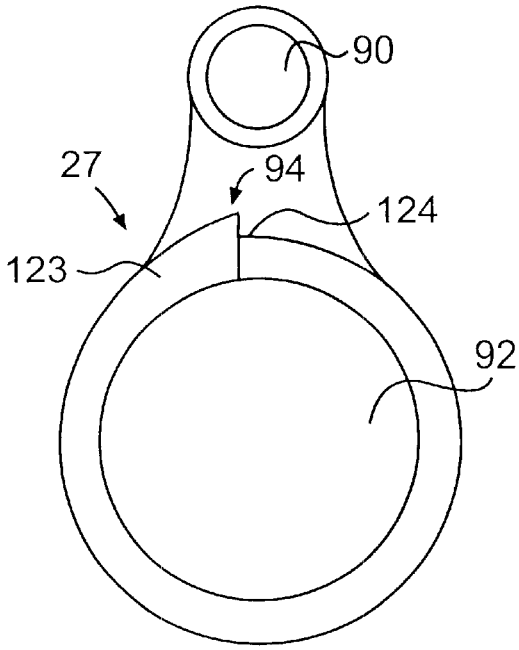
FIG. 6*b* is a front plan view of a second embodiment of a connecting rod.

The present invention contemplates that many variations of the first and second stop mechanisms will be readily apparent to one skilled in the art. For example, as illustrated in FIGS. 6*a* and 6*b*, eccentric cam 16 may include a projection 120 having a face 122. Connecting rod 27 may include a sloping projection 123 ending in a stop 124. When crankshaft 15 is rotated in the forward direction, projection 120 on eccentric cam will ride along and over sloping projection 120 on connecting rod 27. However, when the direction of crankshaft rotation is reversed, face 122 of eccentric cam will engage stop 124 on connecting rod 27, thereby preventing the eccentric cam from rotating with respect to the connecting rod.

FIGS. 21A through 21G and FIGS. 22A through 22E illustrate another exemplary embodiment of the first and second stop mechanisms. This embodiment utilizes pawls and catches to control the motion of the eccentric cam with respect to the crankpin and the connecting rod.

The first stop mechanism 202 includes a recess 204, a catch 206, and a pawl 208. Recess 204 is formed on the inner surface 205 of eccentric cam 16 and is configured to receive pawl 208 therein. Catch 206 is disposed on the surface of crankpin 14. Catch 206 includes a stop surface 210 and an angled surface 212. Pawl 208 includes a front surface 214 and a bottom surface 216.

Similarly, the second stop mechanism 220 includes a recess 222, a catch 224, and a pawl 226. Recess 222 is disposed on the inner surface 225 of connecting rod 27 and is configured to receive pawl 226 therein. Catch 224 is formed on the outer surface 207 of eccentric cam 16. Catch 224 includes a stop surface 229 and an angled surface 228. Pawl 226 includes a front surface 230 and a bottom surface 232.

When crankpin 14 is rotating in the forward direction, as indicated by arrow 236 (referring to FIG. 21D), crankpin 14 is fixed with respect to eccentric cam 16 while eccentric cam 16 is free to rotate within connecting rod 27. Stop surface 210 of catch 212 is engaged with front surface 214 of pawl 208 to maintain crankpin 14 fixed with respect to eccentric cam 16. At the same time, angled surface 228 of catch 224 pushes bottom surface 232 of pawl 226 and allows eccentric cam 16 to freely rotate within connecting rod 27. Consequently, crankpin 14 and eccentric cam 16 rotate together as a unit within connecting rod 27 when crankpin 14 is rotating in the forward direction.

When crankpin 14 is rotating in the reverse direction, as indicated by arrow 238 (referring to FIG. 21E), crankpin 14 is free to rotate within eccentric cam 16 while eccentric cam 16 is fixed with respect to connecting rod 27. Angled surface 212 of catch 206 pushes bottom surface 216 of pawl 208 and allows crankpin 14 to freely rotate within connecting rod 27. At the same time, stop surface 229 of catch 224 is engaged with front surface 230 of pawl 226 to maintain eccentric cam 16 fixed with respect to connecting rod 27. Consequently, crankpin 14 rotates freely within eccentric cam 16 which, in turn, is fixed with respect to connecting rod 27 when crankpin 14 is rotating in the reverse direction.

Preferably, pawls 208 and 226 are spring-biased to engage catches 206 and 224 although the present invention contemplates that the gravity may be utilized to bias pawls 208 and 226 to engage catches 206 and 224. As soon as the crankpin 14 changes its rotation from the forward direction (referring to FIG. 21D) to the reverse direction (referring to FIG. 21E), angled surface 212 pushes pawl 208 toward recess 204. Subsequently, stop surface 229 engages front surface 230 of pawl 226. There may be, however, a time delay between the disengagement of first stop mechanism 202 and the engagement of second stop mechanism 208 because catch 224 and pawl 226 may not be aligned when the crankpin 14 changes its rotation from the forward direction to the reverse direction. If catch 224 and pawl 226 are not aligned, crankpin 14 will drag eccentric cam 16 in the reverse direction for a short period of time until catch 224 aligns with pawl 226. When catch 224 is aligned with pawl 226, which is either spring-biased or gravity-biased toward catch 224, pawl 226 forces stop surface 229 to engage front surface 230. As a result, eccentric cam 16 is fixed with respect to connecting rod 27 while crankpin 14 is free to rotate in the reverse direction with respect to eccentric cam 16.

As the crankpin 14 changes its rotation from the reverse direction (referring to FIG. 21E) to the forward direction (referring to FIG. 21D), stop surface 210 engages front surface 214 to fix crankpin 14 with respect to eccentric cam 16. There may be, however, a time delay because catch 212 and pawl 208 may not be aligned when the crankpin 14 changes its rotation from the reverse direction to the forward direction. When catch 212 is aligned with pawl 208, which is either spring-biased or gravity-biased toward catch 212, pawl 208 forces stop surface 212 to engage front surface 214. As soon as stop surface 212 engages front surface 214 to rotate eccentric cam 16 in the forward direction with crankpin 14, angled surface 228 pushes pawl 226 toward recess 222 to free eccentric cam 16 from an engagement with connecting rod 27. As a result, crankpin 14 is fixed with respect to eccentric cam 16 to rotate together as a unit in the forward direction within connecting rod 27.

FIGS. 23A through 23E and 24A through 24F illustrate another exemplary embodiment of the first and second stop mechanisms. This embodiment utilizes pins, which are arranged substantially parallel with the axis of the crankpin, and catches to control the motion of the eccentric cam with respect to the crankpin and the connecting rod.

The first stop mechanism 250 includes a bore 252, a catch 254, and a pin 256. Bore 252 is disposed on a side surface 255 of eccentric cam 16. Catch 254 is disposed on a block 259, which is part of crankshaft 15, and is configured to engage pin 256. A ramp 257 is provided on the surface of block 259 facing side surface 255 of eccentric cam 16. Crankpin 14 extends out from block 259. A spring (not shown) received within bore 252 biases pin 256 toward block 259 from eccentric cam 16. Pin 256 is substantially parallel with the axis of crankpin 14 (referring to FIG. 24A).

Similarly, the second stop mechanism 258 includes a bore 260, a catch 262, and a pin 264. Bore 260 is disposed on a side surface 265 of eccentric cam 16. Catch 262 is disposed on an inner surface 266 of connecting rod 27. Inner surface 266, which faces side surface 265, includes a ramp 268. Preferably, a spring (not shown) received within bore 260 biases pin 264 toward connecting rod 27 from eccentric cam 16. However, the present invention contemplates that pin 264 may be biased toward catch 262 by gravity instead of the spring. Pin 264 is substantially parallel with the axis of crankpin 14 (referring to FIG. 24A).

When crankpin 14 is rotating in the forward direction, as indicated by arrow 270 (referring to FIG. 23D), crankpin 14 is fixed with respect to eccentric cam 16 while eccentric cam 16 is free to rotate within connecting rod 27. Pin 256 is engaged with catch 254 to maintain crankpin 14 fixed with respect to eccentric cam 16. At the same time, pin 264 rides along ramp 268 and passes over catch 262, and thereby allows eccentric cam 16 to freely rotate within connecting rod 27. Consequently, crankpin 14 and eccentric cam 16 rotate together as a unit within connecting rod 27 when crankpin 14 is rotating in the forward direction.

When crankpin 14 is rotating in the reverse direction, as indicated by arrow 272 (referring to FIG. 23E), crankpin 14 is free to rotate within eccentric cam 16 while eccentric cam 16 is fixed with respect to connecting rod 27. Pin 256 rides along ramp 257 and passes over catch 254. This allows crankpin 14 to freely rotate within eccentric cam 16. At the same time, pin 264 is engaged with catch 262 to maintain eccentric cam 16 fixed with respect to connecting rod 27. Consequently, crankpin 14 rotates freely within eccentric cam 16 which, in turn, is fixed with respect to connecting rod 27 when crankpin 14 is rotating in the reverse direction.

As soon as the crankpin 14 changes its rotation from the forward direction (referring to FIG. 23D) to the reverse direction (referring to FIG. 23E), pin 256 disengages from catch 254 and rides along ramp 257. Subsequently, pin 264 engages catch 262. There may be, however, a time delay between the disengagement of first stop mechanism 250 and the engagement of second stop mechanism 258 because pin 264 may not be aligned with catch 262 when the crankpin 14 changes its rotation from the forward direction to the reverse direction. If pin 264 is not aligned with catch 262, crankpin 14 will drag eccentric cam 16 in the reverse direction for a short period of time until pin 264 engages catch 262. As a result, eccentric cam 16 is fixed with respect to connecting rod 27 while crankpin 14 is free to rotate in the reverse direction with respect to eccentric cam 16.

As the crankpin 14 changes its rotation from the reverse direction (referring to FIG. 23E) to the forward direction (referring to FIG. 23D), pin 256 engages catch 254 to fix crankpin 14 with respect to eccentric cam 16. There may be, however, a time delay because catch 254 may not be aligned with pin 256 when the crankpin 14 changes its rotation from the reverse direction to the forward direction. As soon as pin 256 engages catch 254 to rotate eccentric cam 16 in the forward direction with crankpin 14, pin 264 disengages from catch 262 and rides along ramp 268. As a result, crankpin 14 is fixed with respect to eccentric cam 16 to rotate together in the forward direction within connecting rod 27.

FIGS. 25A through 25E and 26A through 26D illustrate another exemplary embodiment of the first and second stop mechanisms. This embodiment also utilizes pins, which are arranged substantially parallel with the axis of the crankpin, and catches to control the motion of the eccentric cam with respect to the crankpin and the connecting rod.

The first stop mechanism 300 includes a bore 302, a catch 304, and a pin 306. Bore 302 is disposed in a block 308, which is part of crankshaft 15. Catch 304 is disposed on a surface 305 of eccentric cam 16 facing block 308 and is configured to engage pin 306. A ramp 307 is provided on surface 305. Preferably, a spring (not shown) received within bore 302 biases pin 306 toward cam 16 from block 308. However, the present invention contemplates that pin 306 may be biased toward catch 304 by gravity instead of the spring. Pin 306 is substantially parallel with the axis of crankpin 14 (referring to FIG. 26A).

Similarly, the second stop mechanism 310 includes a bore 312, a catch 314, and a pin 316. Bore 312 is provided in eccentric cam 16. Preferably, bore 312 extends through the body of eccentric cam 16. The present invention, however, contemplates that bore 312 may not extend through the body of eccentric cam 16. Catch 314 is disposed on an inner surface 318 of connecting rod 27 and is configured to engage pin 316. Inner surface 318 includes a ramp 315. Preferably, pin 316 is biased toward catch 314 by gravity. However, the present invention contemplates that a spring (not shown) received within bore 312 may bias pin 316 toward connecting rod 27 from cam 16. Pin 264 is substantially parallel with the axis of crankpin 14 (referring to FIG. 26A).

When crankpin 14 is rotating in the forward direction, as indicated by arrow 320 (referring to FIG. 25D), crankpin 14 is fixed with respect to eccentric cam 16 while eccentric cam 16 is free to rotate within connecting rod 27. Pin 306 is engaged with catch 304 to maintain crankpin 14 fixed with respect to eccentric cam 16. At the same time, pin 316 rides along ramp 315 and passes over catch 314, and thereby allows eccentric cam 16 to freely rotate within connecting rod 27. Consequently, crankpin 14 and eccentric cam 16 rotate together as a unit within connecting rod 27 when crankpin 14 is rotating in the forward direction.

When crankpin 14 is rotating in the reverse direction, as indicated by arrow 322 (referring to FIG. 25E), crankpin 14 is free to rotate within eccentric cam 16 while eccentric cam 16 is fixed with respect to connecting rod 27. Pin 306 rides along ramp 307 and passes over catch 304. This allows crankpin 14 to freely rotate within eccentric cam 16. At the same time, pin 316 is engaged with catch 314 to maintain eccentric cam 16 fixed with respect to connecting rod 27 Consequently, crankpin 14 rotates freely within eccentric cam 16 which, in turn, is fixed with respect to connecting rod 27 when crankpin 14 is rotating in the reverse direction.

As soon as the crankpin 14 changes its rotation from the forward direction (referring to FIG. 25D) to the reverse direction (referring to FIG. 25E), pin 306 disengages from catch 304. After pin 306 disengages from catch 304, pin 306 rides along ramp 307. Subsequently, pin 316 engages catch 314. There may be, however, a time delay between the disengagement of first stop mechanism 300 and the engagement of second stop mechanism 310 because pin 316 may not be aligned with catch 314 when the crankpin 14 changes its rotation from the forward direction to the reverse direction. If pin 316 is not aligned with catch 314, crankpin 14 will drag eccentric cam 16 in the reverse direction for a short period of time until pin 316 engages catch 314. As a result, eccentric cam 16 is fixed with respect to connecting rod 27 while crankpin 14 is free to rotate in the reverse direction with respect to eccentric cam 16.

As the crankpin 14 changes its rotation from the reverse direction (referring to FIG. 25E) to the forward direction (referring to FIG. 25D), pin 306 engages catch 304 to fix crankpin 14 with respect to eccentric cam 16. There may be, however, a time delay because pin 306 may not be aligned with catch 304 when the crankpin 14 changes its rotation from the reverse direction to the forward direction. As soon as pin 306 engages catch 304 to rotate eccentric cam 16 in the forward direction with crankpin 14, pin 316 disengages from catch 314. After pin 316 disengages from catch 314, pin 316 rides along ramp 315. As a result, crankpin 14 is fixed with respect to eccentric cam 16 to rotate together in the forward direction within connecting rod 27.

It should be noted that having bore 302 in crankshaft 15 instead of having bore 254 in eccentric cam 16 (referring to FIGS. 23C and 24C) enables the use of centrifugal force to prevent any pin noise from occurring when crankpin 14 is rotating in the reverse direction. When crankpin 14 is rotating in the reverse direction at a operating speed, centrifugal force pushes pin 306 against the wall of bore 302 so that pin 306 is held in a noise preventing position. In other words, if pin 306 is in the noise-preventing position, pin 306 is prevented from riding along ramp 207 and moving into catch 314. The embodiment shown in FIGS. 23A through 23E and 24A through 24F cannot utilize centrifugal force because bore 254 is in eccentric cam 15 that does not rotate when crankpin 14 is rotating in the reverse direction.

FIGS. 27A through 27E and 28A through 28F illustrate another exemplary embodiment of the first and second stop mechanisms. This embodiment utilizes pins, which are arranged substantially perpendicular to the axis of the crankpin, and catches to control the motion of the eccentric cam with respect to the crankpin and the connecting rod.

The first stop mechanism 330 includes a bore 332, a catch 334, and a pin 336. Bore 332 is disposed in eccentric cam 16. Catch 334 is disposed on the surface of crankpin 14 and is configured to engage pin 306, Catch 334 includes a stop surface 338 and an angled surface 340. Preferably, a spring 342 received within bore 342 biases pin 336 toward crankpin 14 from eccentric cam 16. Pin 336 is substantially perpendicular to the axis of crankpin 14 (referring to FIG. 28A).

Similarly, the second stop mechanism 350 includes a bore 352, a catch 354, and a pin 356. Bore 352 is disposed in connecting rod 27. Catch 354 is disposed on the outer surface 357 of eccentric cam 16 and is configured to engage pin 356. Catch 354 includes a stop surface 358 and an angled surface 360. Preferably, a spring 362 received within bore 352 biases pin 356 toward eccentric cam 16 from connecting rod 27. Pin 336 is also substantially perpendicular to the axis of crankpin 14 (referring to FIG. 28A).

When crankpin 14 is rotating in the forward direction, as indicated by arrow 370 (referring to FIG. 27D), crankpin 14 is fixed with respect to eccentric cam 16 while eccentric cam 16 is free to rotate within connecting rod 27. Stop surface 338 maintains pin 336 in engagement with catch 334 so that crankpin 14 is fixed with respect to eccentric cam 16. At the same time, angled surface 360 pushes pin 356 into bore 352 to allow eccentric cam 16 to freely rotate within connecting rod 27.

Consequently, crankpin 14 and eccentric cam 16 rotate together as a unit within connecting rod 27 when crankpin 14 is rotating in the forward direction.

When crankpin 14 is rotating in the reverse direction, as indicated by arrow 372 (referring to FIG. 27E), eccentric cam 16 is fixed with respect to connecting rod 27 while crankpin 14 is free to rotate within eccentric cam 16. Stop surface 358 maintains pin 356 in engagement with catch 354 so that eccentric cam 16 is fixed with respect to connecting rod 27. At the same time, angled surface 340 pushes pin 336 into bore 332 to allow crankpin 14 to freely rotate within eccentric cam 16. Consequently, crankpin 14 rotates freely within eccentric cam 16 which, in turn, is fixed with respect to connecting rod 27 when crankpin 14 is rotating in the reverse direction.

As soon as the crankpin 14 changes its rotation from the forward direction (referring to FIG. 27D) to the reverse direction (referring to FIG. 27E), pin 336 disengages from catch 334 resulting from angled surface 340 pushing pin 336 into bore 332. Subsequently, pin 356 engages catch 354 and stop surface 358 maintains pin 356 in engagement with catch 354. There may be, however, a time delay between the disengagement of first stop mechanism 330 and the engagement of second stop mechanism 350 because bore 352 may not be aligned with catch 354 when the crankpin 14 changes its rotation from the forward direction to the reverse direction. If pin 356 is not aligned with catch 354, crankpin 14 will drag eccentric cam 16 in the reverse direction for a short period of time until pin 356 engages catch 354. As a result, eccentric cam 16 is fixed with respect to connecting rod 27 while crankpin 14 is free to rotate in the reverse direction with respect to eccentric cam 16.

As the crankpin 14 changes its rotation from the reverse direction (referring to FIG. 27E) to the forward direction (referring to FIG. 27D), stop surface 338 engages pin 336 and maintains pin 336 in engagement with catch 334. There may be, however, a time delay because catch 334 may not be aligned with bore 332 when the crankpin 14 changes its rotation from the reverse direction to the forward direction. As soon as stop surface 338 engages pin 336 to rotate eccentric cam 16 in the forward direction with crankpin 14, angled surface 360 pushes pin 356 into bore 352 to disengage pin 356 from catch 354. As a result, crankpin 14 is fixed with respect to eccentric cam 16 to rotate together in the forward direction within connecting rod 27.

FIGS. 29A through 29E and 30A through 30C illustrate another exemplary embodiment of the first and second stop mechanisms. This embodiment utilizes pins, one of which is arranged substantially perpendicular to the axis of the crankpin and the other is arranged substantially parallel with the axis of the crankpin, and catches to control the motion of the eccentric cam with respect to the crankpin and the connecting rod.

The first stop mechanism 400 includes a bore 402, a catch 404, and a pin 406. Bore 402 is disposed in block 408, which is part of crankshaft 15. Catch 404 is disposed on a surface 405 of eccentric cam 16 facing block 408 and is configured to engage pin 406. A ramp 407 is provided on surface 405. Preferably, a spring (not shown) received within bore 402 biases pin 406 toward eccentric cam 16 from crankshaft 15. Pin 406 is substantially parallel with the axis of crankpin 14 (referring to FIG. 30A).

The second stop mechanism 410 includes a bore 412, a catch 414, and a pin 416. Bore 412 is disposed in connecting rod 27. Catch 414 is disposed on the outer surface 417 of eccentric cam 16 and is configured to engage pin 416. Catch 414 includes a stop surface 418 and an angled surface 420. Preferably, a spring 422 received within bore 412 biases pin 416 toward eccentric cam 16 from connecting rod 27. Pin 416 is substantially perpendicular to the axis of crankpin 14 (referring to FIG. 30A).

When crankpin l4 is rotating in the forward direction, as indicated by arrow 424 (referring to FIG. 29D), crankpin 14 is fixed with respect to eccentric cam 16 while eccentric cam 16 is free to rotate within connecting rod 27. Pin 406 is engaged with catch 404 so that crankpin 14 is fixed with respect to eccentric cam 16. At the same time, angled surface 420 pushes pin 466 into bore 412, and thereby allows eccentric cam 16 to freely rotate within connecting rod 27. Consequently, crankpin 14 and eccentric cam 16 rotate together as a unit within connecting rod 27 when crankpin 14 is rotating in the forward direction.

When crankpin 14 is rotating in the reverse direction, as indicated by arrow 426 (referring to FIG. 29E), eccentric cam 16 is fixed with respect to connecting rod 27 while crankpin 14 is free to rotate within eccentric cam 16. Stop surface 418 maintains pin 416 in engagement with catch 414 so that eccentric cam 16 is fixed with respect to connecting rod 27. At the same time, pin 406 rides along ramp 407 and passes over catch 404, and thereby allows crankpin 14 to freely rotate within eccentric cam 16. Consequently, crankpin 14 rotates freely within eccentric cam 16 which, in turn, is fixed with respect to connecting rod 27 when crankpin 14 is rotating in the reverse direction.

As soon as the crankpin 14 changes its rotation from the forward direction (referring to FIG. 29D) to the reverse direction (referring to FIG. 29E), pin 406 disengages from catch 404. After pin 406 disengages from catch 404, pin 406 rides along ramp 407. Subsequently, pin 416 engages catch 414 and stop surface 418 maintains pin 416 in engagement with catch 414. There may be, however, a time delay between the disengagement of first stop mechanism 400 and the engagement of second stop mechanism 410 because catch 414 may not be aligned with bore 412 when the crankpin 14 changes its rotation from the forward direction to the reverse direction. If catch 414 is not be aligned with bore 412, crankpin 14 will drag eccentric cam 16 in the reverse direction for a short period of time until catch 414 and bore 412 are aligned to allow pin 416 to engage catch 414. As a result, eccentric cam 16 is fixed with respect to connecting rod 27 while crankpin 14 is free to rotate in the reverse direction with respect to eccentric cam 16.

As the crankpin 14 changes its rotation from the reverse direction (referring to FIG. 29E) to the forward direction (referring to FIG. 29D), catch 404 engages pin 406. There may be, however, a time delay because pin 406 may not be aligned with catch 404 when the crankpin 14 changes its rotation from the reverse direction to the forward direction. As soon as catch 404 engages pin 406 to rotate eccentric cam 16 in the forward direction with crankpin 14, angled surface 420 pushes pin 416 into bore 412 to disengage pin 416 from catch 414. As a result, crankpin 14 is fixed with respect to eccentric cam 16 to rotate together in the forward direction within connecting rod 27.

As previously mentioned regarding the embodiment shown in FIGS. 25A through 25E and 26A through 26D, having bore 402 in crankshaft 15 enables the use of centrifugal force to prevent any pin noise from occurring when crankpin 14 is rotating in the reverse direction. When crankpin 14 is rotating in the reverse direction at a operating speed, centrifugal force pushes pin 406 against the wall of bore 402 so that pin 406 is held in a noise preventing position. In other words, if pin 406 is in the noise-preventing position, pin 406 is prevented from riding along ramp 407 and surface 405 and moving into catch 404.

In addition, differences in acceleration between the forward rotation and the reverse rotation can be used to prevent pin noise from occurring when crankpin 14 is rotating in the forward direction. When crankpin 14 is rotating in the forward direction, the force exerted on pin 416 due to inertia is such that it overcomes the biasing force of spring 422. Consequently, pin 416 is held in a noise preventing position where pin 416 is prevented from moving into catch 414.

Figure 8:
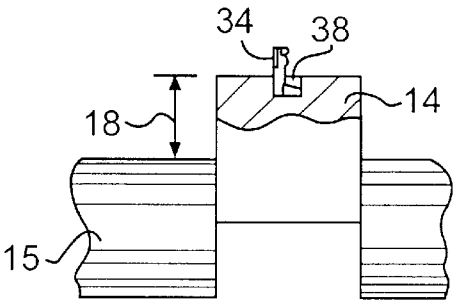
FIG. 8 is a view of a section of a crankshaft and a crankpin taken along line 2—2 in FIG. 7.
Figure 7:
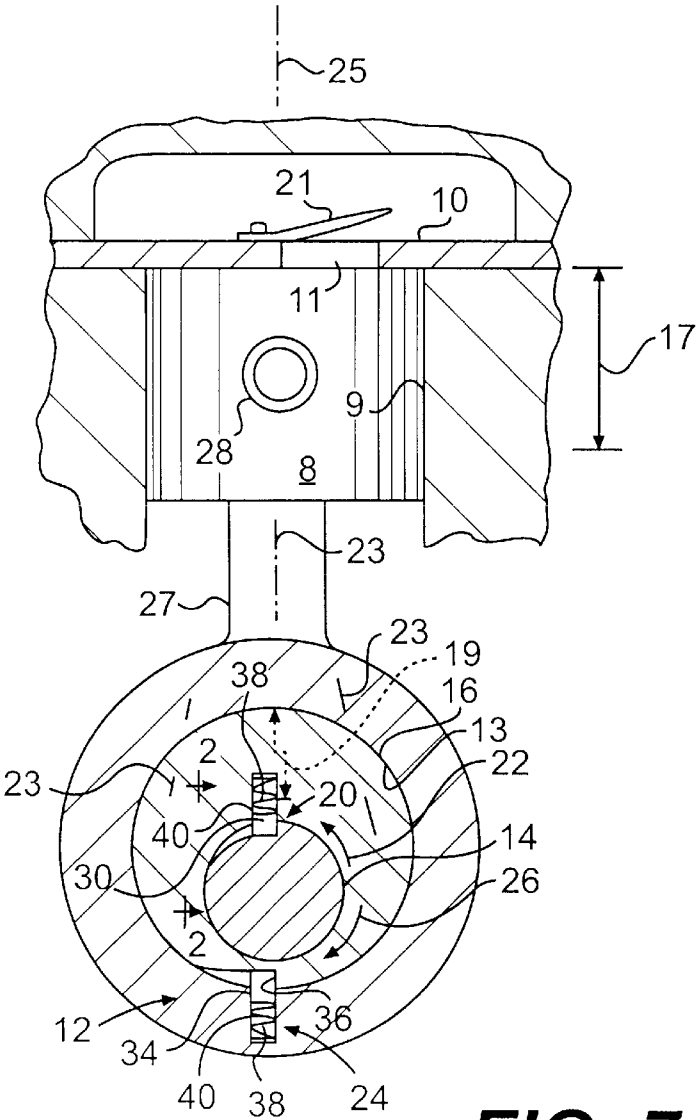
FIG. 7 is a partially cross-sectional view of portions of a refrigerant compressor.

FIGS. 7 and 8 illustrate another exemplary embodiment of the first and second stop mechanisms. This embodiment of the coupling structure is generally designated 12 and is shown in connection with a refrigerator compressor having a piston 8 mounted in a cylinder 9, and having a reed type discharge valve 21 mounted on a valve plate 10 having a discharge port 11 therethrough. The first stop means 20 comprises cooperating shoulder means such as pin 30 on eccentric cam 16 and shoulder 32 machined into crankpin 14, and wherein said second stop means 24 comprises cooperating shoulder means such as pin 34 on connecting rod 27 and shoulder 36 machined into eccentric cam 16. The pins 30 and 34 are continually urged radially inwardly from their sockets 38 by compression springs 40.

Figure 9:
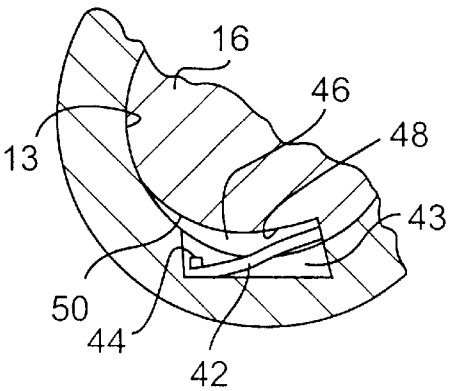
FIG. 9 is an enlarged view of a segment of FIG. 7 showing a variation in the stop mechanism structure.

As an alternative stop mechanism, as shown in FIG. 9, a leaf-type spring or equivalent structure 42 is affixed by screw 44 or the like in a slot 43 machined into connecting rod 27 and is normally sprung into slot 46 machined into eccentric cam 16. As eccentric cam 16 orbits counterclockwise, spring 42 is flexed radially outwardly in to slot 43. It is noted that spring 42 and slot 46 can be dimensioned such that the spring does not strike against the slot floor 48 upon each counterclockwise orbit of the crankpin and eccentric cam and create objectionable clicking sound. Also in this regard, the radius 50 of the exit from slot 46 further reduces or eliminates any noise created by contact of spring 42 with the eccentric cam. Such structure can also be used for the crankpin to eccentric cam junction.

Figure 10:
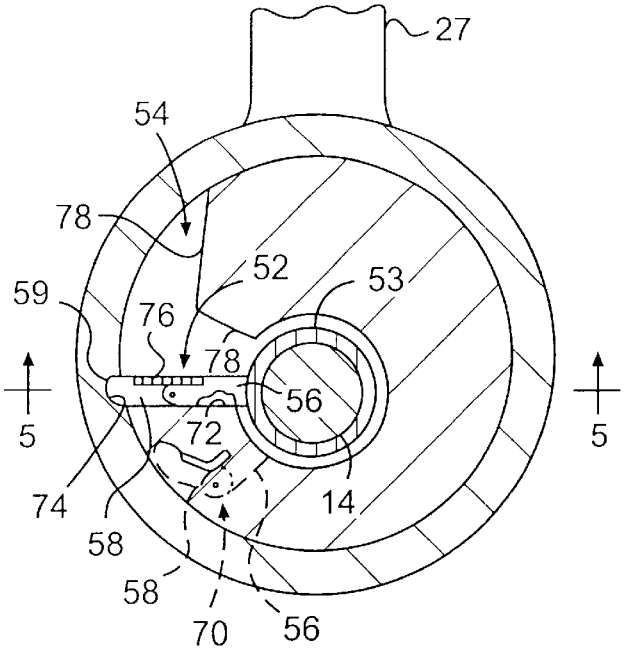
FIG. 10 is an enlarged view as in FIG. 7 taken along line 4—4 of FIG. 11 in the direction of the arrows and showing a variation in the stop mechanism.
Figure 11:
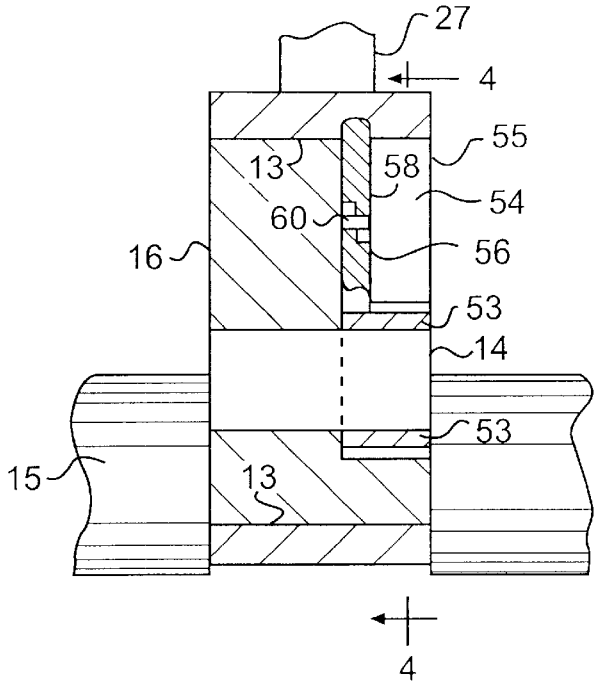
FIG. 11 is a cross sectional view taken along line 5—5 of FIG. 10 in the direction of the arrows and rotated 90° in the plane of the drawing sheet.
Figure 12:
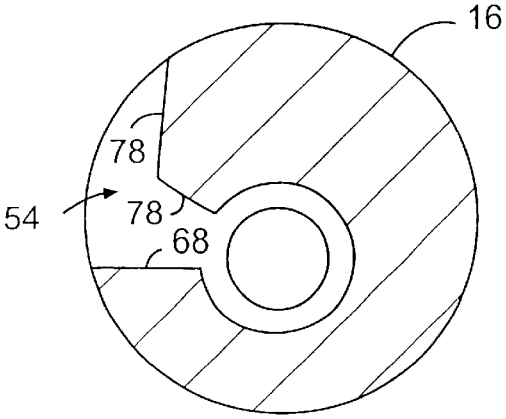
FIG. 12 is an isolated view of the cam bushing per se of FIG. 11.

Referring to FIGS. 10–12, a further variation of the stop structure is shown as being operable thru a break-down linkage which eliminates unnecessary contact of the stop with a rotating structure. In this embodiment as applied, for example, to the eccentric cam and connecting rod, a stop arm generally designated 52 is affixed to a sleeve 63 rotatably mounted on crankpin 14 within a recess 54 in a face 55 of eccentric cam 16. Arm 52 is comprised of an inner section 56 affixed to sleeve 53 and an outer stop section 58 providing a stop end 59. Sections 56 and 58 are pivotally connected by a hinge pin 60.

In the operation the stop mechanism of FIGS. 10–12 with the motor and crankshaft rotating in a clockwise direction for reduced stroke wherein only the crankpin will orbit clockwise, the crankpin will drag eccentric cam 16 also clockwise to engage its recess edge 68 with stop arm 52 and move it and straighten it from its dotted line neutral position 70 to its operative stopping position 72 as shown in FIG. 10 wherein end 59 is set into socket 74. This action locks the eccentric cam 16 to the connecting rod at the precise position that the eccentricity of eccentric cam 16 is aligned with the stroke axis 23 of the connecting rod to assure TDC. A light spring 76 affixed to the top of one of the sections 56 or 58 and sidable on the other may be used to urge section 58 downwardly (as viewed in the drawing) to assist in its insertion into socket 74. Other springs such as a torsional spring mounted over an extension of pivot pin 60 may also be used.

Reversal of the motor and crankshaft direction to a counterclockwise rotation for full stroke will forcibly rotate eccentric cam 16 to engage its recess edge 78 with arm 52 and break it down easily against the force of spring 76 as indicated by the dotted line positions 70 of arm sections 56 and 58 in FIG. 10. This action, at precisely said positions 70, will maintain alignment of the eccentricities of eccentric cam 16 and crankpin 14 in cooperation with the stop means which operatively connects crankpin 14 and eccentric cam 16 for simultaneous orbiting to ensure TDC.

It is noted that as crankpin 14 moves alone thru its orbit during reduced stroke the cam eccentricity 19 will be swung back and forth to each side of the piston stroke axis 25, but as indicated by the approximate dotted lines 23, the cam eccentricity will remain substantially aligned with the connecting rod axis 23.

It is apparent that the present invention in its broad sense is not limited to the use of any particular type of stop structure and the components of the stops shown herein can be reverse mounted, e.g., the spring 40 and pin 34 can be mounted in the cam bushing and the shoulder 36 cut into the bearing.

In the illustrated embodiments, the eccentricities of the eccentric cam and the crankpin are substantially equal whereby the cylinder capacity can be switched from full to substantially one half upon reversing the crankshaft rotation.

It is particularly noted that the first and second stop means or stop mechanisms may be positioned at any angular position around the crankpin and eccentric cam, and around the eccentric cam and connecting rod respectively as long as the two eccentricities are aligned for full stroke, and the bushing eccentricity is substantially aligned with the connecting rod stroke axis for the reduced stroke.

Figure 15A:
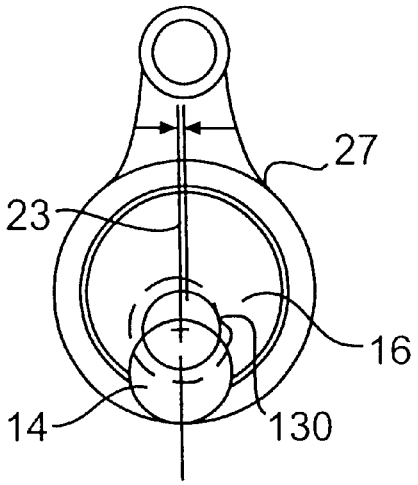
FIG. 15*a* is a front view of a mechanical system for linking a reversible motor to a piston, illustrating a stabilizing system when the compressor is operating in a full stroke mode.
Figure 15B:
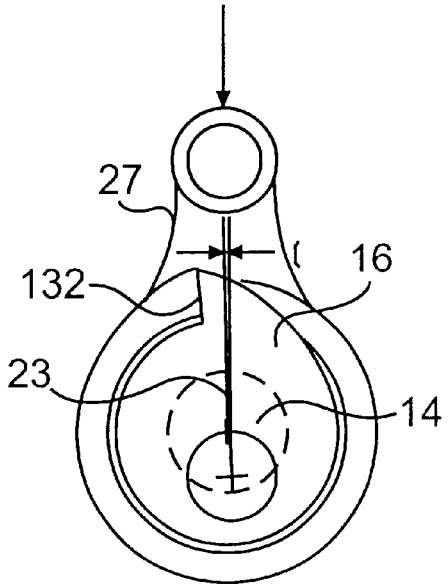
FIG. 15*b* is a rear view of a mechanical system for linking a reversible motor to a piston, illustrating a stabilizing system when the compressor is operating in a half stroke mode.

As shown in FIGS. 15*a* and 15*b*, first stop mechanism 130 and second stop mechanism 132 are preferably offset from connecting rod axis 23. When the crankshaft rotates in the forward direction to achieve the full stroke mode, first stop mechanism has a tendency to become unstable just after the piston passes top dead center. If first stop mechanism 130 is offset as shown in FIG. 15*a*, the forces that create the instability will act on eccentric cam 16 to move the eccentric cam into connection with the stop on the crankshaft, thereby removing the instability.

When the crankshaft rotates in the reverse direction and causes the piston to move through the half stroke, there is no tendency for the system to become unstable. However, during transients an instability could exist. Thus, second stop mechanism 132 is preferably advanced as shown in FIG. 15*b* to prevent any unstable conditions.

FIGS. 31A through 31E and 32A through 32F illustrate another exemplary embodiment of the present invention. This embodiment utilizes a single stop mechanism, which is arranged substantially perpendicular to the axis of the crankpin, to control the motion of the eccentric cam with respect to the crankpin and the connecting rod.

The stop mechanism 450 includes a bore 452, catches 454, and 456 and a sliding block 458. Bore 452 extends through the body of eccentric cam 16 from its inner surface 470 to its outer surface 472. Catch 454 is disposed on the surface of crankpin 14 and is configured to engage a first end 457 of sliding block 458,. Catch 456 is disposed on the inner surface 474 of connecting rod 27 and is configured to engage a second end 459 of sliding block 458. Catch 454 includes a stop surface 464 and an angled surface 466. Catch 456 also includes a stop surface 460 and an angled surface 462. Sliding block 458 is substantially perpendicular to crankpin 14 (referring to FIG. 32A). Sliding block 458 is longer than the length of bore 452 so that it must be in engagement with one of catches 454 and 456 at all times. However, when one end of sliding block 458 is engaged with one of catches 454 and 456, the other end of sliding block 458 is disposed within bore 452.

When crankpin 14 is rotating in the forward direction, as indicated by arrow 480 (referring to FIG. 31D), sliding block 458 is engaged with catch 454 so that eccentric cam 16 is fixed with respect to crankpin 14. Stop surface 464 engages first end 457 of sliding block 458 to prevent crankpin 14 from rotating with respect to eccentric cam 16. At the same time, second end 459 is disengaged from catch 456. Consequently, crankpin 14 and eccentric cam 16 rotate together as a unit within connecting rod 27 when crankpin 14 is rotating in the forward direction.

When crankpin 14 is rotating in the reverse direction, as indicated by arrow 482 (referring to FIG. 30E), sliding block 458 is engaged with catch 456 so that connecting rod 27 is fixed with respect to eccentric cam 16. Stop surface 460 engages second end 459 of sliding block 458 to prevent eccentric cam 16 from rotating with respect to connecting rod 27. At the same time, first end 457 is disengaged from catch 454 when crankpin 14 rotates in the reverse direction. As a result, eccentric cam 16 is fixed with respect to connecting rod 27 while crankpin 14 is free to rotate in the reverse direction with respect to eccentric cam 16.

As soon as crankpin 14 changes its rotation from the forward direction (referring to FIG. 31D) to the reverse direction (referring to FIG. 31E), angled surface 466 pushes sliding block 458 toward connecting rod 27. However, there may be a time delay between the change in the rotational direction and a disengagement of sliding block 458 from catch 454 because bore 452 may not be aligned with catch 456. If bore 452 is not aligned with catch 456 when the rotational direction changes, eccentric cam 16 will rotate with crankpin 14 in the reverse direction for a short period of time until bore 452 aligns with catch 456. When bore 452 aligns with catch 456, angled surface 466 pushes sliding block 458 into engagement with catch 456. As a result, eccentric cam 16 is fixed with respect to connecting rod 27 while crankpin 14 is free to rotate in the reverse direction with respect to eccentric cam 16.

As crankpin 14 changes its rotation from the reverse direction (referring to FIG. 31E) to the forward direction (referring to FIG. 31D), first end 457 of sliding block 458 engages catch 454 to fix eccentric cam 16 with respect to crankpin 14. However, there may be a time delay between the change in the rotational direction and a disengagement of sliding block 458 from catch 456 because catch 454 may not be aligned with bore 452 when the rotational direction changes. As crankpin 14 changes its rotation from the reverse direction to the forward direction, crankpin 14 will drag eccentric cam 16 in the forward direction so that angled surface 462 pushes sliding block 458 toward eccentric cam 16. First end 457 of sliding block 458, however, may not engage catch 454 for a short period of time until catch 454 aligns with bore 452. When catch 454 aligns with bore 452, angled surface 462 pushes sliding block 458 into engagement with catch 454. As a result, crankpin 14 is fixed with respect to eccentric cam 16 to rotate together in the forward direction within connecting rod 27.

FIGS. 33A through 33E and 34A through 34F illustrate another exemplary embodiment of the present invention. This embodiment also utilizes a single stop mechanism, which is arranged substantially perpendicular to the axis of the crankpin, to control the motion of the eccentric cam with respect to the crankpin and the connecting rod.

The stop mechanism 500 includes a bore 502, catches 504, and 506 and a sliding pin 508. Bore 502 extends through the body of eccentric cam 16 from its inner surface 520 to its outer surface 522. Catch 504 is disposed on the surface of crankpin 14 and is configured to engage a first end 507 of sliding pin 508. Catch 506 is disposed on the inner surface 524 of connecting rod 27 and is configured to engage a second end 509 of sliding pin 508. Catch 504 includes a stop surface 514 and an angled surface 516. Catch 506 also includes a stop surface 510 and an angled surface 512. Sliding pin 508 is substantially perpendicular to crankpin 14 (referring to FIG. 34A). Sliding pin 508 is longer than the length of bore 502 so that it must be in engagement with one of catches 504 and 506 at all times. However, when one end of sliding pin 508 is engaged with one of catches 504 and 506, the other end of sliding pin 508 is disposed within bore 502.

When crankpin 14 is rotating in the forward direction, as indicated by arrow 530 (referring to FIG. 33D), sliding pin 508 is engaged with catch 504 so that eccentric cam 16 is fixed with respect to crankpin 14. Stop surface 514 engages first end 507 of sliding pin 508 to prevent crankpin 14 from rotating with respect to eccentric cam 16. At the same time, second end 509 is disengaged from catch 506. Consequently, crankpin 14 and eccentric cam 16 rotate together as a unit within connecting rod 27 when crankpin 14 is rotating in the forward direction.

When crankpin 14 is rotating in the reverse direction, as indicated by arrow 532 (referring to FIG. 33E), sliding pin 508 is engaged with catch 506 so that connecting rod 27 is fixed with respect to eccentric cam 16. Stop surface 510 engages second end 509 of sliding pin 508 to prevent eccentric cam 16 from rotating with respect to connecting rod 27. At the same time, first end 507 is disengaged from catch 504 when crankpin 14 rotates in the reverse direction. As a result, eccentric cam 16 is fixed with respect to connecting rod 27 while crankpin 14 is free to rotate in the reverse direction with respect to eccentric cam 16.

As soon as crankpin 14 changes its rotation from the forward direction (referring to FIG. 33D) to the reverse direction (referring to FIG. 33E), angled surface 516 pushes sliding pin 508 toward connecting rod 27. However, there may be a time delay between the change in the rotational direction and a disengagement of sliding pin 508 from catch 504 because bore 502 may not be aligned with catch 506. If bore 502 is not aligned with catch 506 when the rotational direction changes, eccentric cam 16 will rotate with crankpin 14 in the reverse direction for a short period of time until bore 502 aligns with catch 506. When bore 502 aligns with catch 506, angled surface 516 pushes sliding pin 508 into engagement with catch 506. As a result, eccentric cam 16 is fixed with respect to connecting rod 27 while crankpin 14 is free to rotate in the reverse direction with respect to eccentric cam 16.

As crankpin 14 changes its rotation from the reverse direction (referring to FIG. 33E) to the forward direction (referring to FIG. 33D), first end 507 of sliding pin 508 engages catch 504 to fix eccentric cam 16 with respect to crankpin 14. However, there may be a time delay between the change in the rotational direction and a disengagement of sliding pin 508 from catch 506 because catch 504 may not be aligned with bore 502 when the rotational direction changes. As crankpin 14 changes its rotation from the reverse direction to the forward direction, crankpin 14 will drag eccentric cam 16 in the forward direction so that angled surface 512 pushes sliding pin 508 toward eccentric cam 16. First end 507 of sliding pin 508, however, may not engage catch 504 for a short period of time until catch 504 aligns with bore 502. When catch 504 aligns with bore 502, angled surface 512 pushes sliding pin 508 into engagement with catch 504. As a result, crankpin 14 is fixed with respect to eccentric cam 16 to rotate together in the forward direction within connecting rod 27.

In accordance with the present invention, a unique electrical circuit has been developed for controlling the reversible motor and may be employed in a preferred embodiment of the invention as described below in connection with a single cylinder compressor, the circuit being shown schematically in FIGS. 16 and 17.

Figure 16:
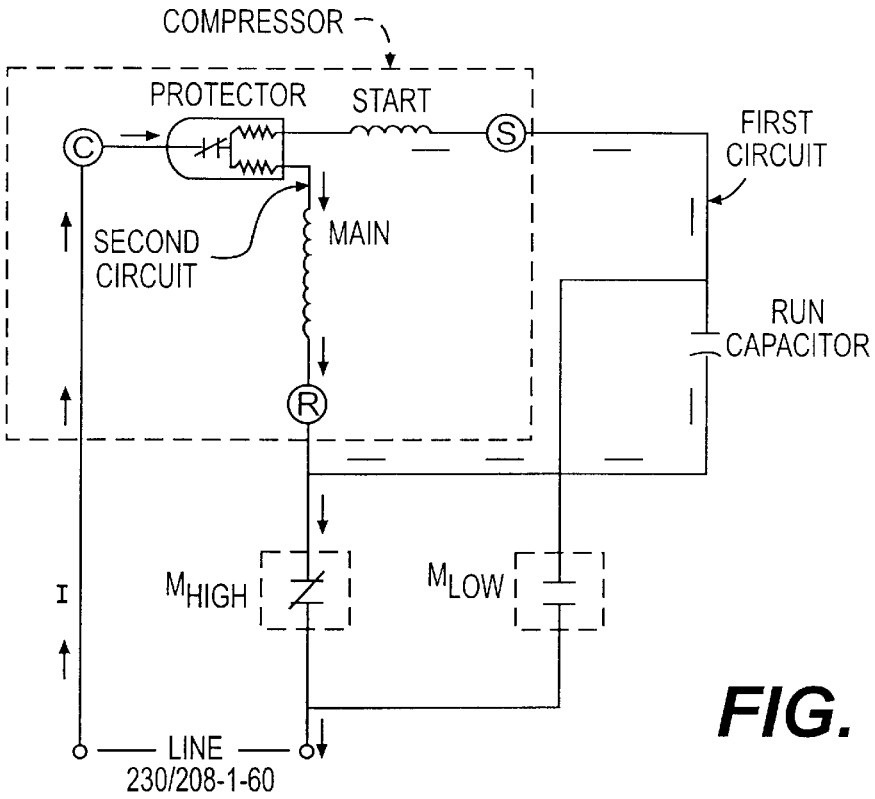
FIG. 16 is a motor control schematic for full capacity compressor operation.

The control schematic of FIG. 16 is equivalent to industry conventional PSC (permanent, split capacitor) wiring schematics using predetermined power supply. Line 1 runs through the common terminal (C) which leads into the motor protection. After leaving the motor protection, the current flow will split, going through both the start (S) and main, i.e., run (R) windings with M (motor) High contactor closed. This stage will be using the run winding as the main winding and places the run capacitor in series with the start winding, obtaining standard motor rotation with the piston fully active, i.e., full capacity operation.

Figure 17:
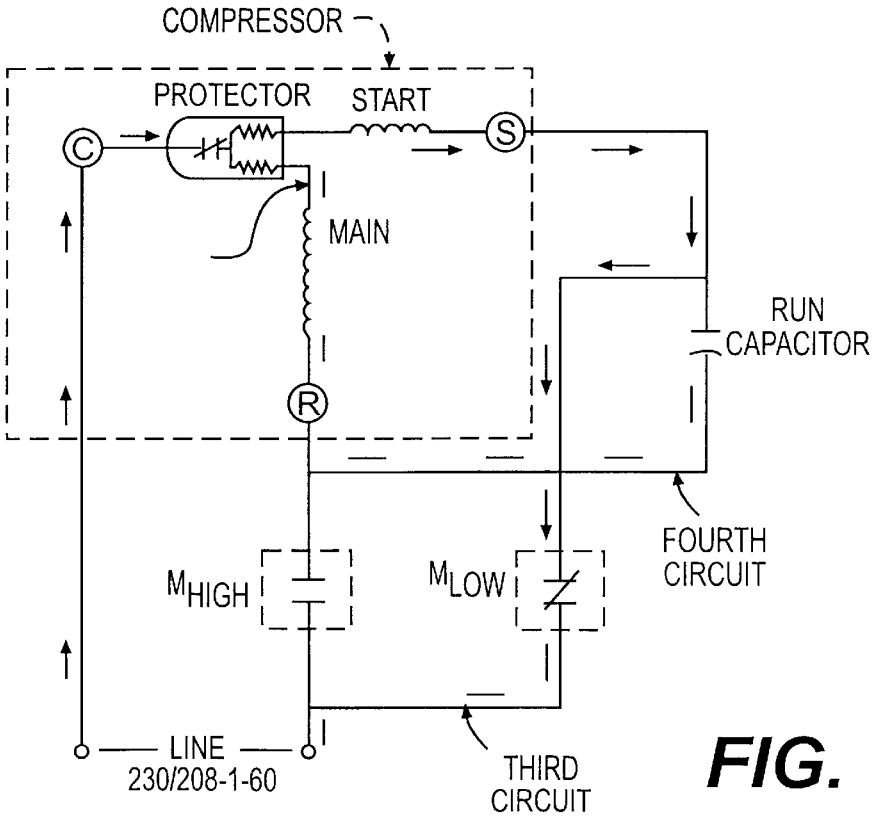
FIG. 17 is a motor control schematic for motor reversal and reduced capacity compressor operation.

The present unique Control Schematic of FIG. 17 employs a predetermined power supply depending on application. Line one will run through the common terminal (C), which leads to the motor protection. After leaving the motor protection, the current flow separates going through both the original start and original main windings with M low contactor energized. The compressor will now be using the start winding as the main and placing the run capacitor in series with the original main winding. Run capacitor placement in this mode facilitates both motor and mechanical rotation changes and simultaneously reduces motor strength to match the resulting reduced piston stroke, thus maximizing motor efficiency for the reduced load. It is particularly noted that for certain applications the original main winding and start capacitor, in reduced compressor capacity mode, may be taken off-line by a centrifugal switch or the like after the motor attains operational speed.

Suitable exemplary solenoid actuated contactors or switches for use as the "switching means" of the present invention are shown and described in the General Electric, Product information brochure GEA-115408 4/87 ISM 1800, entitled "Definite Purpose Controls", 23 pages, the disclosure of which is hereby incorporated herein by reference in its entirety.

As best known at this time for use with a single cylinder compressor described below, the power unit would employ the following structures and operating characteristics:

Motor—reversible, squirrel cage induction, PSC, 1–3 hp

Protector—Protects against overload in both load modes. Senses both T° and current;

| | | |
|---|---|---|
| [0171] | Run Capacitor | 35 $\mu$F/370 VAC; |
| [0172] | Speed (rated load) | 3550 rpm; |
| [0173] | Motor Strength | 252 oz. ft. Max/<br>90 oz. ft. rated load; |
| [0174] | Power Supply - Single or three phase of any frequency or voltage, e.g., 230 V - 60 $H_z$ single phase, or 460 V - 60 $H_z$ three phase; | |

Switching Mechanism—control circuit which is responsive to load requirements to operate solenoid contactor and place the run capacitor in series with either the start winding or main winding, depending on the load requirements.

The compressor would have substantially the following structure and operating characteristics:

| | | |
|---|---|---|
| [0177](a) | size (capacity) | 3 Ton; |
| [0178](b) | number of cylinders | One; |
| [0179](c) | cylinder displacement at full throw | 3.34 $in^3$/rev; |
| [0180](d) | full stroke length | 0.805 in.; |
| [0181](e) | normal operating pressure range in full stroke mode | 77 to 297 Psig. |

Figure 18:
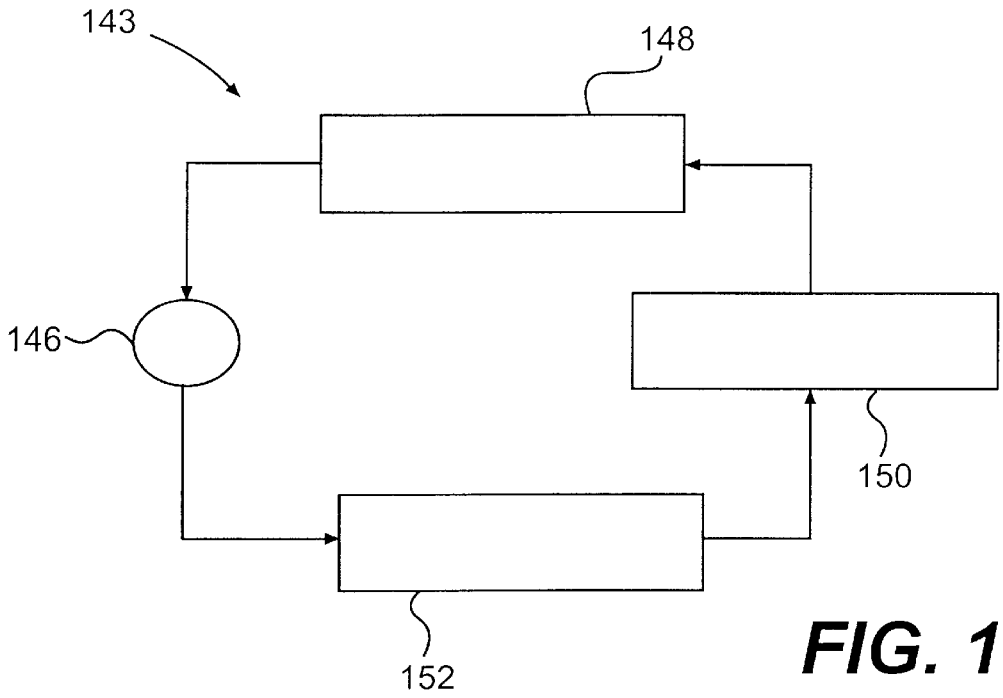
FIG. 18 is a schematic diagram of a refrigeration cycle.

In accordance with the present invention, the two stage reciprocating compressor and control system described above may be used in a variety of commercial applications utilizing a refrigeration cycle. An exemplary embodiment of a refrigeration cycle is illustrated in FIG. 18 and generally designated as reference number 143. As shown, refrigeration cycle 143 includes a condenser 148, an expansion device 146, an evaporator 152, and a two-stage reciprocating compressor 150. A refrigerant is circulated through the refrigeration cycle. As is known in the art, the capacity of compressor 150 directly affects the amount of cooling provided by the refrigerant in the evaporator. When the two stage reciprocating compressor is operated in the full stroke mode, compressor 150 operates at full capacity and provides maximum cooling to the evaporator. When the two stage reciprocating compressor is operated in the reduced stroke mode, the amount of cooling provided to the evaporator is similarly reduced.

Figure 19:
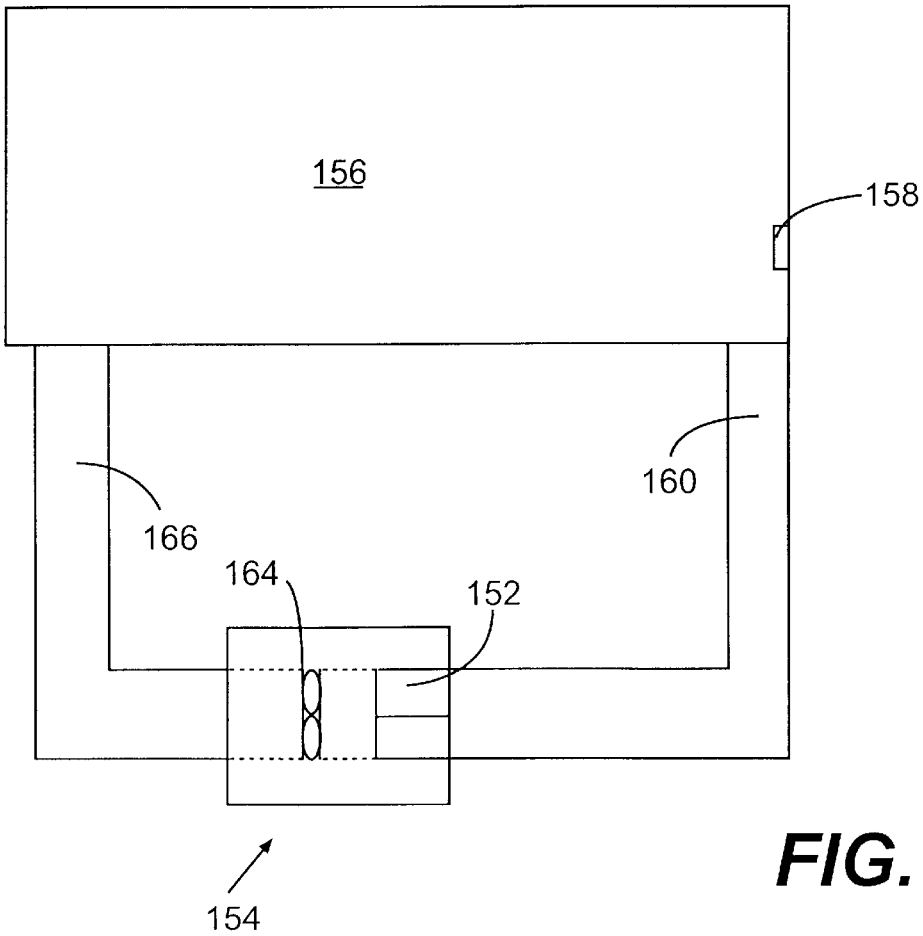
FIG. 19 is a schematic diagram of a heating, ventilating, and air conditioning ("HVAC") system.

It is contemplated that the two stage reciprocating compressor of the present invention may be used in a variety of commercial applications. For example, as illustrated in FIG. 19, refrigeration cycle 143 may be used in a heating, ventilating, and air conditioning ("HVAC") system. The HVAC system is used to condition the air in an enclosure 156. Air is circulated through the HVAC unit 154 through supply duct 160 and return duct 166 by a blower 164. Blower 164 passes air over the evaporator of the refrigeration cycle to cool the air before the air enters the room. A temperature sensor 158 is positioned within enclosure 156. When sensor 158 determines the temperature of enclosure has risen above a preset limit, sensor 158 activates the compressor in either the full stroke mode or the reduced stroke mode depending upon the sensed temperature of the air. Operating the compressor at the appropriate capacity depending upon the current conditions of the room will improve the overall efficiency of the system. It is contemplated that the present invention may be used in other air conditioning systems, such as heat pumps, or the like.

Figure 20:
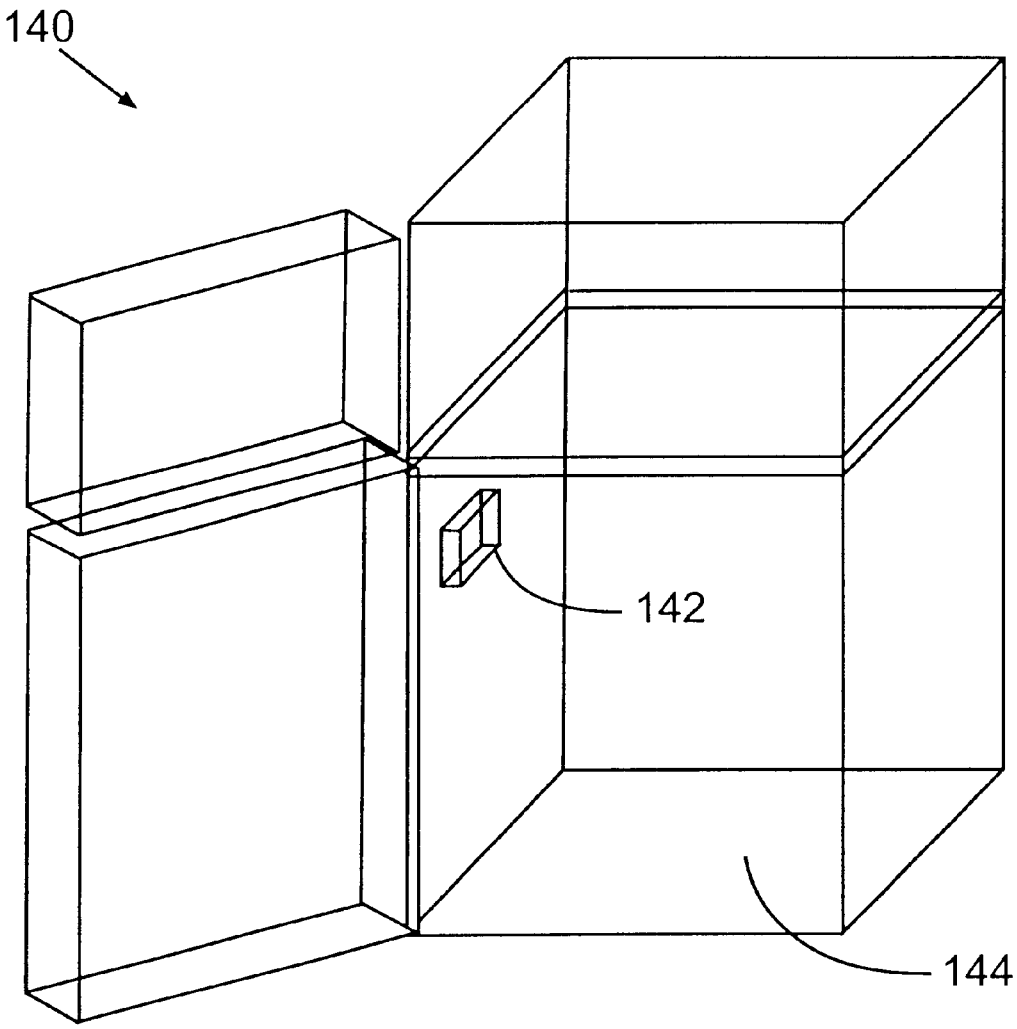
FIG. 20 is a perspective view of a refrigerator appliance.
Figure 21A:
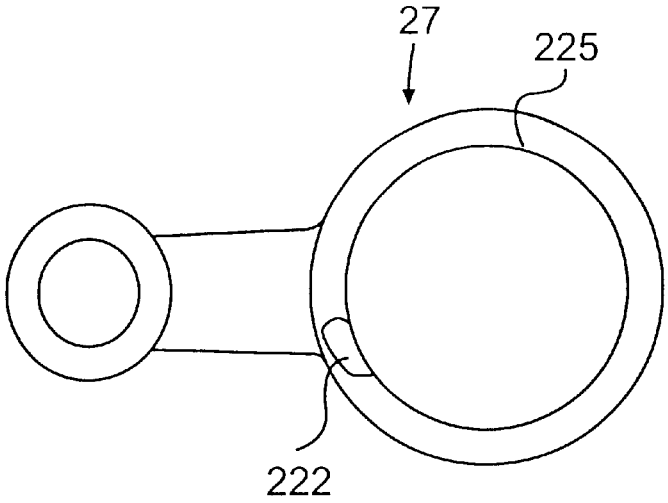
FIG. 21A is a cross sectional view of a connecting rod according to another embodiment of the present invention.
Figure 21B:
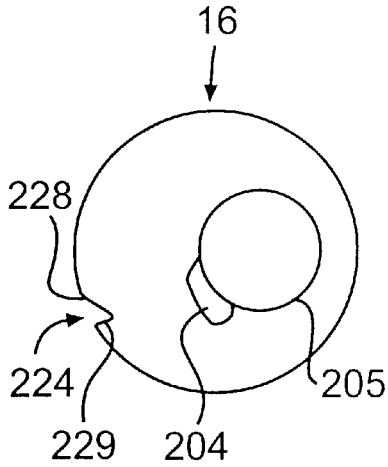
FIG. 21B is a cross sectional view of an eccentric cam according to another embodiment of the present invention.
Figure 21C:
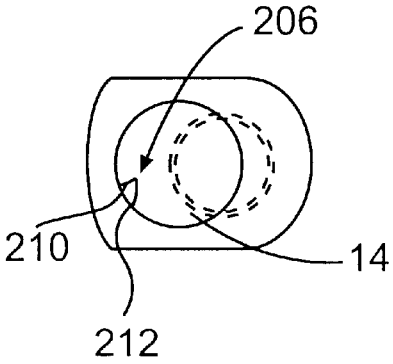
FIG. 21C is a cross sectional view of a crankpin and a crankshaft according to another embodiment of the present invention.
Figure 21D:
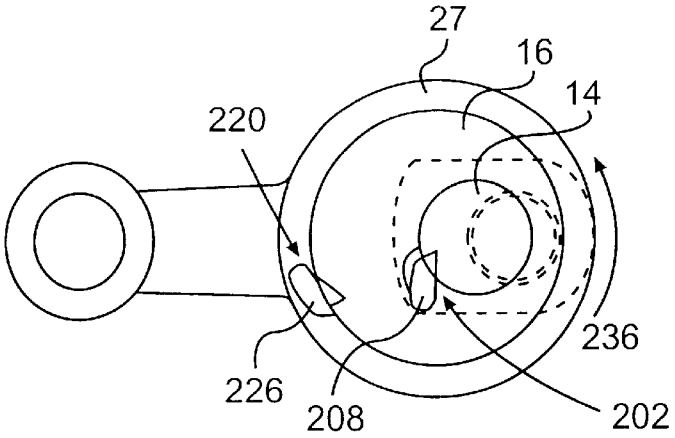
FIG. 21D is a cross sectional view illustrating a compressor operation when the crankpin is rotating in a forward direction.
Figure 21E:
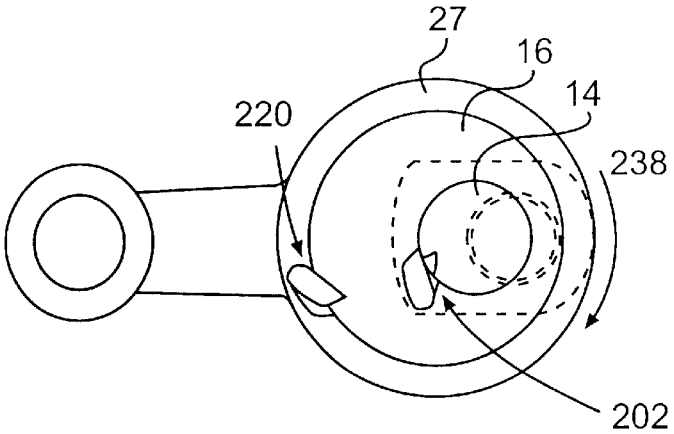
FIG. 21E is a cross sectional view illustrating a compressor operation when the crankpin is rotating in a reverse direction.
Figure 21F:
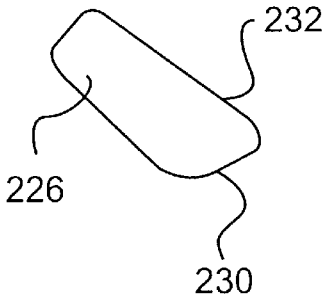
FIGS. 21F and 21G are cross sectional views of pawls according to another embodiment of the present invention.
Figure 21G:
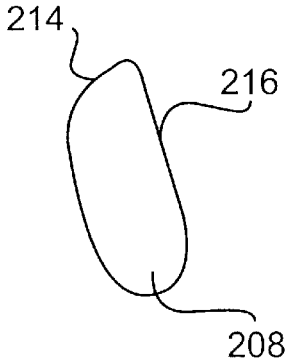
Figure 22A:
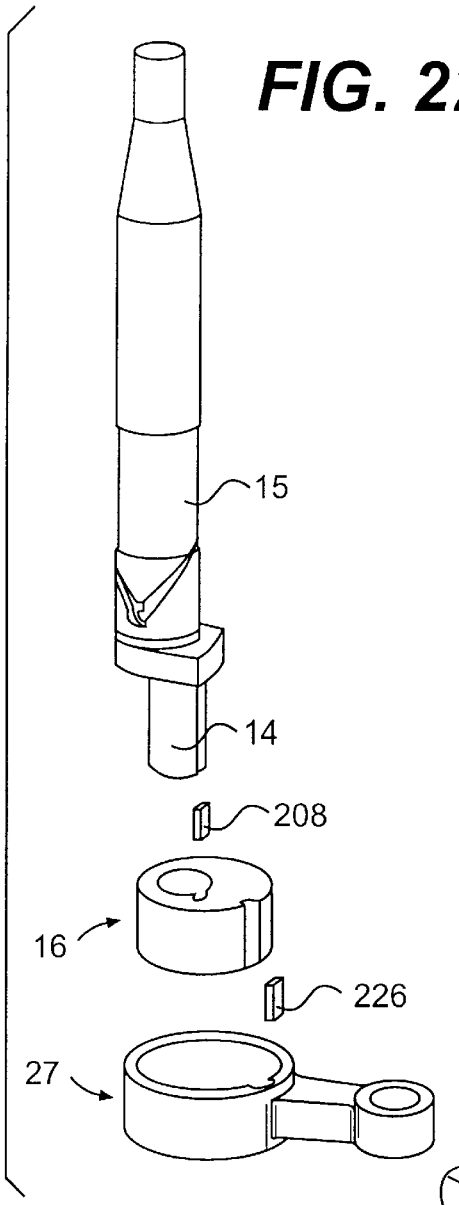
FIGS. 22A through 22E are perspective views of a connecting rod, an eccentric cam, a crankpin, and a crankshaft shown in FIGS. 21A through 21E.
Figure 22B:
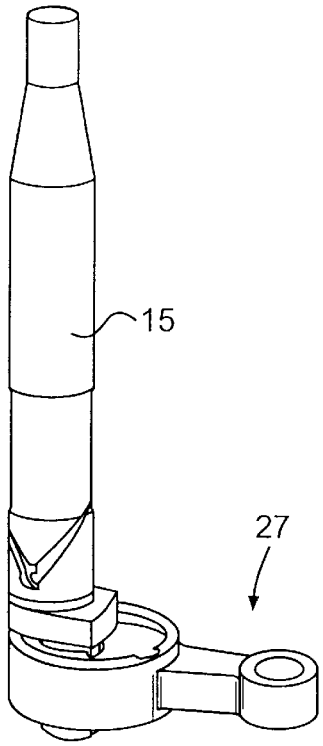
Figure 22C:
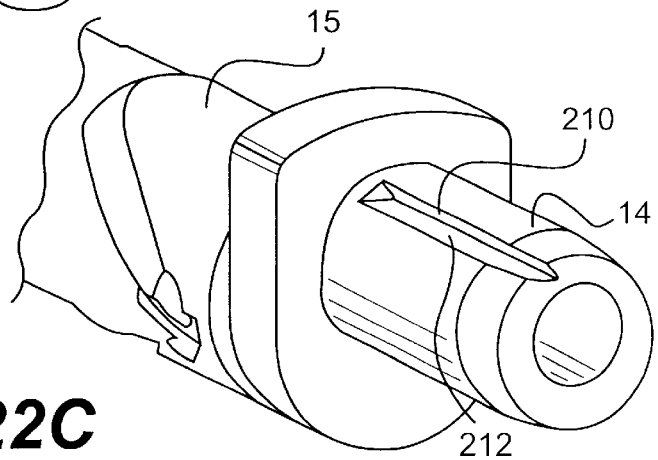
Figure 22E:
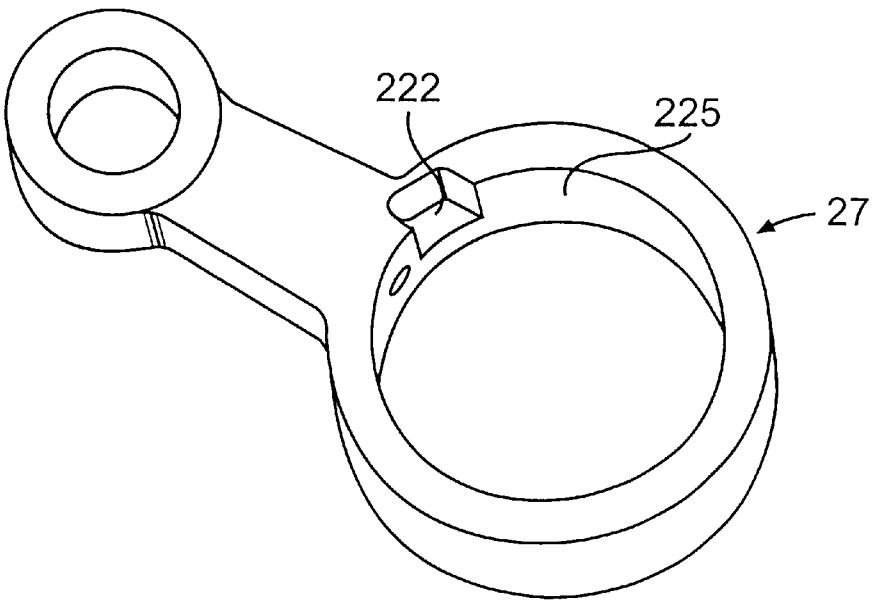
Figure 22D:
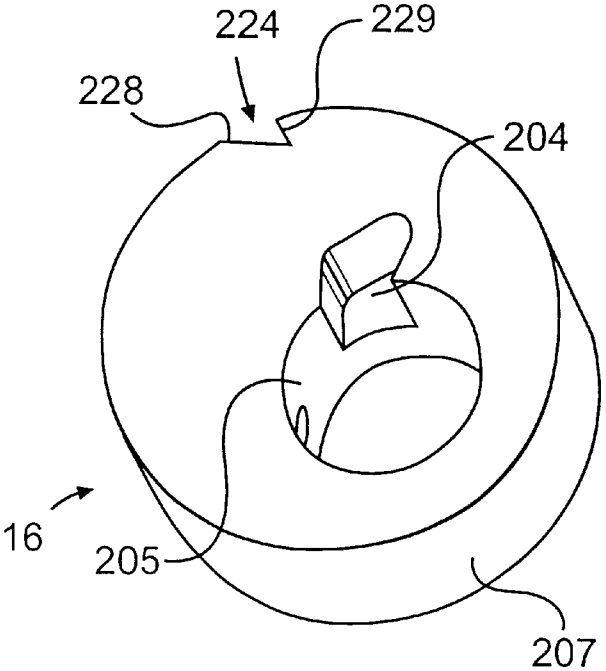
Figure 23A:
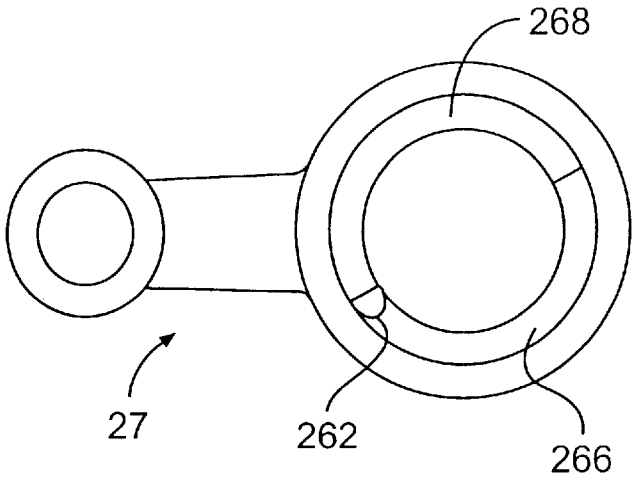
FIG. 23A is a cross sectional view of a connecting rod according to another embodiment of the present invention.
Figure 23B:
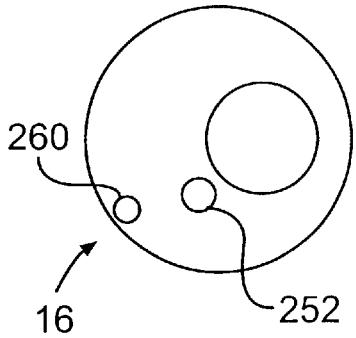
FIG. 23B is a cross sectional view of an eccentric cam according to another embodiment of the present invention.
Figure 23C:
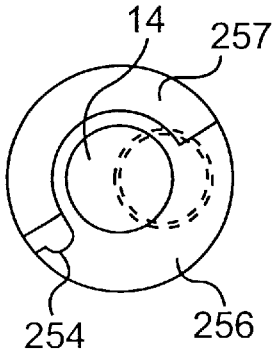
FIG. 23C is a cross sectional view of a crankpin and a crankshaft according to another embodiment of the present invention.
Figure 23D:
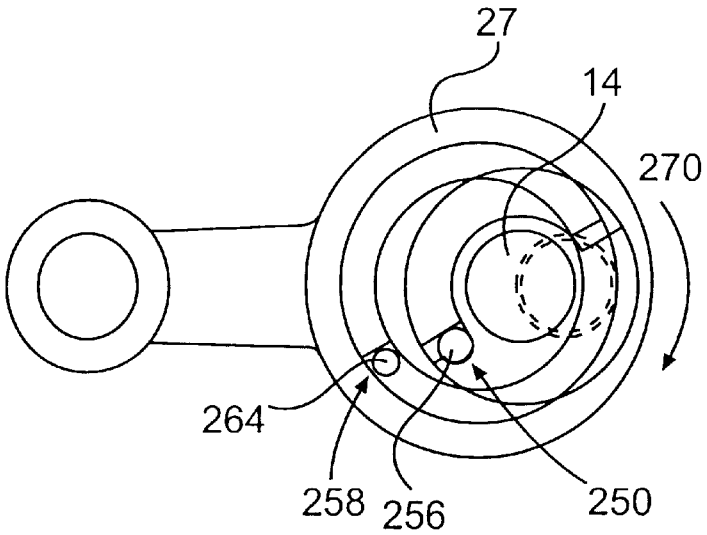
FIG. 23D is a cross sectional view illustrating a compressor operation when the crankpin is rotating in a forward direction.
Figure 23E:
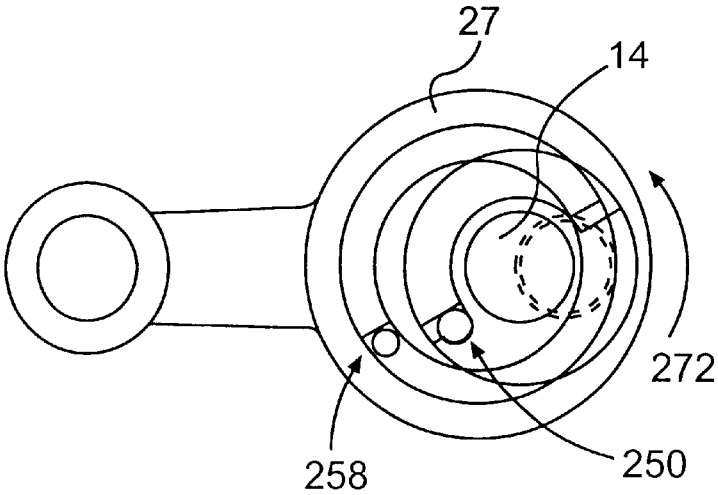
FIG. 23E is a cross sectional view illustrating a compressor operation when the crankpin is rotating in a reverse direction.
Figure 24A:
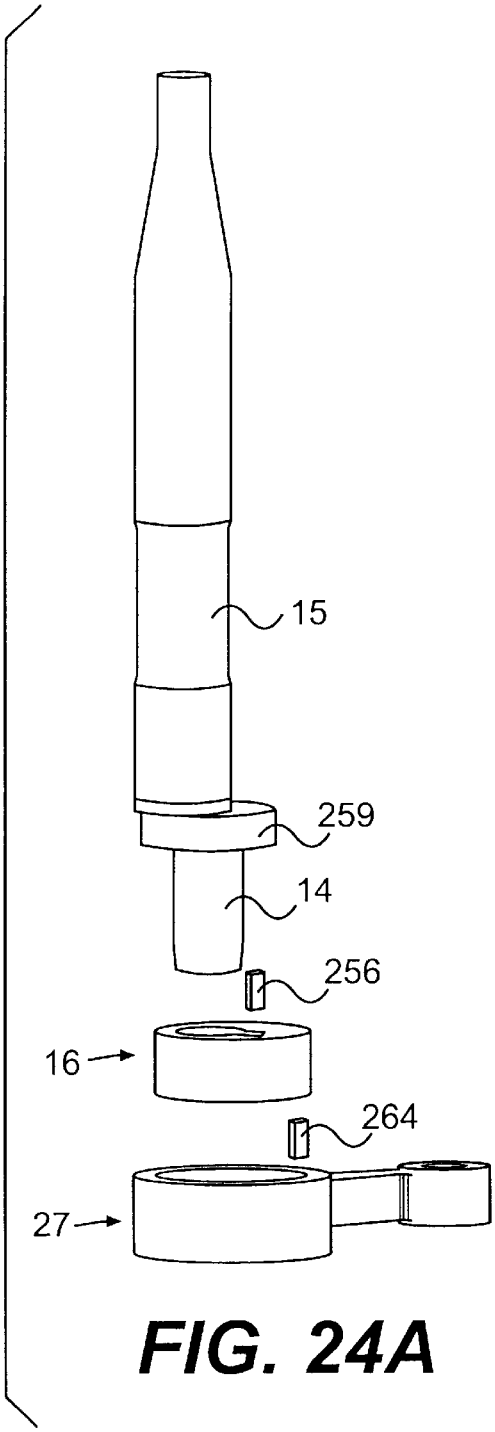
FIGS. 24A through 24F are perspective views of a connecting rod, an eccentric cam, a crankpin, and a crankshaft shown in FIGS. 23A through 23E.
Figure 24B:
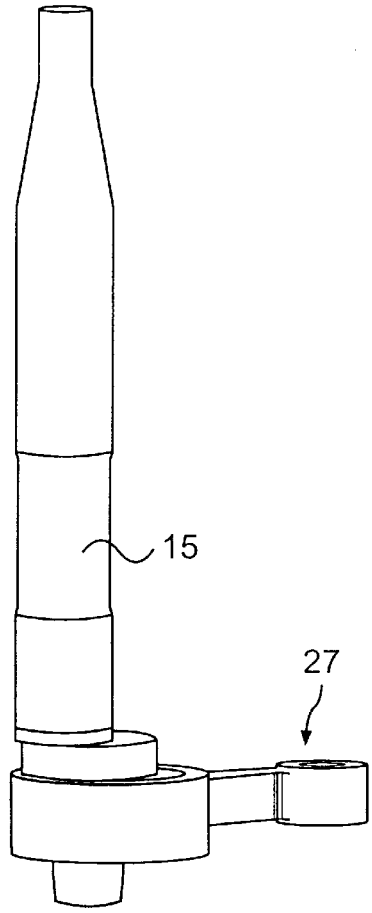
Figure 24C:
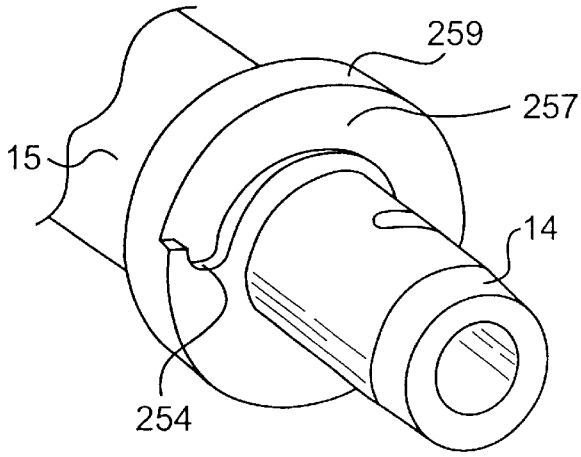
Figure 24D:
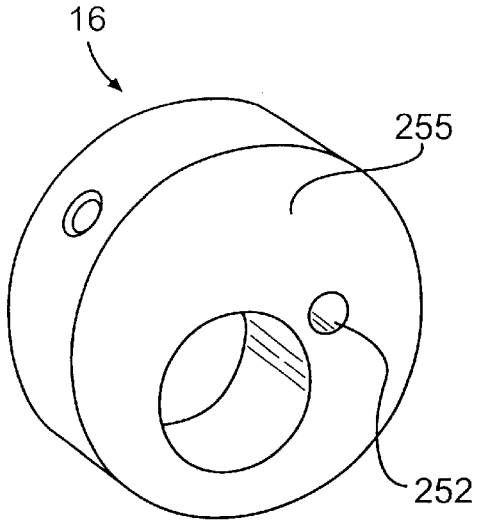
Figure 24E:
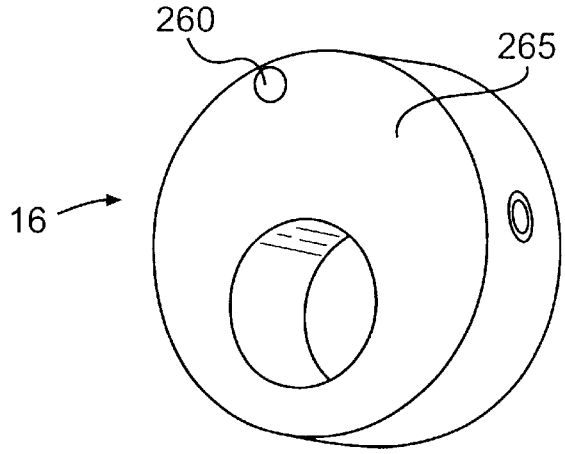
Figure 24F:
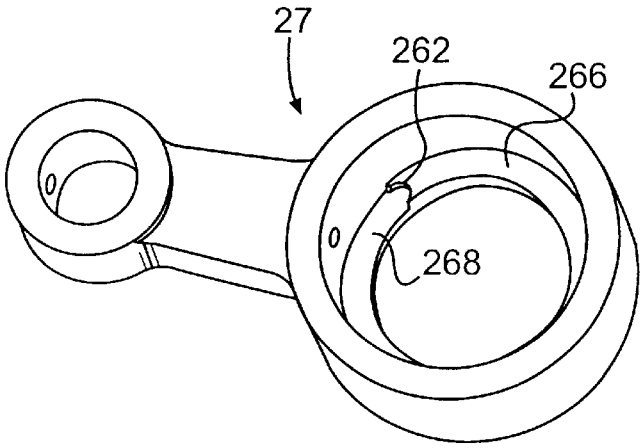
Figure 25A:
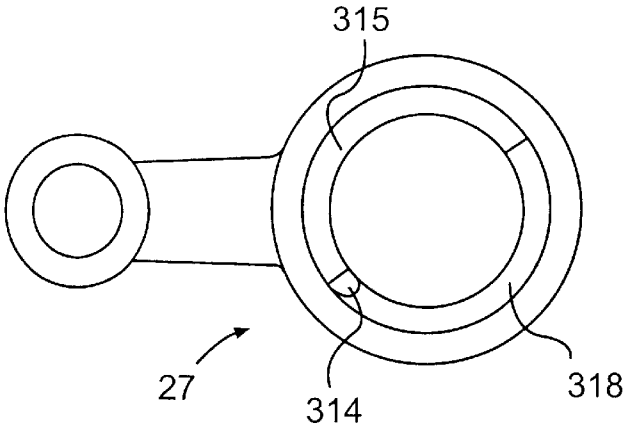
FIG. 25A is a cross sectional view of a connecting rod according to another embodiment of the present invention.
Figure 25B:
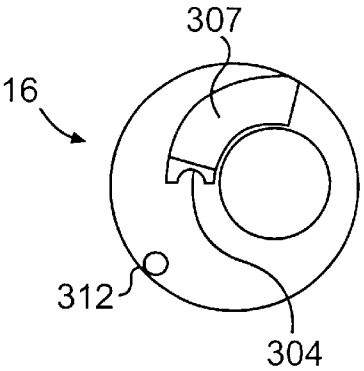
FIG. 25B is a cross sectional view of an eccentric cam according to another embodiment of the present invention.
Figure 25C:
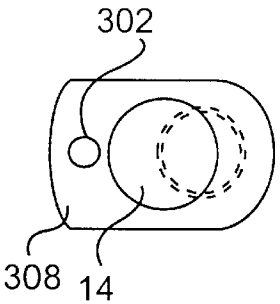
FIG. 25C is a cross sectional view of a crankpin and a crankshaft according to another embodiment of the present invention.
Figure 25D:
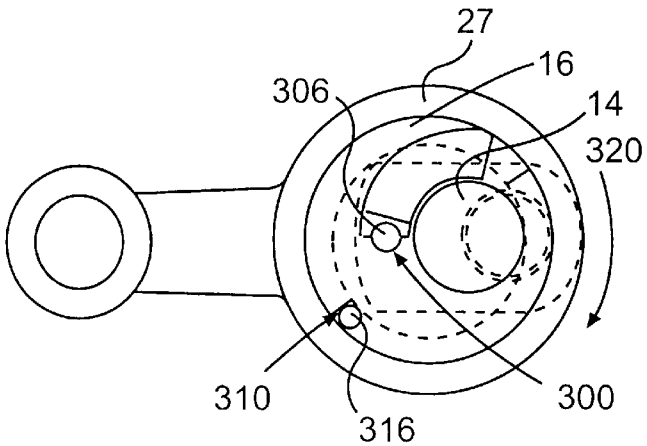
FIG. 25D is a cross sectional view illustrating a compressor operation when the crankpin is rotating in a forward direction.
Figure 25E:
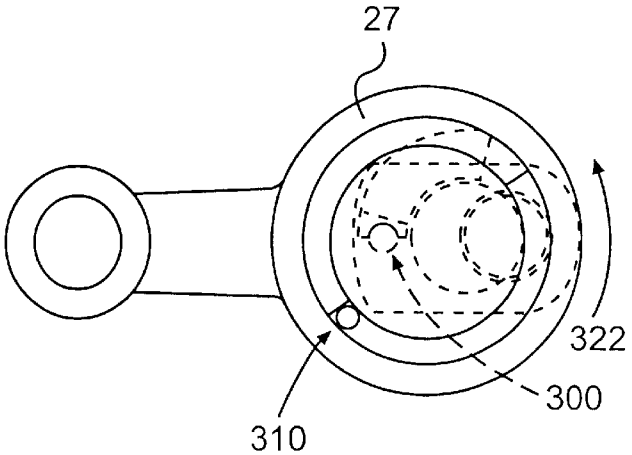
FIG. 25E is a cross sectional view illustrating a compressor operation when the crankpin is rotating in a reverse direction.
Figure 26A:
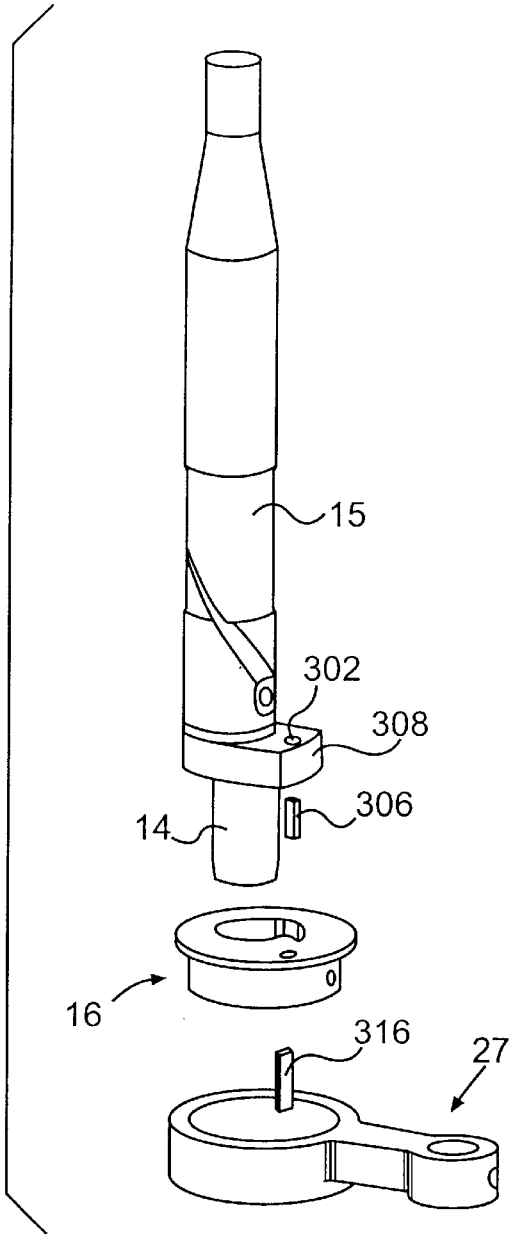
FIGS. 26A through 26D are perspective views of a connecting rod, an eccentric cam, a crankpin, and a crankshaft shown in FIGS. 25A through 25E.
Figure 26B:
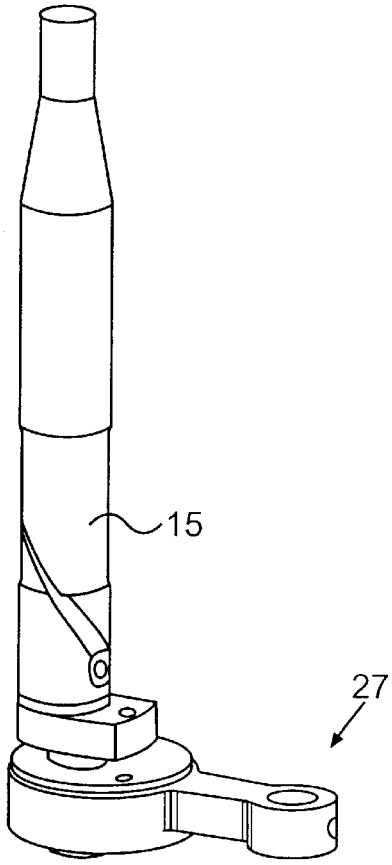
Figure 26C:
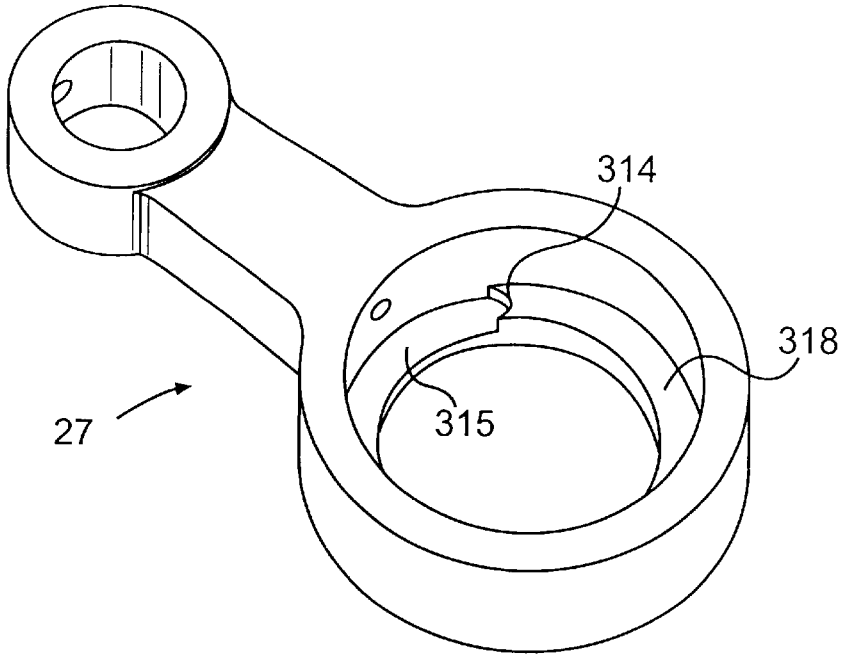
Figure 26D:
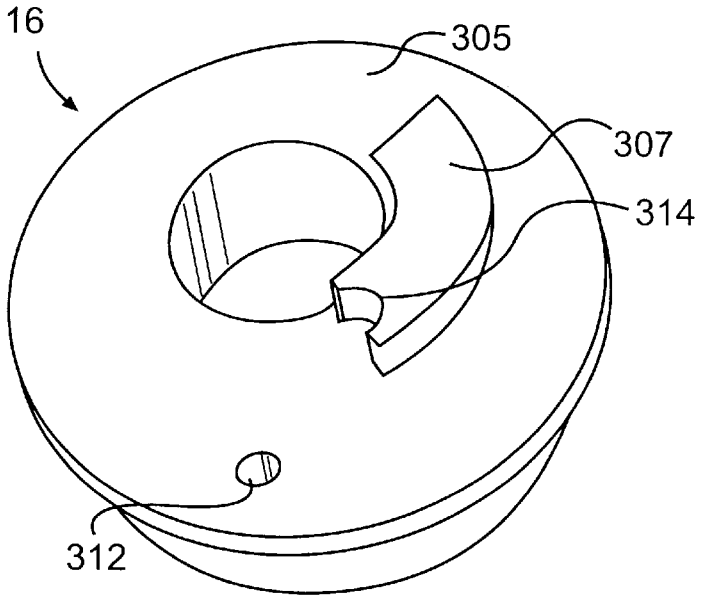
Figure 27A:
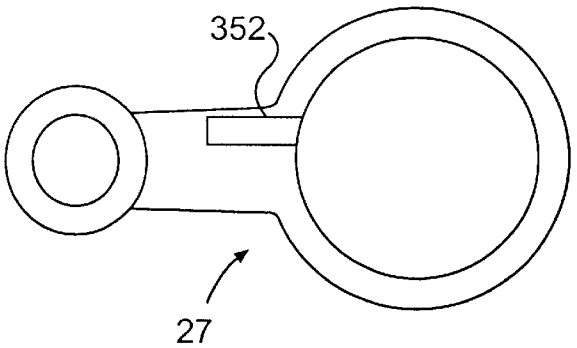
FIG. 27A is a cross sectional view of a connecting rod according to another embodiment of the present invention.
Figure 27B:
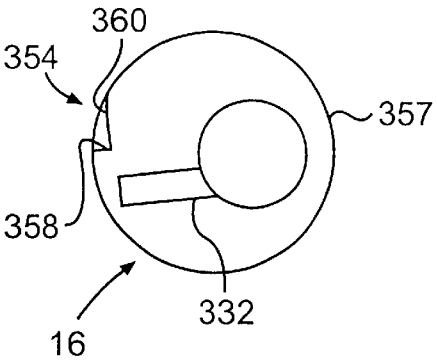
FIG. 27B is a cross sectional view of an eccentric cam according to another embodiment of the present invention.
Figure 27C:
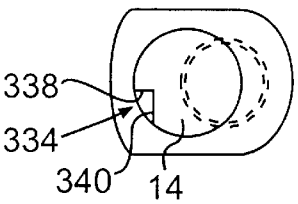
FIG. 27C is a cross sectional view of a crankpin and a crankshaft according to another embodiment of the present invention.
Figure 27D:
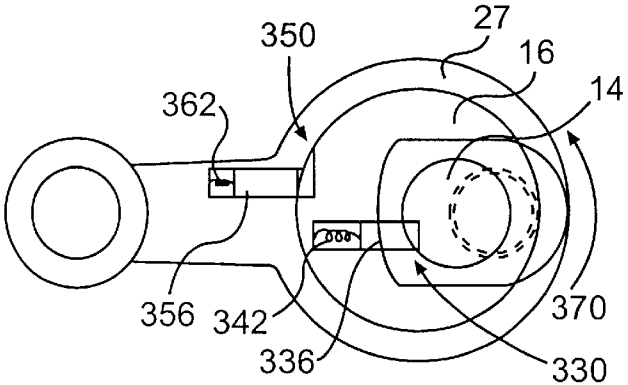
FIG. 27D is a cross sectional view illustrating a compressor operation when the crankpin is rotating in a forward direction.
Figure 27E:
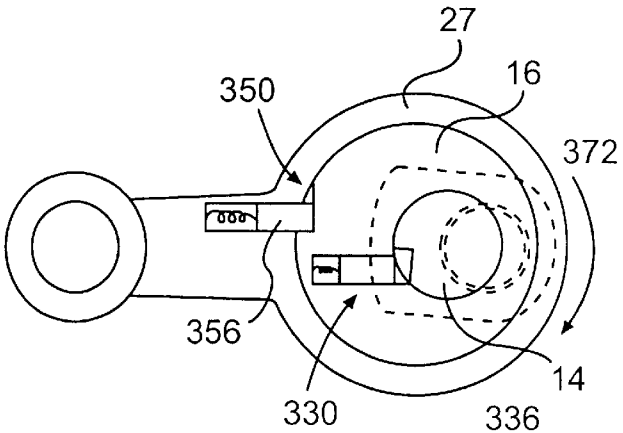
FIG. 27E is a cross sectional view illustrating a compressor operation when the crankpin is rotating in a reverse direction.
Figure 28A:
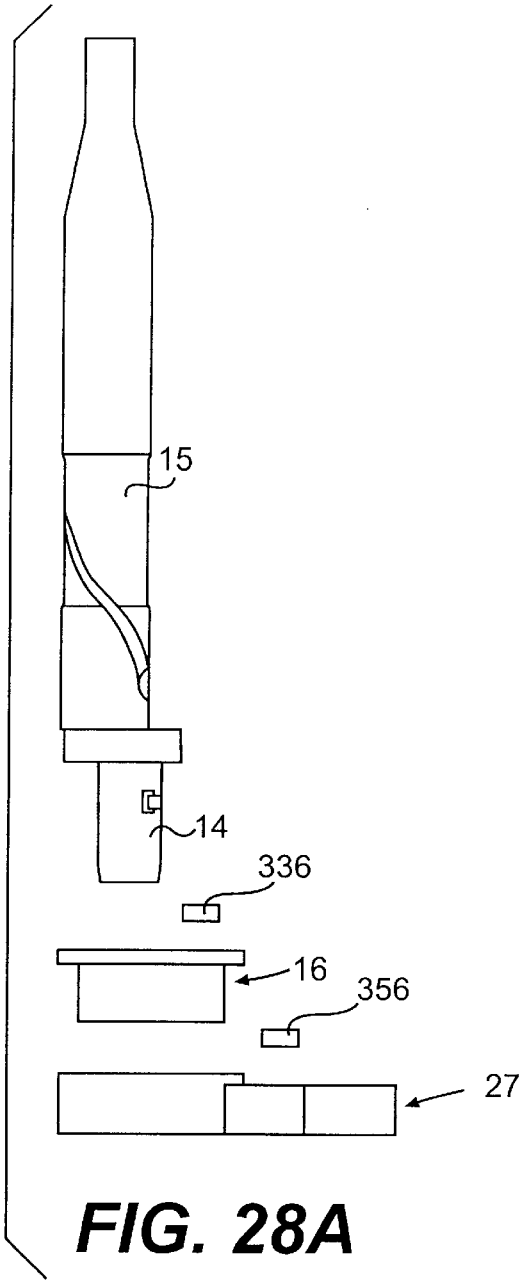
FIGS. 28A through 28F are perspective views of a connecting rod, an eccentric cam, a crankpin, and a crankshaft shown in FIGS. 27A through 27E.
Figure 28B:
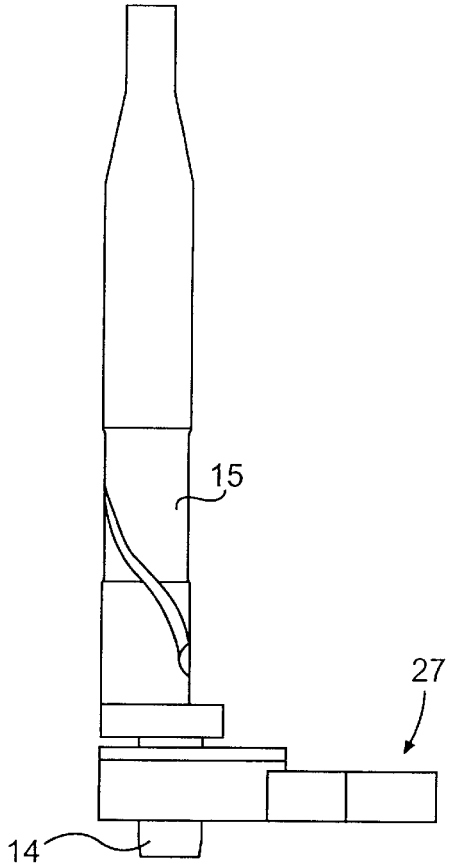
Figure 28C:
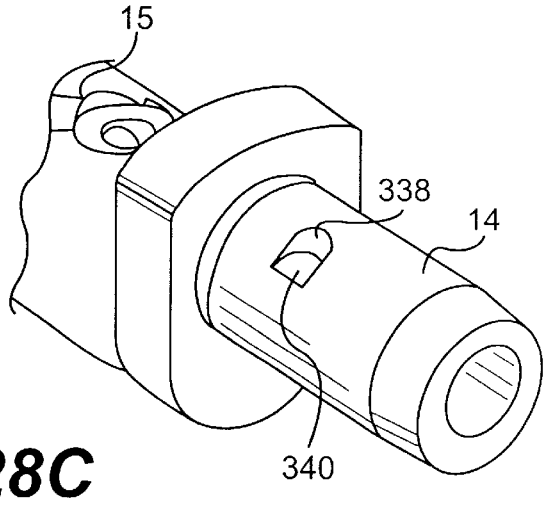
Figure 28D:
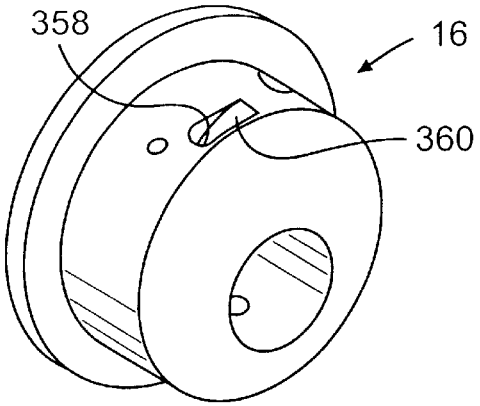
Figure 28E:
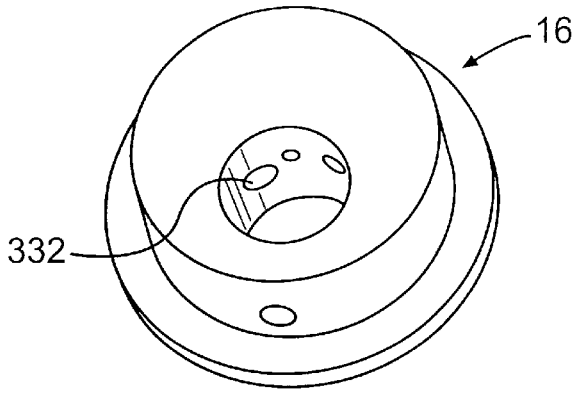
Figure 28F:
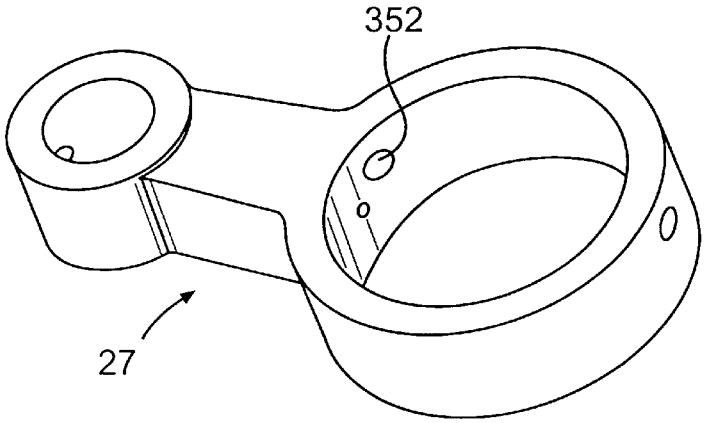
Figure 29A:
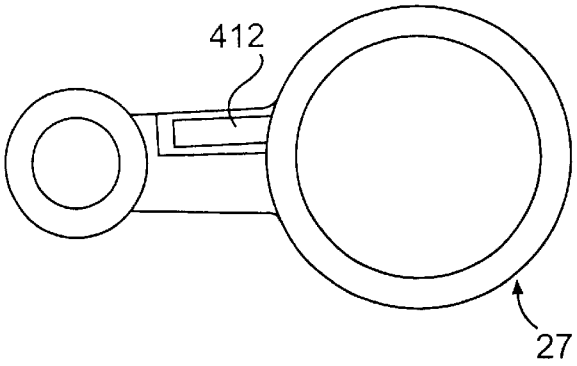
FIG. 29A is a cross sectional view of a connecting rod according to another embodiment of the present invention.
Figure 29B:
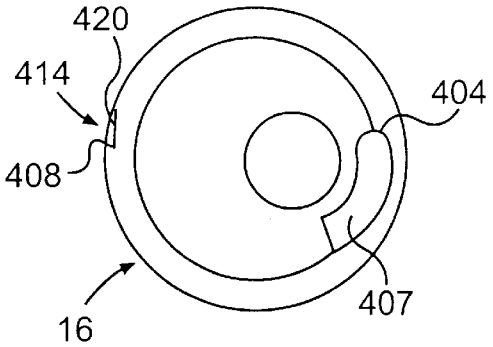
FIG. 29B is a cross sectional view of an eccentric cam according to another embodiment of the present invention.
Figure 29C:
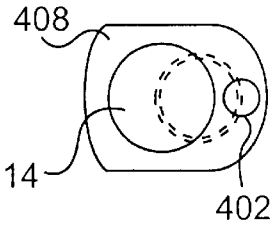
FIG. 29C is a cross sectional view of a crankpin and a crankshaft according to another embodiment of the present invention.
Figure 29D:
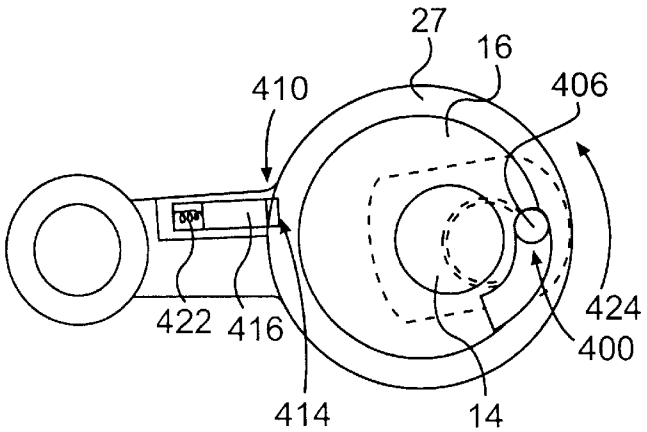
FIG. 29D is a cross sectional view illustrating a compressor operation when the crankpin is rotating in a forward direction.
Figure 29E:
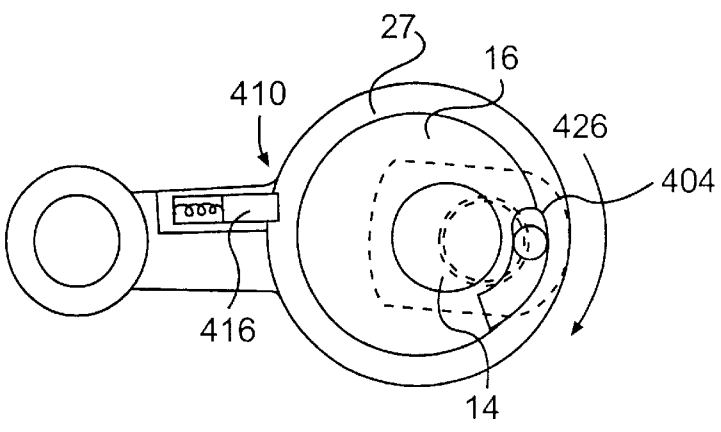
FIG. 29E is a cross sectional view illustrating a compressor operation when the crankpin is rotating in a reverse direction.
Figure 30A:
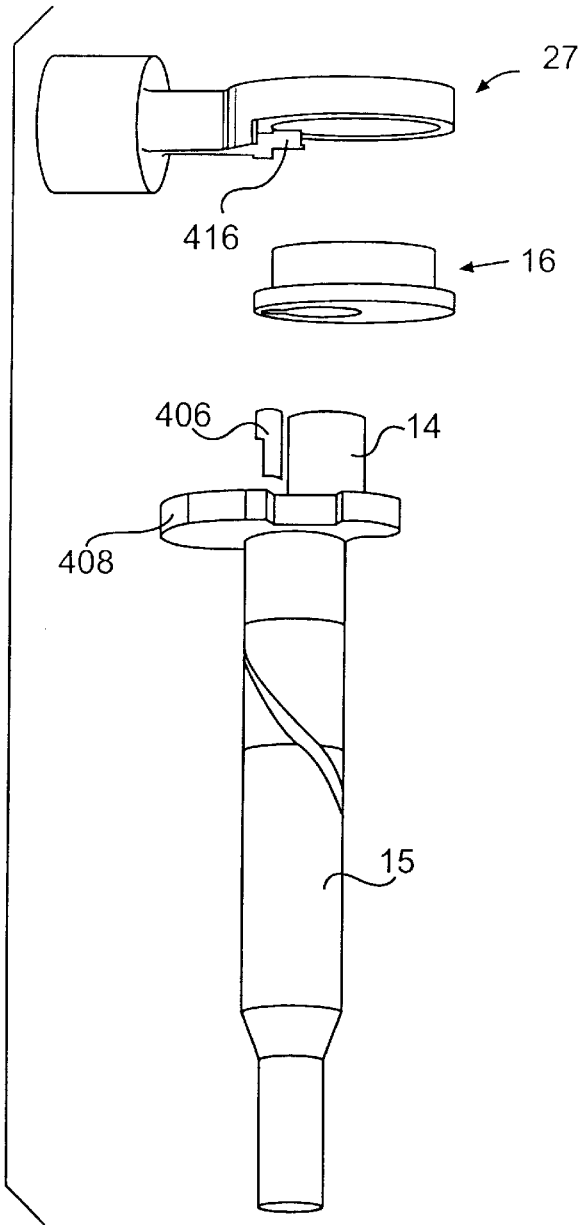
FIGS. 30A through 30C are perspective views of a connecting rod, an eccentric cam, a crankpin, and a crankshaft shown in FIGS. 29A through 29E.
Figure 30B:
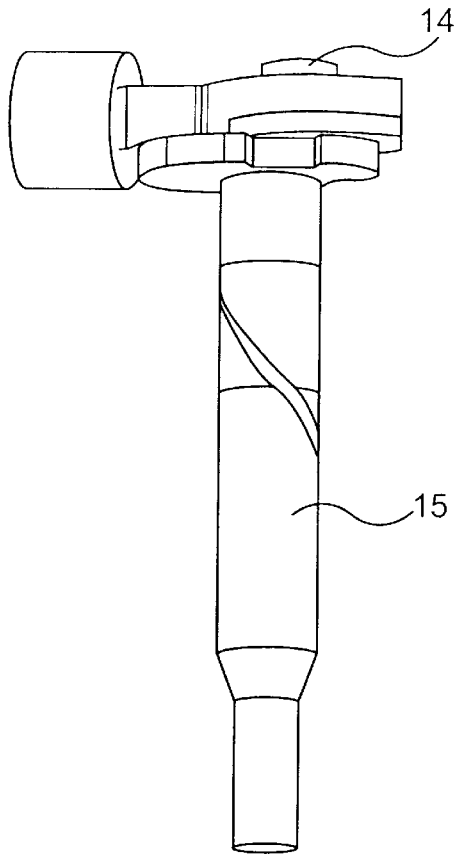
Figure 30C:
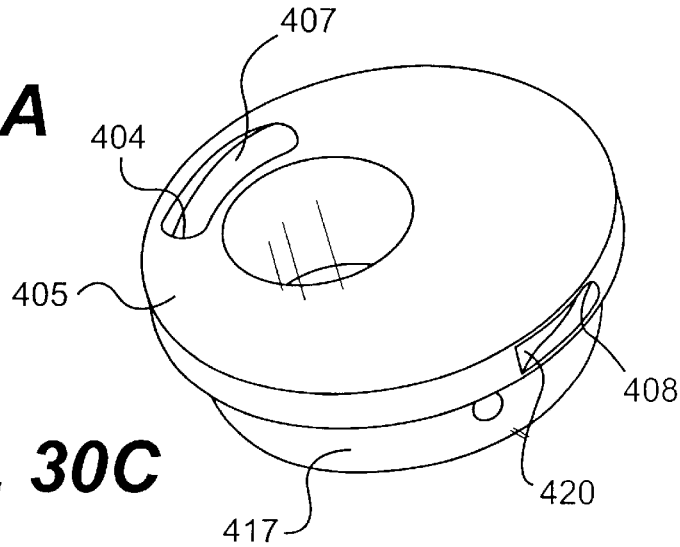
Figure 31A:
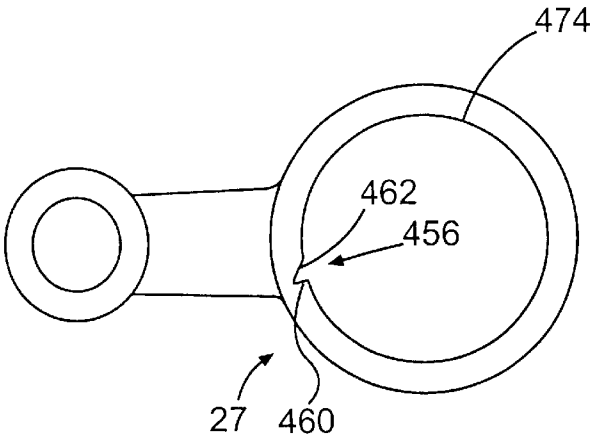
FIG. 31A is a cross sectional view of a connecting rod according to another embodiment of the present invention.
Figure 31B:
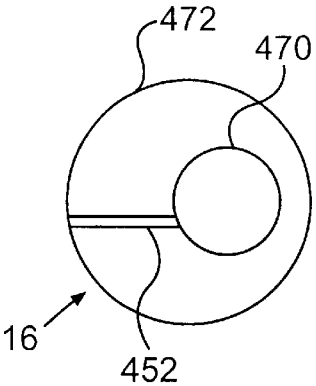
FIG. 31B is a cross sectional view of an eccentric cam according to another embodiment of the present invention.
Figure 31C:
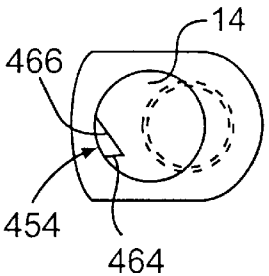
FIG. 31C is a cross sectional view of a crankpin and a crankshaft according to another embodiment of the present invention.
Figure 31D:
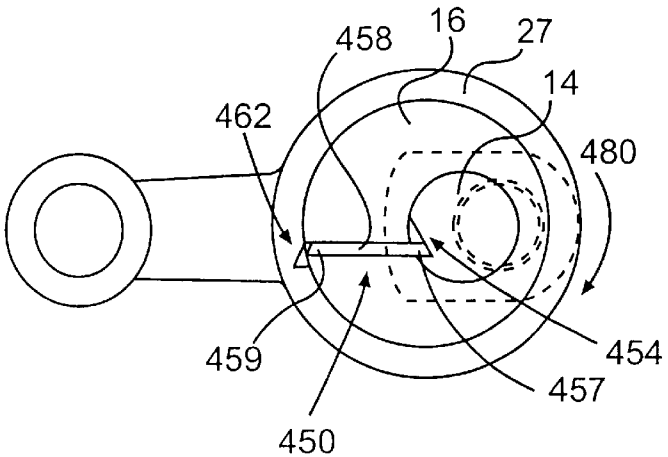
FIG. 31D is a cross sectional view illustrating a compressor operation when the crankpin is rotating in a forward direction.
Figure 31E:
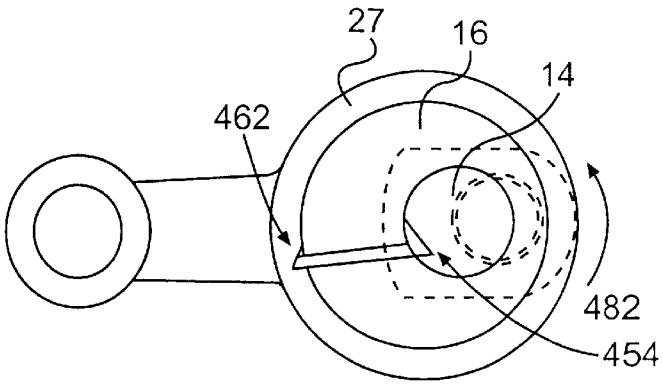
FIG. 31E is a cross sectional view illustrating a compressor operation when the crankpin is rotating in a reverse direction.
Figure 32A:
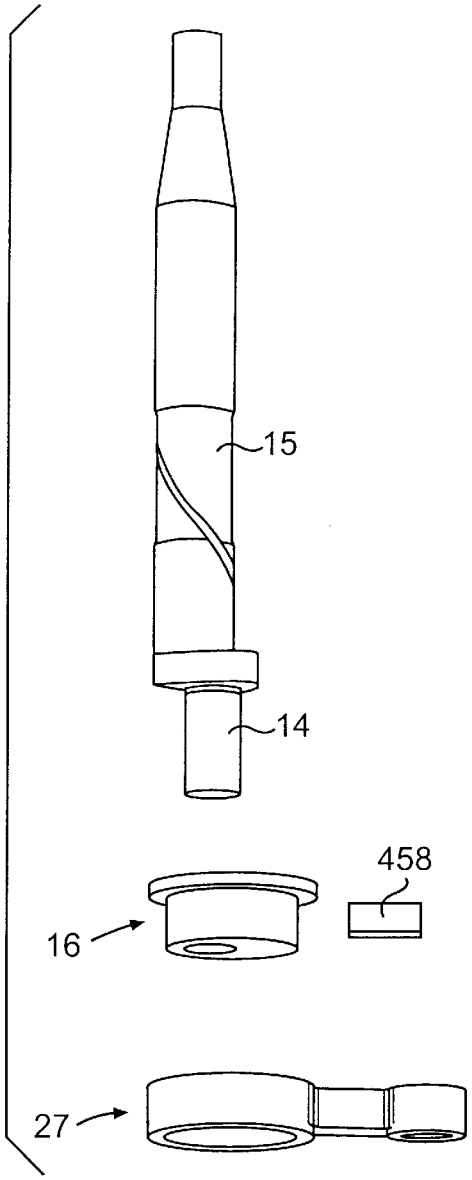
FIGS. 32A through 32F are perspective views of a connecting rod, an eccentric cam, a crankpin, and a crankshaft shown in FIGS. 31A through 31E.
Figure 32B:
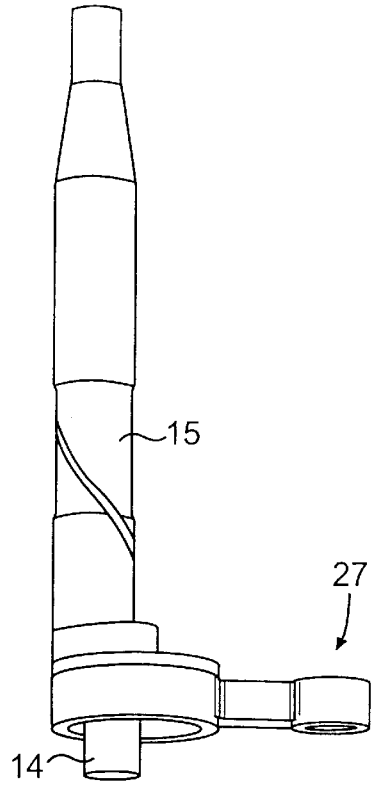
Figure 32C:
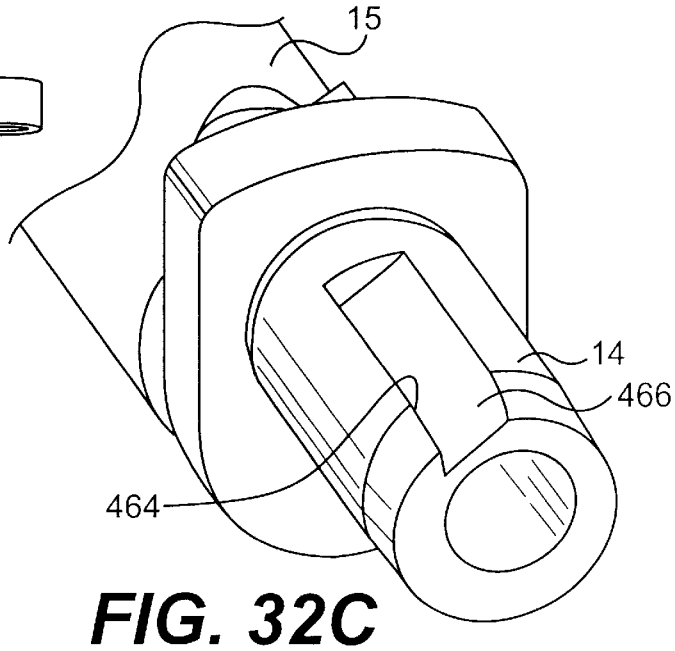
Figure 32D:
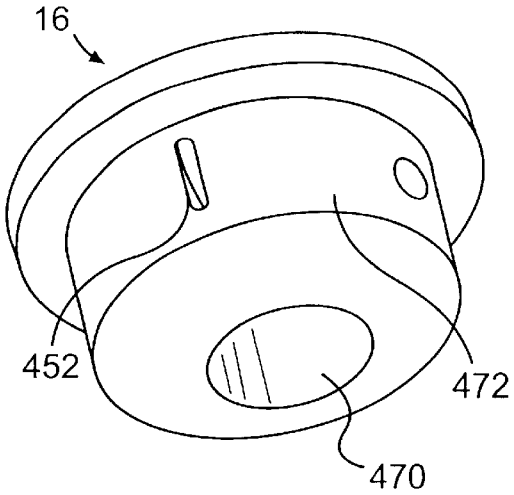
Figure 32E:
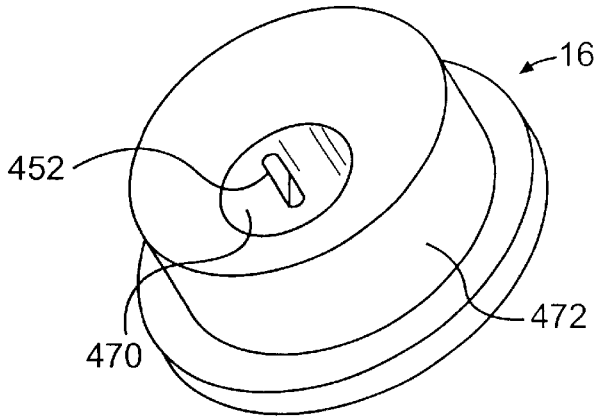
Figure 32F:
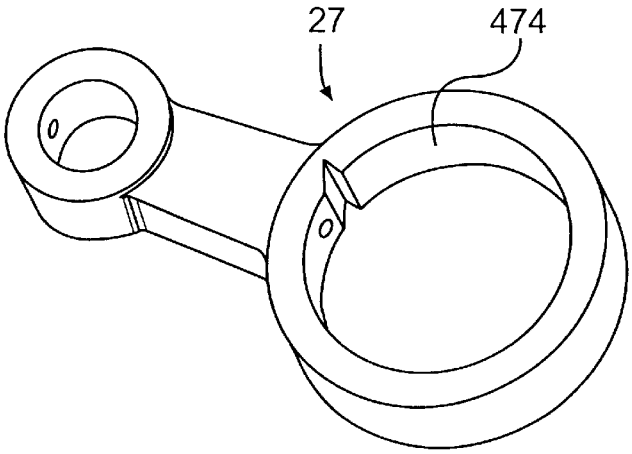
Figure 33A:
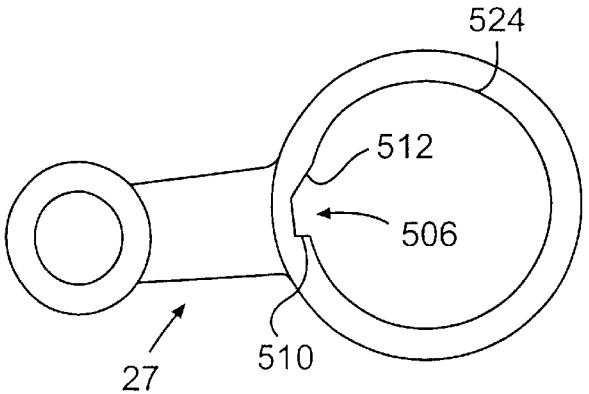
FIG. 33A is a cross sectional view of a connecting rod according to another embodiment of the present invention.
Figure 33B:
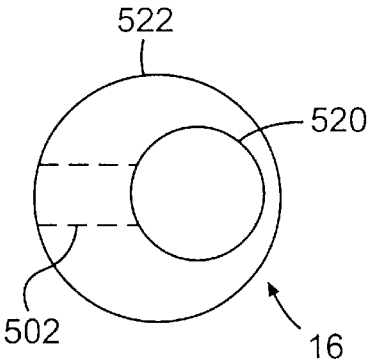
FIG. 33B is a cross sectional view of an eccentric cam according to another embodiment of the present invention.
Figure 33C:
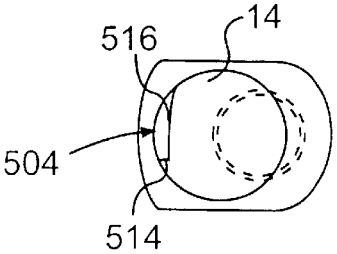
FIG. 33C is a cross sectional view of a crankpin and a crankshaft according to another embodiment of the present invention.
Figure 33D:
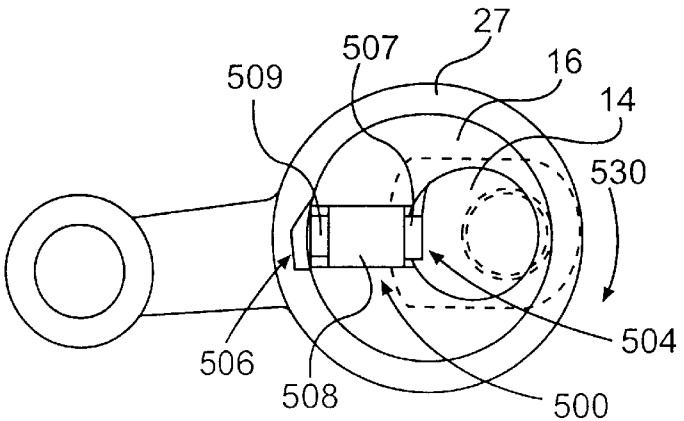
FIG. 33D is a cross sectional view illustrating a compressor operation when the crankpin is rotating in a forward direction.
Figure 33E:
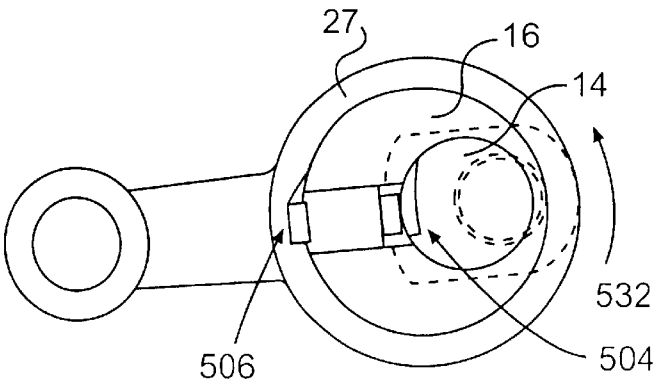
FIG. 33E is a cross sectional view illustrating a compressor operation when the crankpin is rotating in a reverse direction.
Figure 34A:
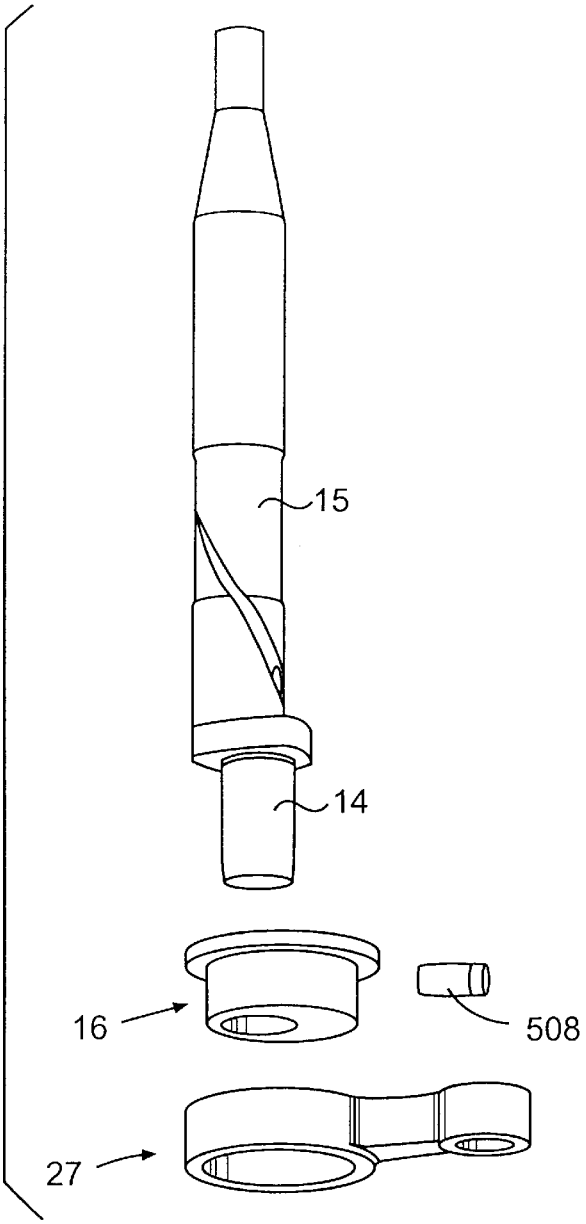
FIGS. 34A through 34F are perspective views of a connecting rod, an eccentric cam, a crankpin, and a crankshaft shown in FIGS. 33A through 33E.
Figure 34B:
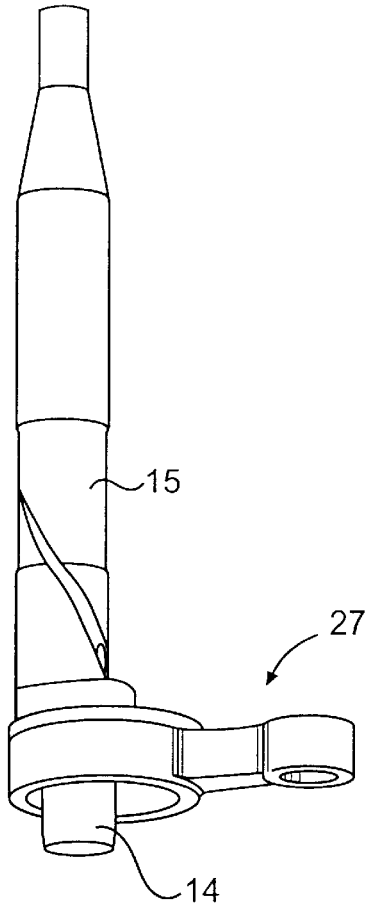
Figure 34C:
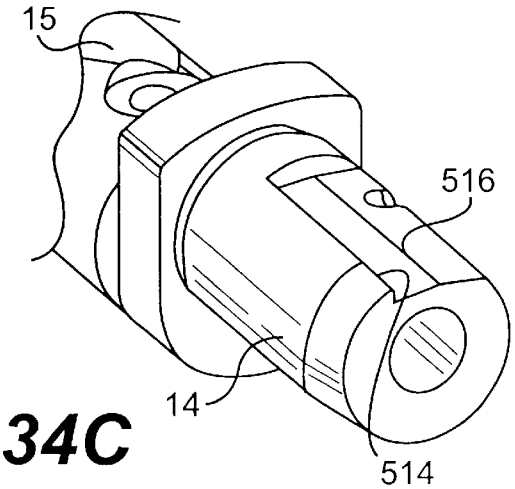
Figure 34D:
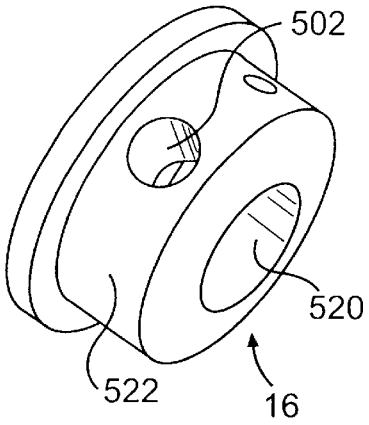
Figure 34E:
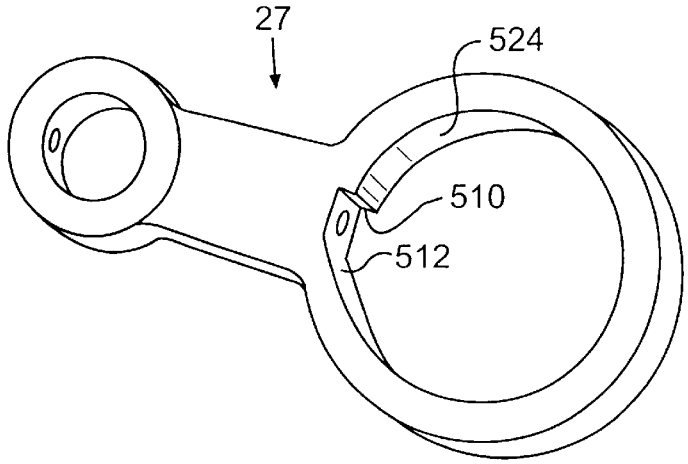
Figure 34F:
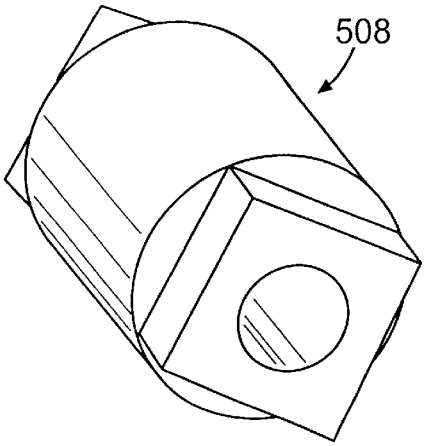

The refrigeration cycle may also be used with a refrigerator appliance. As illustrated in FIG. 20, a refrigerator 140 includes at least one insulated cooling compartment 144. A temperature sensor 142 is positioned inside compartment 144. Depending on the temperature of compartment 144, the compressor may be operated in either the full stroke or reduced stroke mode. Preferably, the compressor is continuously operated in the reduced stroke mode until a high cooling demand, such as opening the door or introducing a load of relatively warm perishables, is placed on the refrigerator. When the high demand is sensed by sensor 142 by a rise in the temperature of compartment 144, the compressor may be switched to full stroke mode to compensate for the increased demand. In this manner, compartment 144 of refrigerator 140 may be kept cool efficiently and reliably.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A two stage reciprocating compressor comprising:

a block with a single cylinder and associated single compression chamber and single piston;

a crankshaft having an eccentric crankpin, the eccentric crankpin operatively connected to the piston;

a reversible motor operable to rotate the crankshaft in a forward direction and in a reverse direction; and an eccentric cam rotatably mounted on the eccentric crankpin, the cam held stationary at a first position with respect to the crankpin when the crankshaft is rotating in the forward direction to drive the piston at a full stroke between a bottom position and a top dead center position, the cam rotating to a second position with respect to the crankpin when the crankshaft is rotating in the reverse direction to drive the piston at a reduced stroke between an intermediate position and the top dead center position, wherein the eccentricities of the crankpin and the cam combine to move the piston through the full stroke when the motor is rotating in the forward direction and to move the piston through the reduced stroke when the motor is rotating in the reverse direction, wherein the eccentricities of the cam and the crankpin are chosen so that the capacity of the compressor is switched from full to approximately one half, upon reversing of the motor.

2. The compressor of claim 1, further comprising a connecting rod operatively linking the cam with the piston.

3. The compressor of claim 2, further comprising a means for restricting relative rotation of the cam about the crankpin when the motor is running in the forward direction and a means for restricting relative rotation of the cam with respect to the connecting rod when the motor is running in the reverse direction.

4. The compressor of claim 2, further comprising a stop mechanism for restricting relative rotation of the cam about the crankpin when the motor is running in the forward direction and for restricting relative rotation of the cam with respect to the connecting rod when the motor is running in the reverse direction.

5. A two stage compressor comprising:

a block with a single cylinder and associated single compression chamber and single piston;

a crankshaft having an eccentric crankpin, the eccentric crankpin operatively connected to the piston;

a reversible motor operable to rotate the crankshaft in a forward direction and in a reverse direction;

an eccentric cam rotatably mounted on the eccentric crankpin, the cam held stationary at a first position with respect to the crankpin when the crankshaft is rotating in the forward direction to drive the piston at a full stroke between a bottom position and a top dead center position, the cam rotating to a second position with respect to the crankpin when the crankshaft is rotating in the reverse direction to drive the piston at a reduced stroke between an intermediate position and the top dead center position;

a connecting rod operatively linking the cam with the piston; and a stop mechanism for restricting relative rotation of the cam about the crankpin when the motor is running in the forward direction and for restricting relative rotation of the cam with respect to the connecting rod when the motor is running in the reverse direction, wherein the stop mechanism comprises a bore extending through the cam and a sliding block disposed within the bore, the sliding block engaging a catch in the crankpin when the motor is running in the forward direction, the sliding block engaging a catch in the connecting rod when the motor is running in the reverse direction.

6. The compressor of claim 5, wherein the catch in the crankpin and the catch in the connecting rod include a stop surface and an angled surface.

7. A two stage compressor comprising:

a block with a single cylinder and associated single compression chamber and single piston;

a crankshaft having an eccentric crankpin, the eccentric crankpin operatively connected to the piston;

a reversible motor operable to rotate the crankshaft in a forward direction and in a reverse direction;

an eccentric cam rotatably mounted on the eccentric crankpin, the cam held stationary at a first position with respect to the crankpin when the crankshaft is rotating in the forward direction to drive the piston at a full stroke between a bottom position and a top dead center position, the cam rotating to a second position with respect to the crankpin when the crankshaft is rotating in the reverse direction to drive the piston at a reduced stroke between an intermediate position and the top dead center position;

a connecting rod operatively linking the cam with the piston; and a stop mechanism for restricting relative rotation of the cam about the crankpin when the motor is running in the forward direction and for restricting relative rotation of the cam with respect to the connecting rod when the motor is running in the reverse direction, wherein the stop mechanism comprises a bore extending through the cam and a sliding pin disposed within the bore, the sliding pin engaging a catch in the crankpin when the motor is running in the forward direction, the sliding pin engaging a catch in the connecting rod when the motor is running in the reverse direction.

8. The compressor of claim 7, wherein the catch in the crankpin and the catch in the connecting rod include a stop surface and an angled surface.

9. The compressor of claim 3, further comprising a means for restricting relative rotation of the cam about the crankpin when the motor is running in the forward direction and for restricting relative rotation of the cam with respect to the connecting rod when the motor is running in the reverse direction.

10. A two stage compressor comprising:

a block with a single cylinder and associated single compression chamber and single piston;

a crankshaft having an eccentric crankpin, the eccentric crankpin operatively connected to the piston;

a reversible motor operable to rotate the crankshaft in a forward direction and in a reverse direction;

an eccentric cam rotatably mounted on the eccentric crankpin, the cam held stationary at a first position with respect to the crankpin when the crankshaft is rotating in the forward direction to drive the piston at a full stroke between a bottom position and a top dead center position, the cam rotating to a second position with respect to the crankpin when the crankshaft is rotating in the reverse direction to drive the piston at a reduced stroke between an intermediate position and the top dead center position;

a connecting rod operatively linking the cam with the piston; and a first stop mechanism for restricting relative rotation of the cam about the crankpin when the motor is running in the forward direction and a second stop mechanism for restricting relative rotation of the cam with respect to the connecting rod when the motor is running in the reverse direction.

11. The compressor of claim 10, wherein the first stop mechanism includes a pawl disposed within a recess formed in the cam, the pawl being biased toward the crankpin and configured to engage a catch in the crankpin when the motor is running in the forward direction.

12. The compressor of claim 11, wherein the second stop mechanism includes a pawl disposed within a recess formed in the connecting rod, the pawl being biased toward the cam and configured to engage a catch in the cam when the motor is running in the reverse direction.

13. The compressor of claim 12, wherein the catch in the crankpin and the catch in the cam include a stop surface and an angled surface.

14. The compressor of claim 12, wherein the pawl disposed in the cam and the pawl disposed in the connecting rod are biased by springs.

15. The compressor of claim 12, wherein the pawl disposed in the cam and the pawl disposed in the connecting rod are biased by gravity.

16. The compressor of claim 10, wherein the first stop mechanism includes a mechanical member configured to selectively link the cam with the crankpin along an axis substantially parallel with an axis of the crankpin.

17. The compressor of claim 16, wherein the mechanical member of the first stop mechanism is a pin is biased toward the crankshaft from the cam and is configured to engage a catch in the crankshaft when the motor is running in the forward direction.

18. The compressor of claim 17, wherein the crankshaft includes a ramp configured for the pin to ride along when the motor is running in the reverse direction.

19. The compressor of claim 10, wherein the mechanical member of the first stop mechanism is a pin biased toward the cam from the crankshaft and is configured to engage a catch in the cam when the motor is running in the forward direction.

20. The compressor of claim 19, wherein the cam includes a ramp configured for the pin to ride along when the motor is running in the reverse direction.

21. The compressor of claim 16, wherein the second stop mechanism includes a mechanical member configured to selectively link the cam with the connecting rod along an axis substantially parallel with the axis of the crankpin.

22. The compressor of claim 21, wherein the mechanical member of the second stop mechanism is a pin biased toward the connecting rod from the cam to engage a catch in the connecting rod when the motor is running in the reverse direction.

23. The compressor of claim 22, wherein the connecting rod includes a ramp configured for the pin to ride along when the motor is running in the forward direction.

24. The compressor of claim 16, wherein the second stop mechanism includes a mechanical member configured to selectively link the cam with the connecting rod along an axis substantially perpendicular to the axis of the crankpin.

25. The compressor of claim 24, wherein the mechanical member of the first stop mechanism is a pin biased toward the cam from the crankshaft to engage a catch in the cam when the motor is running in the forward direction.

26. The compressor of claim 25, wherein the cam includes a ramp configured for the pin to ride along when the motor is running in the reverse direction.

27. The compressor of claim 24, wherein the mechanical member of the second stop mechanism is a pin biased toward the cam from the connecting rod and is configured to engage a catch in the cam when the motor is running in the reverse direction.

28. The compressor of claim 27, wherein the catch in the cam includes a stop surface and an angled surface.

29. The compressor of claim 10, wherein the first stop mechanism includes a mechanical member configured to selectively link the cam with the crankpin along an axis substantially perpendicular to an axis of the crankpin.

30. The compressor of claim 29, wherein the mechanical member of the first stop mechanism is a pin biased toward the crankpin from the cam and is configured to engage a catch in the crankpin when the motor is running in the forward direction.

31. The compressor of claim 30, wherein the cam include a ramp configured for the pin to ride along when the motor is running in the reverse direction.

32. The compressor of claim 30, wherein the catch in the crankpin includes a stop surface and an angled surface.

33. The compressor of claim 29, wherein the second stop mechanism includes a mechanical member configured to selectively link the cam with the connecting rod along an axis substantially perpendicular to the axis of the crankpin.

34. The compressor of claim 33, wherein the mechanical member of the second stop mechanism is a pin biased toward the cam from the connecting rod and is configured to engage a catch in the cam when the motor is running in the reverse direction.

35. The compressor of claim 34, wherein the catch in the cam includes a stop surface and an angled surface.

36. A refrigerator appliance comprising:

at least one insulated cooling compartment;

a two stage reciprocating compressor having an electrical motor, a single cylinder with an associated single compression chamber and single piston, and an eccentric cam rotatably mounted on an eccentric crankpin, the cam held stationary at a first position with respect to the crankpin when the motor is rotating in a forward direction to drive the piston at a full stroke between a bottom position and a top dead center position and rotating to a second position with respect to the crankpin when the motor is rotating in a reverse direction to drive the piston at a reduced stroke between an intermediate position and the top dead center position; and an evaporator, an expansion valve, and a condenser in series with the compressor and placed in a system designed to cool the cooling compartment, wherein the compressor includes a crankshaft rotated by the motor, a connecting rod operatively linking the cam with the piston, and a stop mechanism for restricting relative rotation of the cam about the crankpin when the motor is running in the forward direction and for restricting relative rotation of the cam with respect to the connecting rod when the motor is running in the reverse direction, wherein the stop mechanism comprises a bore extending through the cam and a sliding pin disposed within the bore, the sliding pin engaging a catch in the crankpin when the motor is running in the forward direction, the sliding pin engaging a catch in the connecting rod when the motor is running in the reverse direction.

37. The refrigerator appliance of claim 36, wherein the catch in the crankpin and the catch in the connecting rod include a stop surface and an angled surface.

38. A refrigerator appliance comprising:

at least one insulated cooling compartment;

a two stage reciprocating compressor having an electrical motor, a single cylinder with an associated single compression chamber and single piston, and an eccentric cam rotatably mounted on an eccentric crankpin, the cam held stationary at a first position with respect to the crankpin when the motor is rotating in a forward direction to drive the piston at a full stroke between a bottom position and a top dead center position and rotating to a second position with respect to the crankpin when the motor is rotating in a reverse direction to drive the piston at a reduced stroke between an intermediate position and the top dead center position; and an evaporator, an expansion valve, and a condenser in series with the compressor and placed in a system designed to cool the cooling compartment, wherein the eccentricities of the cam and the crankpin are chosen so that the capacity of the compressor is switched from full to approximately one half, upon reversing of the motor.

39. The refrigerator appliance of claim 38, wherein the compressor operates at the full stroke when the difference between a temperature within the cooling compartment and a desired temperature exceeds a preselected value and at the reduced stroke when that difference falls below the preselected value and above a second preselected value.

40. The refrigerator appliance of claim 38, wherein the eccentricities of the crankpin and the cam combine to move the piston through the full stroke when the motor is operated in the forward direction and to move the piston through the reduced stroke when the motor is operated in the reverse direction.

41. The refrigerator appliance of claim 38, wherein the compressor includes a crankshaft rotated by the motor and a connecting rod operatively linking the cam with the piston.

42. The refrigerator appliance of claim 41, wherein the compressor further includes a stop mechanism for restricting relative rotation of the cam about the crankpin when the motor is running in the forward direction and for restricting relative rotation of the cam with respect to the connecting rod when the motor is running in the reverse direction.

43. A refrigerator appliance comprising:

at least one insulated cooling compartment;

a two stage reciprocating compressor having an electrical motor, a single cylinder with an associated single compression chamber and single piston, and an eccentric cam rotatably mounted on an eccentric crankpin, the cam held stationary at a first position with respect to the crankpin when the motor is rotating in a forward direction to drive the piston at a full stroke between a bottom position and a top dead center position and rotating to a second position with respect to the crankpin when the motor is rotating in a reverse direction to drive the piston at a reduced stroke between an intermediate position and the top dead center position; and an evaporator, an expansion valve, and a condenser in series with the compressor and placed in a system designed to cool the cooling compartment, wherein the compressor includes a crankshaft rotated by the motor, a connecting rod operatively linking the cam with the piston, and a stop mechanism for restricting relative rotation of the cam about the crankpin when the motor is running in the forward direction and for restricting relative rotation of the cam with respect to the connecting rod when the motor is running in the reverse direction, wherein the stop mechanism comprises a bore extending through the cam and a sliding block disposed within the bore, the sliding block engaging a catch in the crankpin when the motor is running in the forward direction, the sliding block engaging a catch in the connecting rod when the motor is running in the reverse direction.

44. The refrigerator appliance of claim 43, wherein the catch in the crankpin and the catch in the connecting rod include a stop surface and an angled surface.

45. A heating, ventilating, and air conditioning ("HVAC") system for conditioning air in an enclosure, comprising:

a condenser;

an expansion device;

an evaporator; and a two stage reciprocating compressor having an electrical motor, a single cylinder with an associated single compression chamber and single piston, and an eccentric cam rotatably mounted on an eccentric crankpin, the cam held stationary at a first position with respect to the crankpin when the motor is rotating in a forward direction to drive the piston at a full stroke between a bottom position and a top dead center position and rotating to a second position with respect to the crankpin when the motor is rotating in a reverse direction to drive the piston at a reduced stroke between an intermediate position and the top dead center position, wherein the compressor includes a crankshaft rotated by the motor, a connecting rod operatively linking the cam with the piston, and a stop mechanism for restricting relative rotation of the cam about the crankpin when the motor is running in the forward direction and for restricting relative rotation of the cam with respect to the connecting rod when the motor is running in the reverse direction, wherein the stop mechanism comprises a bore extending through the cam and a sliding block disposed within the bore, the sliding block engaging a catch in the crankpin when the motor is running in the forward direction, the sliding block engaging a catch in the connecting rod when the motor is running in the reverse direction.

46. The system of claim 45, wherein the catch in the crankpin and the catch in the connecting rod include a stop surface and an angled surface.

47. The refrigerator appliance of claim 41, wherein the compressor further includes a means for restricting relative rotation of the cam about the crankpin when the motor is running in the forward direction and for restricting relative rotation of the cam with respect to the connecting rod when the motor is running in the reverse direction.

48. A refrigerator appliance comprising:

at least one insulated cooling compartment;

a two stage reciprocating compressor having an electrical motor, a single cylinder with an associated single compression chamber and single piston, and an eccentric cam rotatably mounted on an eccentric crankpin, the cam held stationary at a first position with respect to the crankpin when the motor is rotating in a forward direction to drive the piston at a full stroke between a bottom position and a top dead center position and rotating to a second position with respect to the crankpin when the motor is rotating in a reverse direction to drive the piston at a reduced stroke between an intermediate position and the top dead center position; and an evaporator, an expansion valve, and a condenser in series with the compressor and placed in a system designed to cool the cooling compartment, wherein the compressor includes a crankshaft rotated by the motor and a connecting rod operatively linking the cam with the piston, wherein the compressor further includes a first stop mechanism for restricting relative rotation of the cam about the crankpin when the motor is running in the forward direction and a second stop mechanism for restricting relative rotation of the cam with respect to the connecting rod when the motor is running in the reverse direction.

49. The refrigerator appliance of claim 48, wherein the first stop mechanism includes a pawl disposed within a recess formed in the cam, the pawl being biased toward the crankpin and configured to engage a catch in the crankpin when the motor is running in the forward direction.

50. The refrigerator appliance of claim 49, wherein the second stop mechanism includes a pawl disposed within a recess formed in the connecting rod, the pawl being biased toward the cam and configured to engage a catch in the cam when the motor is running in the reverse direction.

51. The refrigerator appliance of claim 50, wherein the catch in the crankpin and the catch in the cam include a stop surface and an angled surface.

52. The refrigerator appliance of claim 50, wherein the pawl disposed in the cam and the pawl disposed in the connecting rod are biased by springs.

53. The refrigerator appliance of claim 50, wherein the pawl disposed in the cam and the pawl disposed in the connecting rod are biased by gravity.

54. The refrigerator appliance of claim 48, wherein the first stop mechanism includes a mechanical member configured to selectively link the cam with the crankpin along an axis substantially parallel with an axis of the crankpin.

55. The refrigerator appliance of claim 54, wherein the mechanical member of the first stop mechanism is a pin is biased toward the crankshaft from the cam and is configured to engage a catch in the crankshaft when the motor is running in the forward direction.

56. The refrigerator appliance of claim 55, wherein the crankshaft includes a ramp configured for the pin to ride along when the motor is running in the reverse direction.

57. The refrigerator appliance of claim 48, wherein the mechanical member of the first stop mechanism is a pin biased toward the cam from the crankshaft and is configured to engage a catch in the cam when the motor is running in the forward direction.

58. The refrigerator appliance of claim 57, wherein the cam includes a ramp configured for the pin to ride along when the motor is running in the reverse direction.

59. The refrigerator appliance of claim 54, wherein the second stop mechanism includes a mechanical member configured to selectively link the cam with the connecting rod along an axis substantially parallel with the axis of the crankpin.

60. The refrigerator appliance of claim 59, wherein the mechanical member of the second stop mechanism is a pin biased toward the connecting rod from the cam to engage a catch in the connecting rod when the motor is running in the reverse direction.

61. The refrigerator appliance of claim 60, wherein the connecting rod includes a ramp configured for the pin to ride along when the motor is running in the forward direction.

62. The refrigerator appliance of claim 54, wherein the second stop mechanism includes a mechanical member configured to selectively link the cam with the connecting rod along an axis substantially perpendicular to the axis of the crankpin.

63. The refrigerator appliance of claim 62, wherein the mechanical member of the first stop mechanism is a pin biased toward the cam from the crankshaft to engage a catch in the cam when the motor is running in the forward direction.

64. The refrigerator appliance of claim 63, wherein the cam includes a ramp configured for the pin to ride along when the motor is running in the reverse direction.

65. The refrigerator appliance of claim 62, wherein the mechanical member of the second stop mechanism is a pin biased toward the cam from the connecting rod and is configured to engage a catch in the cam when the motor is running in the reverse direction.

66. The refrigerator appliance of claim 65, wherein the catch in the cam includes a stop surface and an angled surface.

67. The refrigerator appliance of claim 48, wherein the first stop mechanism includes a mechanical member configured to selectively link the cam with the crankpin along an axis substantially perpendicular to an axis of the crankpin.

68. The refrigerator appliance of claim 67, wherein the mechanical member of the first stop mechanism is a pin biased toward the crankpin from the cam and is configured to engage a catch in the crankpin when the motor is running in the forward direction.

69. The refrigerator appliance of claim 68, wherein the cam include a ramp configured for the pin to ride along when the motor is running in the reverse direction.

70. The refrigerator appliance of claim 68, wherein the catch in the crankpin includes a stop surface and an angled surface.

71. The refrigerator appliance of claim 67, wherein the second stop mechanism includes a mechanical member configured to selectively link the cam with the connecting rod along an axis substantially perpendicular to the axis of the crankpin.

72. The refrigerator appliance of claim 67, wherein the mechanical member of the second stop mechanism is a pin biased toward the cam from the connecting rod and is configured to engage a catch in the cam when the motor is running in the reverse direction.

73. The refrigerator appliance of claim 72, wherein the catch in the cam includes a stop surface and an angled surface.

74. The refrigerator appliance of claim 41, wherein the compressor further includes a means for restricting relative rotation of the cam about the crankpin when the motor is running in the forward direction and a means for restricting relative rotation of the cam with respect to the connecting rod when the motor is running in the reverse direction.

75. A heating, ventilating, and air conditioning ("HVAC") system for conditioning air in an enclosure, comprising:

a condenser;

an expansion device;

an evaporator; and a two stage reciprocating compressor having an electrical motor, a single cylinder with an associated single compression chamber and single piston, and an eccentric cam rotatably mounted on an eccentric crankpin, the cam held stationary at a first position with respect to the crankpin when the motor is rotating in a forward direction to drive the piston at a full stroke between a bottom position and a top dead center position and rotating to a second position with respect to the crankpin when the motor is rotating in a reverse direction to drive the piston at a reduced stroke between an intermediate position and the top dead center position, wherein the eccentricities of the cam and the crankpin are chosen so that the capacity of the compressor is switched from full to approximately one half, upon reversing of the motor.

76. The system of claim 75, wherein the compressor operates at the full stroke when the difference between a temperature within the enclosure and a desired temperature exceeds a preselected value and at the reduced stroke when that difference falls below the preselected value and above a second preselected value.

77. The system of claim 75, wherein the eccentricities of the crankpin and the cam combine to move the piston to through the full stroke when the motor is operated in the forward direction and to move the piston through the reduced stroke when the motor is operated in the reverse direction.

78. The system of claim 75, wherein the compressor includes a crankshaft rotated by the motor and a connecting rod operatively linking the cam with the piston.

79. The system of claim 78, wherein the compressor further includes a stop mechanism for restricting relative rotation of the cam about the crankpin when the motor is running in the forward direction and for restricting relative rotation of the cam with respect to the connecting rod when the motor is running in the reverse direction.

80. A heating, ventilating, and air conditioning ("HVAC") system for conditioning air in an enclosure, comprising:

a condenser;

an expansion device;

an evaporator; and a two stage reciprocating compressor having an electrical motor, a single cylinder with an associated single compression chamber and single piston, and an eccentric cam rotatably mounted on an eccentric crankpin, the cam held stationary at a first position with respect to the crankpin when the motor is rotating in a forward direction to drive the piston at a full stroke between a bottom position and a top dead center position and rotating to a second position with respect to the crankpin when the motor is rotating in a reverse direction to drive the piston at a reduced stroke between an intermediate position and the top dead center position, wherein the compressor includes a crankshaft rotated by the motor, a connecting rod operatively linking the cam with the piston, and a stop mechanism for restricting relative rotation of the cam about the crankpin when the motor is running in the forward direction and for restricting relative rotation of the cam with respect to the connecting rod when the motor is running in the reverse direction, wherein the stop mechanism comprises a bore extending through the cam and a sliding pin disposed within the bore, the sliding pin engaging a catch in the crankpin when the motor is running in the forward direction, the sliding pin engaging a catch in the connecting rod when the motor is running in the reverse direction.

81. The system of claim 80, wherein the catch in the crankpin and the catch in the connecting rod include a stop surface and an angled surface.

82. The system of claim 78, wherein the compressor further includes a means for restricting relative rotation of the cam about the crankpin when the motor is running in the forward direction and for restricting relative rotation of the cam with respect to the connecting rod when the motor is running in the reverse direction.

83. A heating, ventilating, and air conditioning ("HVAC") system for conditioning air in an enclosure, comprising:

a condenser;

an expansion device;

an evaporator; and a two stage reciprocating compressor having an electrical motor, a single cylinder with an associated single compression chamber and single piston, and an eccentric cam rotatably mounted on an eccentric crankpin, the cam held stationary at a first position with respect to the crankpin when the motor is rotating in a forward direction to drive the piston at a full stroke between a bottom position and a top dead center position and rotating to a second position with respect to the crankpin when the motor is rotating in a reverse direction to drive the piston at a reduced stroke between an intermediate position and the top dead center position, wherein the compressor includes a crankshaft rotated by the motor and a connecting rod operatively linking the cam with the piston, wherein the compressor further includes a first stop mechanism for restricting relative rotation of the cam about the crankpin when the motor is running in the forward direction and a second step mechanism for restricting relative rotation of the cam with respect to the connecting rod when the motor is running in the reverse direction.

84. The system of claim 83, wherein the first stop mechanism includes a pawl disposed within a recess formed in the cam, the pawl being biased toward the crankpin and configured to engage a catch in the crankpin when the motor is running in the forward direction.

85. The system of claim 84, wherein the second stop mechanism includes a pawl disposed within a recess formed in the connecting rod, the pawl being biased toward the cam and configured to engage a catch in the cam when the motor is running in the reverse direction.

86. The system of claim 85, wherein the catch in the crankpin and the catch in the cam include a stop surface and an angled surface.

87. The system of claim 85, wherein the pawl disposed in the cam and the pawl disposed in the connecting rod are biased by springs.

88. The system of claim 87, wherein the pawl disposed in the cam and the pawl disposed in the connecting rod are biased by gravity.

89. The system of claim 83, wherein the first stop mechanism includes a mechanical member configured to selectively link the cam with the crankpin along an axis substantially parallel with an axis of the crankpin.

90. The system of claim 89, wherein the mechanical member of the first stop mechanism is a pin is biased toward the crankshaft from the cam and is configured to engage a catch in the crankshaft when the motor is running in the forward direction.

91. The system of claim 90, wherein the crankshaft includes a ramp configured for the pin to ride along when the motor is running in the reverse direction.

92. The system of claim 83, wherein the mechanical member of the first stop mechanism is a pin biased toward the cam from the crankshaft and is configured to engage a catch in the cam when the motor is running in the forward direction.

93. The system of claim 92, wherein the cam includes a ramp configured for the pin to ride along when the motor is running in the reverse direction.

94. The system of claim 89, wherein the second stop mechanism includes a mechanical member configured to selectively link the cam with the connecting rod along an axis substantially parallel with the axis of the crankpin.

95. The system of claim 94, wherein the mechanical member of the second stop mechanism is a pin biased toward the connecting rod from the cam to engage a catch in the connecting rod when the motor is running in the reverse direction.

96. The system of claim 95, wherein the connecting rod includes a ramp configured for the pin to ride along when the motor is running in the forward direction.

97. The system of claim 89, wherein the second stop mechanism includes a mechanical member configured to selectively link the cam with the connecting rod along an axis substantially perpendicular to the axis of the crankpin.

98. The system of claim 97, wherein the mechanical member of the first stop mechanism is a pin biased toward the cam from the crankshaft to engage a catch in the cam when the motor is running in the forward direction.

99. The system of claim 98, wherein the cam includes a ramp configured for the pin to ride along when the motor is running in the reverse direction.

100. The system of claim 97, wherein the mechanical member of the second stop mechanism is a pin biased toward the cam from the connecting rod and is configured to engage a catch in the cam when the motor is running in the reverse direction.

101. The system of claim 100, wherein the catch in the cam includes a stop surface and an angled surface.

102. The system of claim 83, wherein the first stop mechanism includes a mechanical member configured to selectively link the cam with the crankpin along an axis substantially perpendicular to an axis of the crankpin.

103. The system of claim 102, wherein the mechanical member of the first stop mechanism is a pin biased toward the crankpin from the cam and is configured to engage a catch in the crankpin when the motor is running in the forward direction.

104. The system of claim 103, wherein the cam include a ramp configured for the pin to ride along when the motor is running in the reverse direction.

105. The system of claim 103, wherein the catch in the crankpin includes a stop surface and an angled surface.

106. The system of claim 102, wherein the second stop mechanism includes a mechanical member configured to selectively link the cam with the connecting rod along an axis substantially perpendicular to the axis of the crankpin.

107. The system of claim 106, wherein the mechanical member of the second stop mechanism is a pin biased toward the cam from the connecting rod and is configured to engage a catch in the cam when the motor is running in the reverse direction.

108. The system of claim 107, wherein the catch in the cam includes a stop surface and an angled surface.

109. The system of claim 78, wherein the compressor further includes a means for restricting relative rotation of the cam about the crankpin when the motor is running in the forward direction and a means for restricting relative rotation of the cam with respect to the connecting rod when the motor is running in the reverse direction.

* * * * *

UNITED STATES PATENT AND TRADEMARK OFFICE

CERTIFICATE OF CORRECTION

PATENT NO. : 6,446,451 B1
DATED : September 10, 2002
INVENTOR(S) : David T. Monk et al.

It is certified that error appears in the above-identified patent and that said Letters Patent is hereby corrected as shown below:

Column 23,
Line 29, “claim 3” should read -- claim 2 --.

Column 24,
Line 17, after “pin” delete “is”.

Column 25,
Line 4, “include” should read -- includes --.

Column 28,
Line 22, after “pin” delete “is”.

Column 29,
Line 14, “include” should read -- includes --.
Line 67, after “piston” delete “to”.

Column 31,
Line 32, “claim 87” should read -- claim 85 --.
Line 40, after “pin” delete “is”.

Column 32,
Line 35, “include” should read -- includes --.

Signed and Sealed this

First Day of April, 2003

JAMES E. ROGAN
*Director of the United States Patent and Trademark Office*